US012508461B1

(12) United States Patent
KashKash et al.

(10) Patent No.: US 12,508,461 B1
(45) Date of Patent: Dec. 30, 2025

(54) RESISTANCE BAND EXERCISE MACHINE

(71) Applicant: OK Engineering Inc., Palm Harbor, FL (US)

(72) Inventors: Omar Ismail KashKash, Palm Harbor, FL (US); Yousef Ismail KashKash, Palm Harbor, FL (US)

(73) Assignee: OK Engineering Inc, Palm Harbor, FL (US)

( * ) Notice: Subject to any disclaimer, the term of this patent is extended or adjusted under 35 U.S.C. 154(b) by 147 days.

(21) Appl. No.: 18/475,964

(22) Filed: Sep. 27, 2023

Related U.S. Application Data

(63) Continuation-in-part of application No. 17/717,209, filed on Apr. 11, 2022, now Pat. No. 11,794,059, which is a continuation of application No. 16/916,093, filed on Jun. 29, 2020, now Pat. No. 11,324,984.

(51) Int. Cl.

| | |
|---|---|
| ***A63B 21/04*** | (2006.01) |
| ***A63B 21/00*** | (2006.01) |
| ***A63B 21/002*** | (2006.01) |
| ***A63B 21/02*** | (2006.01) |
| ***A63B 21/055*** | (2006.01) |
| ***A63B 21/28*** | (2006.01) |
| ***A63B 23/12*** | (2006.01) |

(52) U.S. Cl.

CPC .... *A63B 21/0442* (2013.01); *A63B 21/00076* (2013.01); *A63B 21/022* (2015.10); *A63B 21/0552* (2013.01); *A63B 21/154* (2013.01); *A63B 21/285* (2013.01); *A63B 21/4007* (2015.10); *A63B 23/1236* (2013.01); *A63B 21/0023* (2013.01); *A63B 21/4005* (2015.10); *A63B 21/4035* (2015.10); *A63B 2208/0257* (2013.01)

(58) Field of Classification Search

CPC . A63B 21/0442; A63B 21/022; A63B 21/023; A63B 21/0552; A63B 21/154; A63B 21/285; A63B 21/4007; A63B 21/0023; A63B 21/4005; A63B 21/4035; A63B 21/28; A63B 21/00076; A63B 23/1236; A63B 2208/0257

See application file for complete search history.

(56) References Cited

U.S. PATENT DOCUMENTS 760,374 A * 5/1904 Belvoir ..... A63B 21/0442 482/129

4,492,375 A 1/1985 Connelly (Continued)

*Primary Examiner* — Loan B Jimenez
*Assistant Examiner* — Kathleen M Fisk

(57) ABSTRACT

A resistance band exercise machine for performing various exercises. An embodiment includes a housing for a cable-pulley variable resistance system. Some embodiments are configured to receive one or more safety bars to set a starting position of an exercise. Some embodiments include a training partner assistantship feature for a training partner to assist the user by imparting a secondary force on the machine. The configuration of the cable-pulley variable resistance system may be in any manner based on the exercise. In some embodiments, a user performs an exercise on the resistance band exercise machine to overcome a primary (e.g., resistance bands) and secondary (e.g., springs) sources of variably increasing resistance from the cable-pulley variable resistance system.

18 Claims, 83 Drawing Sheets

(56) References Cited

U.S. PATENT DOCUMENTS 4,540,171 A * 9/1985 Clark ..... A63B 21/0626 482/99
4,546,971 A 10/1985 Raasoch
4,620,704 A 11/1986 Shifferaw
4,627,615 A 12/1986 Nurkowski
4,953,855 A 9/1990 Shields
5,328,429 A 7/1994 Potash et al.
5,669,861 A 9/1997 Toups
5,924,965 A * 7/1999 Vardy ..... A63B 23/03575 482/148
6,447,431 B1 9/2002 Milburn et al.
6,447,433 B1 * 9/2002 Reyes ..... A63B 21/078 482/104
6,565,490 B2 * 5/2003 O'Hearn ..... A63B 21/0628 482/102
7,387,595 B2 * 6/2008 Towley, III ..... A63B 21/4047 482/135
8,152,700 B2 * 4/2012 Adams ..... A63B 21/0628 482/97
8,187,155 B2 * 5/2012 Ooka ..... A63B 21/063 482/99
9,050,497 B2 * 6/2015 Reyes ..... A63B 21/062
9,327,157 B1 * 5/2016 Miller ..... A63B 23/03525
9,364,702 B2 * 6/2016 Staten ..... A63B 23/1227
9,656,116 B2 5/2017 Giannelli et al.
10,016,646 B2 * 7/2018 Butler ..... A63B 21/062
10,363,473 B2 * 7/2019 Martens ..... A63B 21/0724
10,369,398 B2 8/2019 Lagree et al.
10,639,515 B2 * 5/2020 Simmons ..... A63B 23/0464
10,946,241 B2 * 3/2021 KashKash ..... A63B 21/00058
11,058,909 B2 * 7/2021 Adams ..... A63B 21/4033
11,229,823 B1 * 1/2022 KashKash ..... A63B 23/03541
11,260,261 B2 * 3/2022 Henniger ..... A63B 21/062
11,324,984 B2 * 5/2022 KashKash ..... A63B 21/154
11,794,059 B1 * 10/2023 KashKash ..... A63B 21/022
2005/0119591 A1 * 6/2005 Vardy ..... A63B 21/008 600/587
2006/0252611 A1 11/2006 Quick et al.
2011/0028280 A1 * 2/2011 Adams ..... A63B 21/4047 482/94
2014/0080685 A1 * 3/2014 Butler ..... A63B 21/154 482/102
2020/0289866 A1 * 9/2020 Gvoich ..... A63B 21/4043
2021/0283451 A1 * 9/2021 Gvoich ..... A63B 23/03541
2024/0366991 A1 * 11/2024 Henseler ..... A63B 21/0632

* cited by examiner

RESISTANCE BAND EXERCISE MACHINE

CROSS-REFERENCE TO RELATED APPLICATIONS

This nonprovisional application is a continuation-in-part of and claims priority to Ser. No. 17/717,209, entitled "Resistance Band Exercise Machine," filed Apr. 11, 2022 by the same inventor(s), which is a continuation of and claims priority to nonprovisional application Ser. No. 16/916,093, entitled "Resistance Band Exercise Machine," filed Jun. 29, 2020 by the same inventor(s).

BACKGROUND OF THE INVENTION

1. Field of the Invention

The present invention relates generally to weightlifting machines to provide an increasingly variable load over the concentric range of the exercise and provide assistantship to perform a variably decreasing overload over the eccentric range of the exercise.

2. Brief Description of the Prior Art

Muscle groups have strength curves in which they can exert a maximum force output due to a mechanical advantage at a particular position or range along its motion. Resistance applied to the strong range of an exercise motion or muscle group will allow for the greatest amount of resistance to be used and it will develop the muscles, tendons, ligaments, and bones at a faster rate than if the resistance was only applied to the weak range of an exercise motion or muscle group. The amount of resistance capable of being handled over the strong range of an exercise motion or muscle group is disproportionately greater than the amount of resistance capable of being handled over the weak range due to a mechanical advantage of the limbs involved during the exercise.

As such it is desirable to increase the amount of resistance applied over the strong range of motion for an exercise motion or muscle group during the concentric phase of the exercise as well as the eccentric phase of the exercise. Moreover, yielding isometrics in which you withstand a heavy resistance, preferably as you hold a strong position for time is desirable for producing a high force output. Lastly, overcoming isometrics allows for the maximum force possible to be generated for an exercise motion or muscle group because you attempt to overcome a high level of resistance such as an immovable object as you assume a strong position preferably. This is true because of the inverse relationship between the force developed by a muscle or group of muscles and the velocity of an external load. Simply, the faster you move an external load the less force you can develop and the slower the external load moves the more force you can develop.

In view of the above it is desirable to vary the resistance increasingly along the concentric and eccentric ranges of the exercise to match the strength curves of the muscle groups involved as many existing weightlifting machines with weight stack systems do not provide this benefit as the primary source of resistance. There are weightlifting machines with secondary sources of variably increasing resistance, but they are limited as they are called supplementary for a good reason. For example, secondary sources of variably increasing resistance will usually provide a low amount of resistance to supplement the primary source of resistance to allow for an incremental progression for the total amount of resistance selected. As such the weightlifter must handle the fixed amount of primary resistance throughout the range of motion which does not allow the weightlifter to handle their maximum amount of resistance during the strong range of motion. Usually, the resistance is increasingly varied over the concentric and eccentric phases of an exercise by using a gravitational mass such as a weight stack system and resilient materials such as elastic bands or torsional springs in combination or alone. Sometimes electromechanical devices are used to provide increasingly variable resistance.

In U.S. Pat. No. 4,546,971 to Paul Raasoch (1984) an exercising device exercises the muscles of the human body by movement through an exercise stroke in which concentric and eccentric weights are selected to provide exertion to a bodily muscle function.

In U.S. Pat. No. 5,328,429 to Potash et al. (1994) an attachment for a weight stack provides a downward force to the weight stack during the eccentric portion of the exercise through the use of a drive motor and an eccentric force control cable adopted to be coupled between the drive motor and the weight stack.

In U.S. Pat. No. 5,669,861 to Lanny J. Toups (1997) a weight device creates a controlled and infinitely variable resistance by multiplying the weight selected on a weight stack over the concentric portion of the exercise. The device provides isokinetic and isotonic resistance. A device that multiplies the selected weight amount on the weight stack to provide increasingly variable resistance over the concentric portion of the exercise.

In U.S. Pat. No. 4,953,855 to William D. Shields (1990) a split phase cam machine uses a cam split into two distinct phases and an independent weight stack for each phase of the cam. The weight stacks are labeled "starting" and "finishing" to allow for the performance of the "peak contraction" technique where a user selects less weight for the "starting" weight stack and more weight as needed to the "finishing" weight stack to forcefully squeeze the muscles when fully contracted and to hold this position for a few seconds.

In U.S. Pat. No. 9,656,116 to Giannelli et al. (2017) a first and second force resistance device is provided. The first being a weight stack and the second being a rotating wheel as an actuating device that is acted upon by the first resistance and the user's speed, velocity, force, energy, or power thereby causing the second resistance device to exert a second resistance that is non-linear (geometrically or exponentially) in proportion to the degree of effort done by the user.

In U.S. Pat. No. 6,447,431 to Millburn et al. (2002) a device for retrofitting onto or incorporating into a conventional weightlifting machine is provided. A load tank replaces or supplements a number of weight plates in a conventional weight stack, while a charge tank rests on the floor proximal to the weightlifting machine. A fluid control means is provided for alternatively filling the load tank with water stored in the charge tank and draining the fluid back into the charge tank from the load tank, as desired in proportion to the muscle fatigue of the weightlifter. This invention is based on the premise that weightlifting machines are commonly used in resistance training, where the amount of weight is fixed at an amount less than the weightlifting capacity of the weightlifter. As the weightlifter progresses through his repetitions, the muscles eventually fatigue. The muscles generally reach their capacity only during the last few repetitions. Thus, several sets of repetitions can be necessary for appropriate muscle building, making the first few repetitions wasteful. Therefore, this invention attempts to reduce or eliminate the initial, inefficient repetitions by employing a system that begins at a weight at the weightlifter's capacity and reduces the amount of weight throughout the exercise.

In U.S. patent application publication 20060252611 to Quick et al. (2006) an exercise machine with bench press, weight stack, and elastic bands provide variable resistance during the concentric contraction. Pushing motion on the bench press bar transmits the force to a series of wheels connected by flexible bands and to a pair of weight stacks positioned behind the bench press. The weight members of the weight stack are connected by pins such that an upward movement of the uppermost weight members causes a pulling force to be applied to successive lower weight members one at a time, thereby allowing incremental increase in the resistance force to the lifting motion of the user. Depending on the strength of the user, elastic bands are used because weight plates often jump from 5 to 10 pounds without the possibility for an increment in weight in between.

In U.S. Pat. No. 10,369,398 to Lagree et al (2019) an improved exercise machine with a variable resistance system to provide increasing resistance over the concentric portion of an exercise is provided. The improved exercise machine improves upon Pilates apparatuses by making the selection of variable resistance level clear to the user for continuous uninterrupted exercise. In addition, the direction of variable resistance can be changed immediately to provide the exerciser with another exercise to perform for circuit training benefits. The variable resistance system can be applied to strength training machines such as a pull down and shoulder press combination to optimize the circuit training benefits because of time saved from having to move from one apparatus to another and selecting the desired resistance level which often requires set up time.

In U.S. Pat. No. 4,627,615 to Nurkowski (1986) a progressive resistance mechanism suitable for use with a weightlifting machine provides increasingly variable resistance over the concentric portion of the exercise. The progressive resistance mechanism uses two or more weight stacks that are selectively and independently engaged through a selector post through each weight stack. Each selector post has a first pin for selecting a subset of weights and at least one selector post has a second pin for locking a slidable collar at selected distances along the post above the carriage. The upward-travelling carriage engages the various pre-set collars in sequence to lift the associated selector posts. The weight stacks depending from the selector posts are thus serially engaged during the course of a single user repetition.

In U.S. Pat. No. 4,620,704 to Shifferaw (1986) an exercise machine for muscle building uses resilient rods which are flexed and resist movement of a person using the machine to provide increasingly variable resistance over the concentric portion of the exercise.

In U.S. Pat. No. 4,492,375 to Richard E. Connelly (1985) an exercise apparatus provides variably increasing resistance to the concentric range of the exercise by using elastic bands or torsional springs.

In U.S. Pat. No. 4,540,171 to Clark et al (1985) an apparatus for muscular exercise is provided where the user conducts a repetitive motion under load with the eccentric range of the exercise being loaded with more load than the concentric range of the exercise.

For Raasoch's disclosure, it requires more weight stack space, more weight stack plates, and cannot be incorporated towards existing weight stack systems found on weightlifting machines without a significant change to the mechanical parts and/or its assembly. For Potash's et al. disclosure, it does not provide increasingly variable resistance over the concentric portion of the exercise. For Toups's disclosure, it requires weight stack plates as the primary source of resistance. For Shields's disclosure, it requires at least two independent weight stack plates to create an increasingly variable resistance over the concentric range of motion. For Giannelli's et al. disclosure, it requires weight stack plates and a rotating wheel device as an actuating device to create the variable resistance in proportion to the degree of effort done by the user. For Millburn's et al. disclosure, it does not provide increasingly variable resistance over the concentric portion of the exercise. For Quick's et al. disclosure, it applies to a bench press machine with a free moving barbell, and it does not apply to strength training machines with moving handles that move in a fixed path with a weight stack and cable pulley system. For Lagree's disclosure, it does not provide supplementary resistance in 5 Pound increments or any amount of resistance between 0 and 10 (i.e., 0.5 lb., 2 lbs., 1 lb., etc.). So, incremental progression of 5 pounds is not possible and it will cause a significant limitation for a weightlifter's progress with the resistance level used. It cannot be incorporated towards existing weight stack systems found on weightlifting machines without a significant change to the mechanical parts and/or its assembly. For Nurkowski's disclosure, it requires at least two or more independent weight stacks to provide increasingly variable resistance over the concentric range of the motion. For Shifferaw's disclosure, it cannot be incorporated into the existing weight stack housing frames of weightlifting machines. For Connelly's disclosure, it cannot be incorporated into weightlifting machines utilizing a weight stack with cable pulley system along with the other mechanical parts known in the art. For Clark's disclosure, it does not provide variably increasing resistance over the concentric range of the exercise.

These disclosures heretofore known suffer from a few disadvantages:

1) One cannot selectively select a primary source of variable resistance that is as inexpensive as elastic bands to provide more resistance towards the end of the motion where there is a mechanical advantage for the limbs involved to develop the muscles, tendons, ligaments, and bones at a faster rate than if most of the resistance was applied during the first half of the exercise motion.
2) One cannot selectively add incremental resistance to a primary source of variably increasing resistance such as elastic bands to provide incremental progression of the resistance used to promote adding small amounts of resistance consistently over time as the way to progress a weightlifter's strength as the primary factor with the addition of repetitions and sets as the secondary factor when needed.
3) One cannot utilize the ergonomic/biomechanical design features of weightlifting machines with weight stack and cable pulley systems while using a primary source of variably increasing resistance that is as cheap as elastic bands and perform assisted negative repetitions with variably decreasing resistance over the eccentric range of the motion.
4) One cannot utilize the ergonomic/biomechanical design features of weightlifting machines with weight stack and cable pulley systems while using a primary source of variably increasing resistance such as elastic bands and have an exercise range of motion feature for performing yielding isometrics and overcoming isometrics for added exercise intensity and variation of training routine.

Accordingly, what is needed is an improved exercise machine. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for an improved exercise machine is now met by a new, useful, and nonobvious invention.

In accordance with one embodiment a resistance band exercise machine comprises a cable-pulley variable resistance system housing, a cable-pulley variable resistance system, a pair of uprights with a safety bar inserted into a safety bar hole, and a training partner assistantship cable-pulley system or a training partner assistantship feature of having an input lifting arm with a handle grip and/or a shoulder padding for a user to perform various exercises against a primary (resistance band) and secondary (springs) sources of variably increasing resistance, resistance band with isometrics using safety bars, and perform more full/partial range of motion negative repetitions through variably decreasing resistance with the help of a training partner.

Some embodiments further include a negative repetition assistance feature. The negative repetition assistance feature is configured to allow another user to impart an additional force onto a platform that transfers the additional force to the user to increase the total force imparted onto the user prior to the user executing an eccentric portion of a repetition.

Advantages

Accordingly, several advantages of one or more aspects are as follows: to provide a resistance band exercise machine with a cable-pulley variable resistance system that enables a user wearing a harness or belt to perform push-up exercises in the prone position with their hands on the platform with primary variably increasing resistance and to quickly change the resistance independently, that enables a user to perform push-up exercises with primary variably increasing resistance using partial range of motion, that enables a user to perform push-up exercises with primary variably increasing resistance through a range of motion and perform isometrics against a safety bar, that enables a user to perform push-up exercises with primary variably increasing resistance through full/partial range of motion negative repetitions using a training partner, that enables a user to perform push-up exercises with primary source of variably increasing resistance from start to end position of an exercise and secondary source of variably increasing resistance towards end position of an exercise, that enables a user to perform full/partial range of motion negative repetitions using a training partner against submaximal negative loading with weight and supramaximal negative loading with manual resistance. These advantages will be apparent from consideration of the drawings and ensuing descriptions.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

Figure 1A:
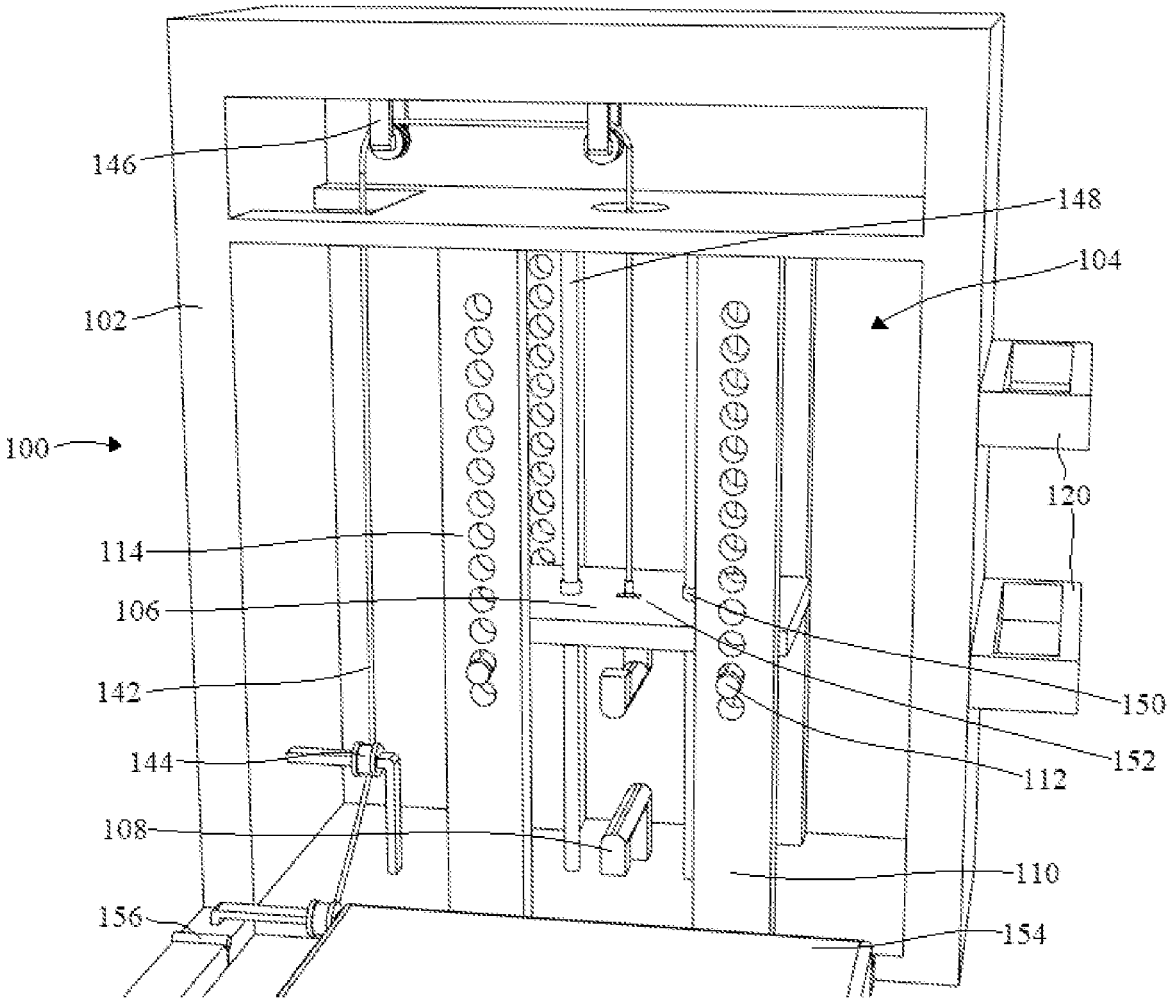
FIGS. 1A to 1E show a perspective view of resistance band exercise machine and in start position of an exercise's range of motion in accordance with one embodiment.
Figure 1B:
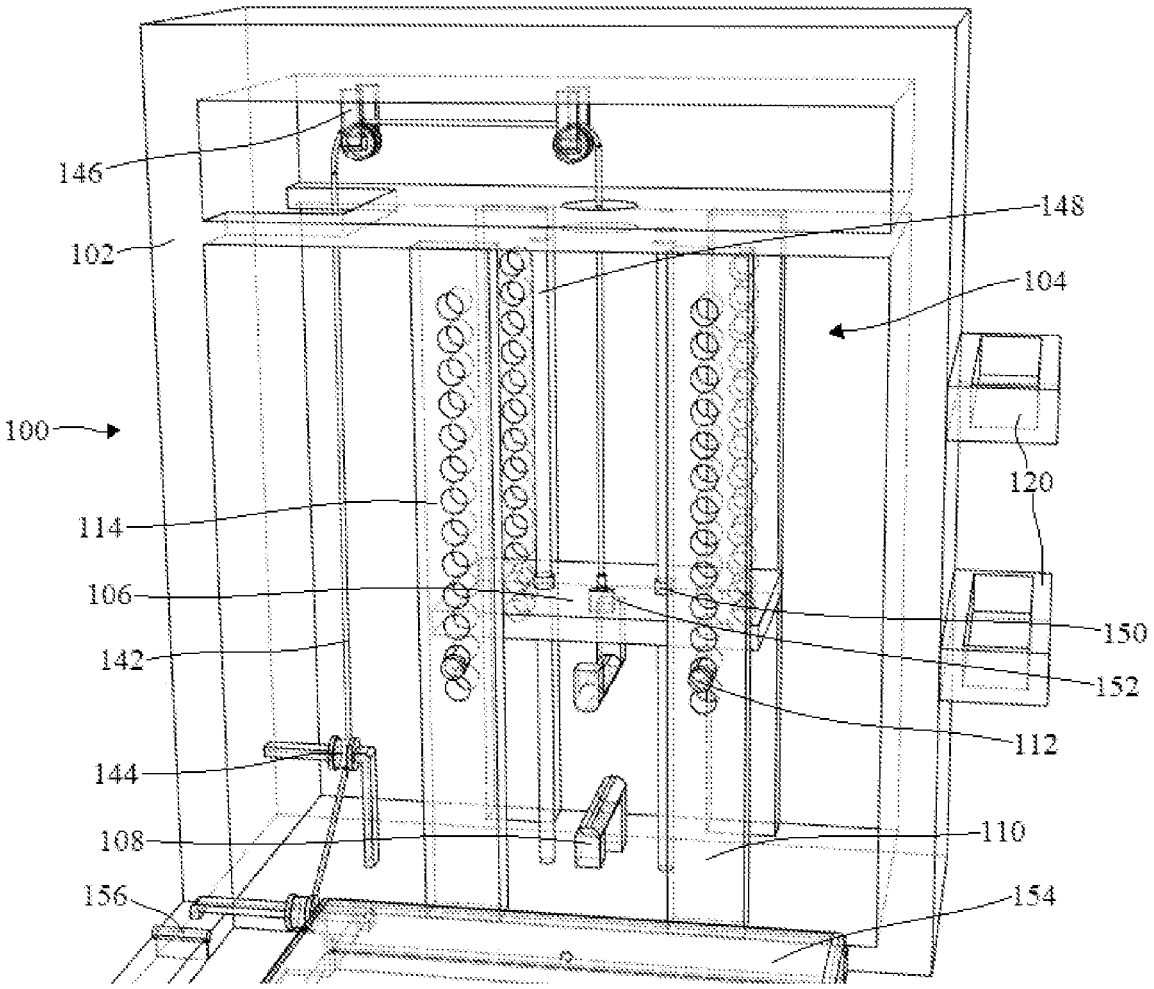

In the following detailed description of the preferred embodiments, reference is made to the accompanying drawings, which form a part thereof, and within which are shown by way of illustration specific embodiments by which the invention may be practiced. It is to be understood that other embodiments may be utilized, and structural changes may be made without departing from the scope of the invention.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

The phrases "in some embodiments," "according to some embodiments," "in the embodiments shown," "in other embodiments," and the like generally mean the particular feature, structure, or characteristic following the phrase is included in at least one implementation. In addition, such phrases do not necessarily refer to the same embodiments or different embodiments.

Referring now to FIGS. 1A-1E, an exemplary embodiment of a resistance band exercise machine 100 is disclosed. The resistance band exercise machine has a cable-pulley variable resistance system housing 102 and a cable-pulley variable resistance system 104. The cable-pulley variable resistance system has a top plate 106 (generally referred to as a "first resistance attachment member") with a resistance band hook 108 welded, bolted, or connected in any manner to the underside of the top plate. Another resistance band hook 108 (generally referred to as a "second resistance attachment member") is secured to the cable-pulley variable resistance system housing beneath the top plate's resistance band hook on the lower frame member. There can be multiple resistance band hooks.

The cable-pulley variable resistance system can include one or more guide rails. The exemplary figures depict the one or more guide rails as a pair of uprights 110 welded, bolted, or connected in any manner to the cable-pulley variable resistance system housing and positioned such that the top plate rests on a pair of safety bars 112 when inserted into a safety bar hole 114.

Figure 1C:
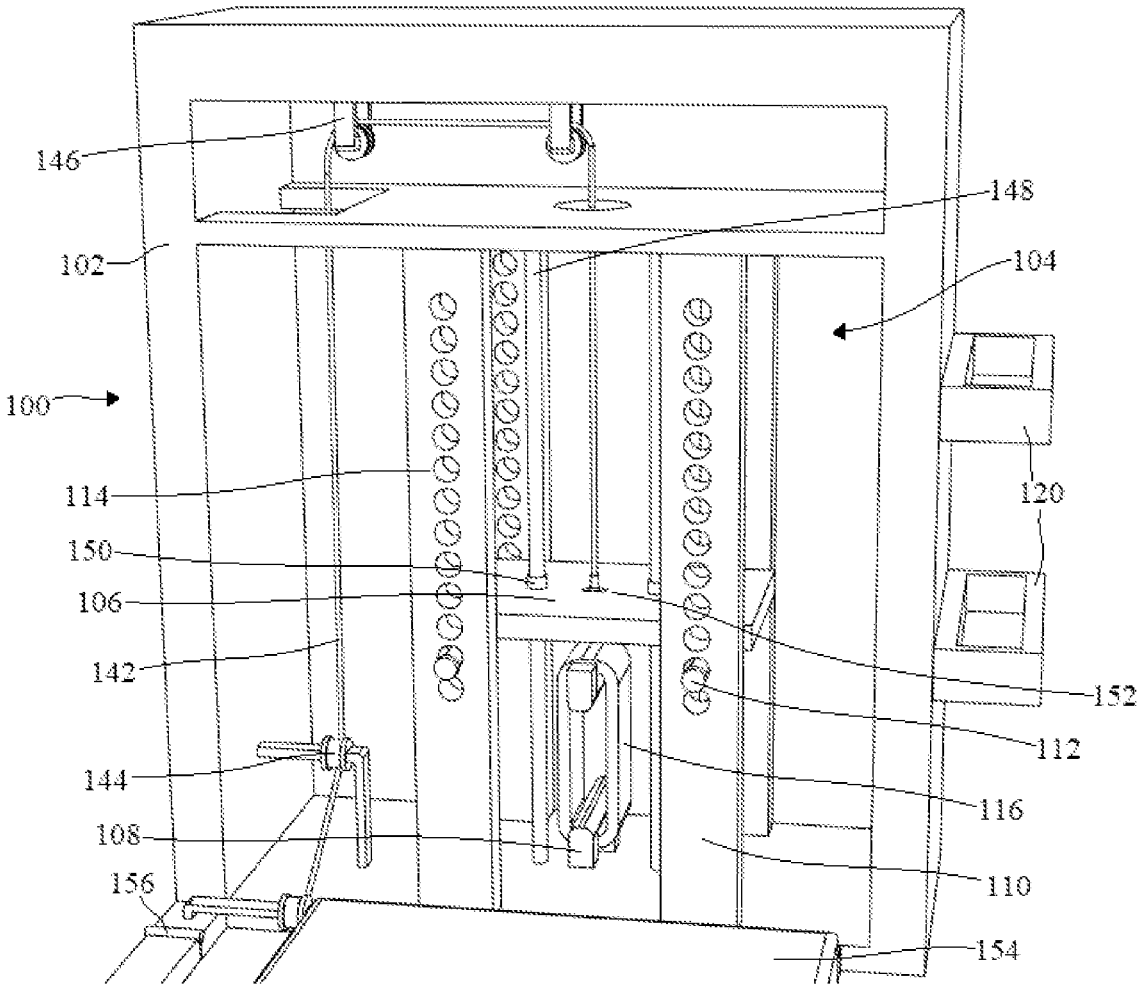
Figure 1D:
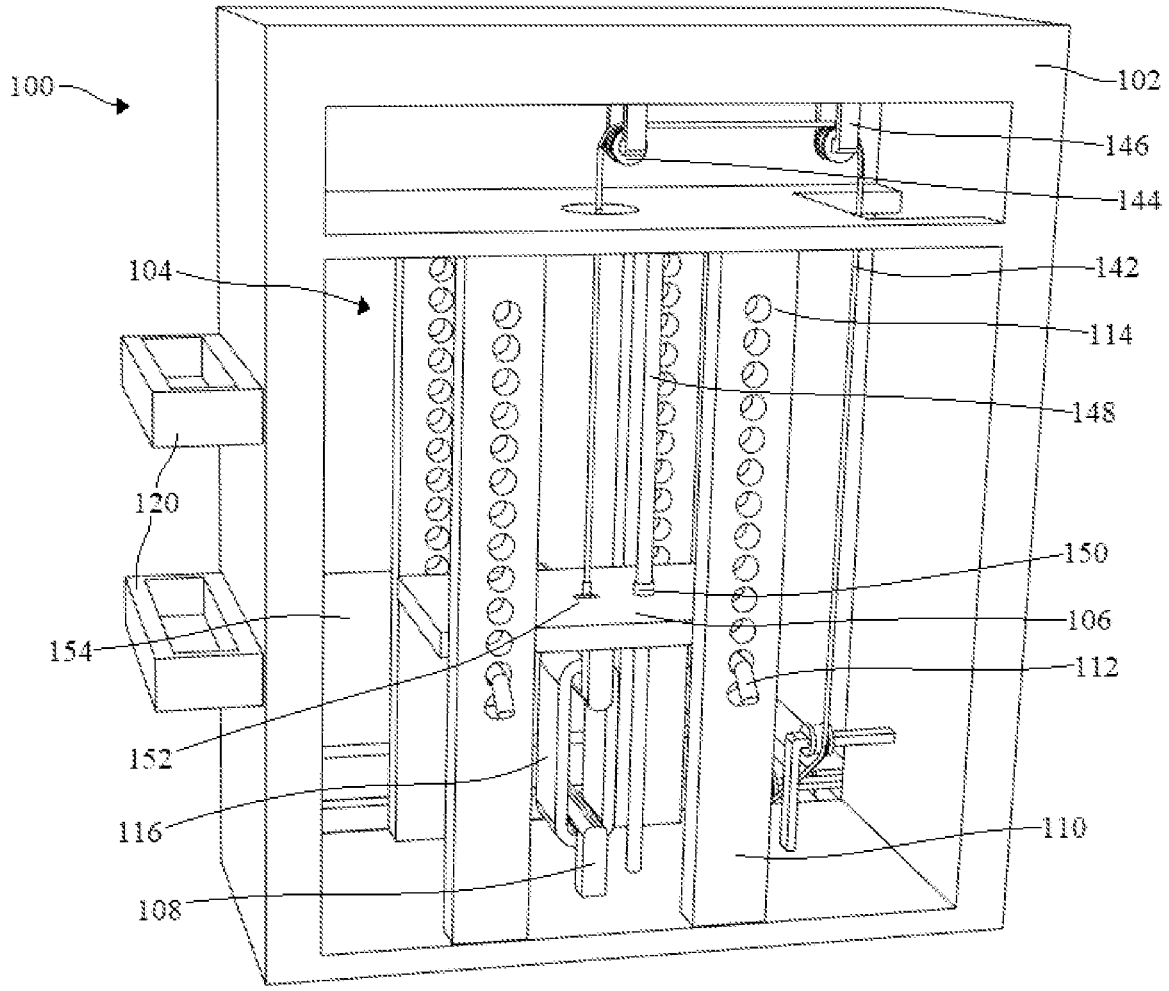
Figure 1E:
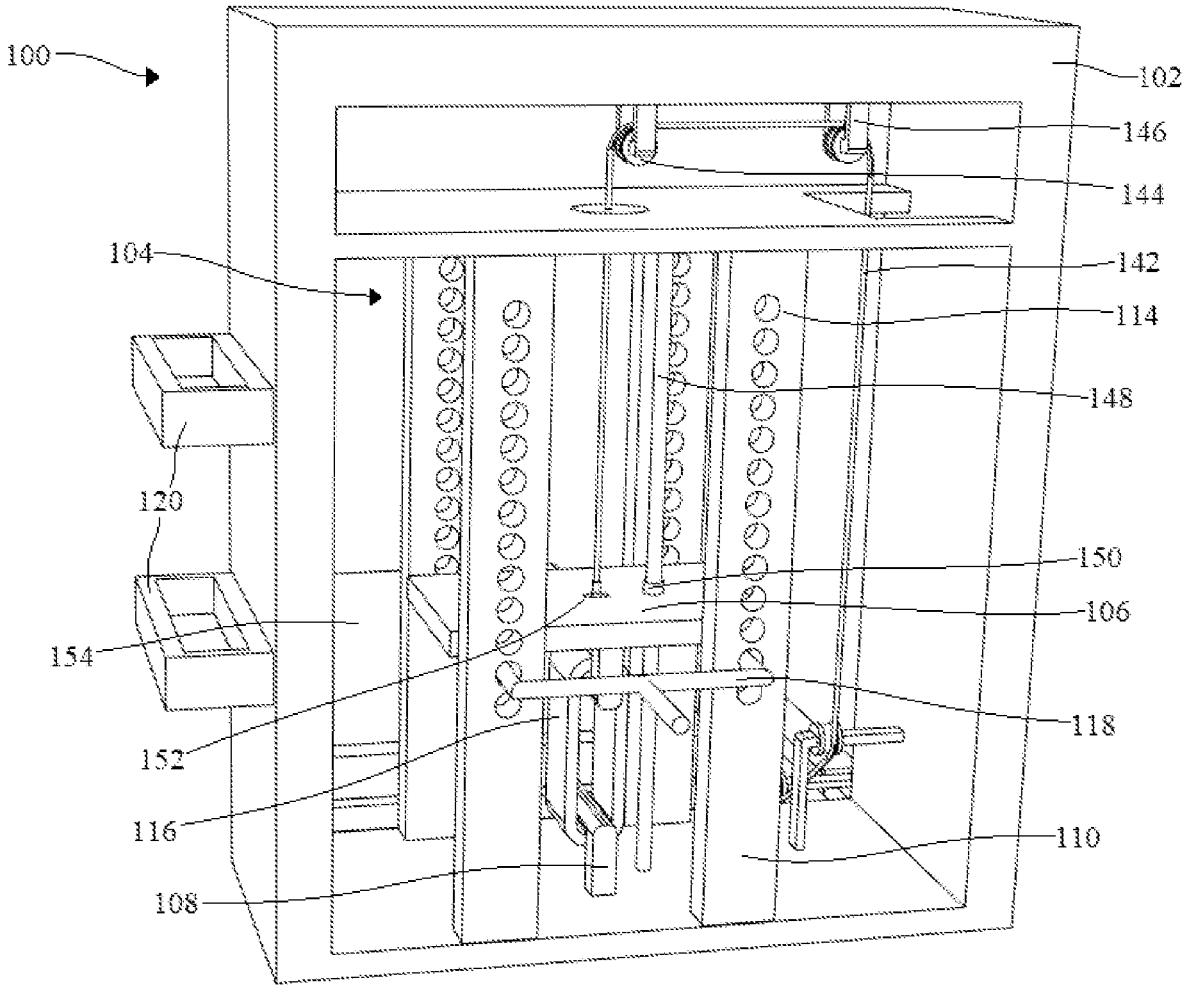
Figure 1F:
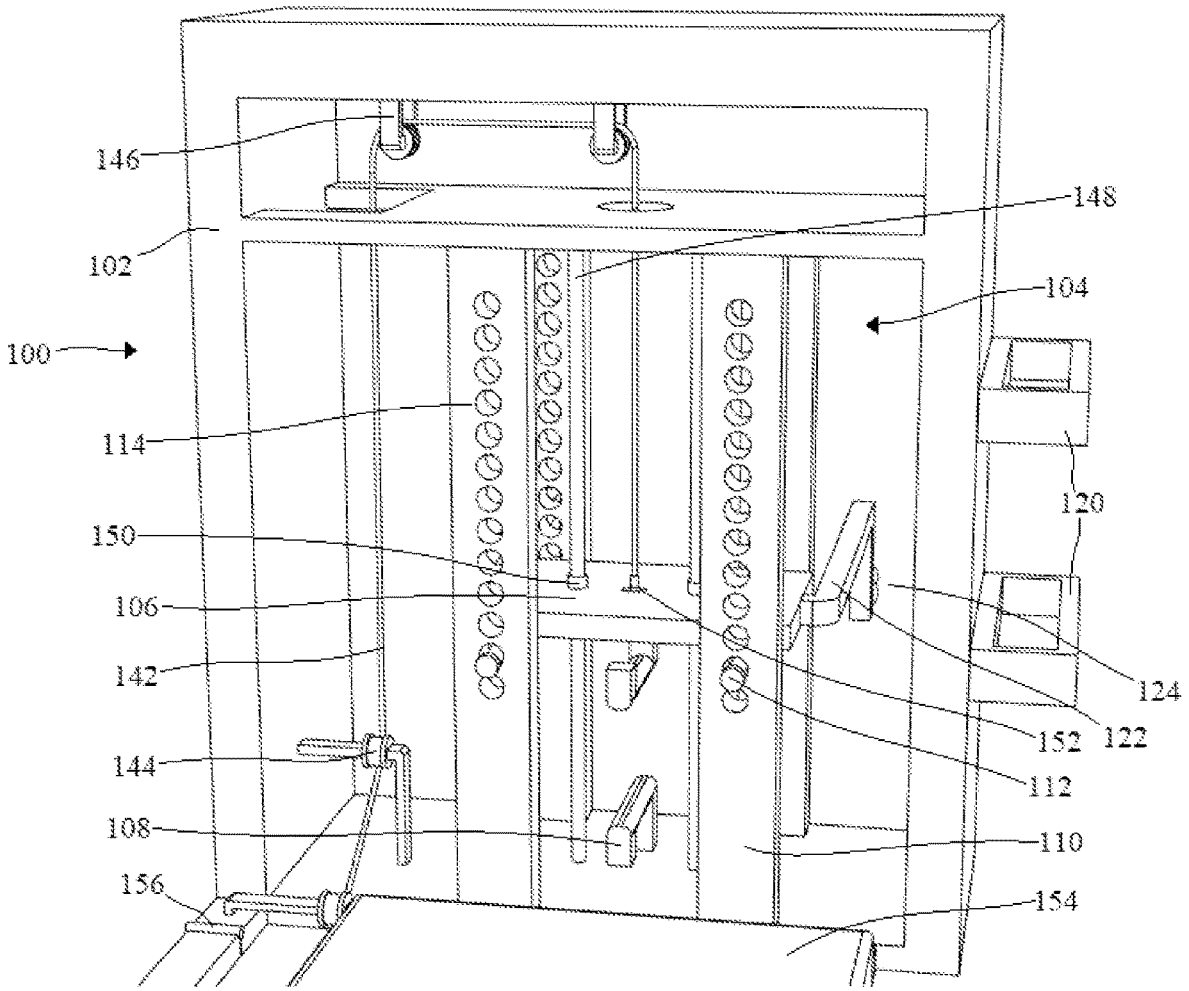
FIGS. 1F to 1L show a perspective view of resistance band exercise machine and in start position of an exercise's range of motion in accordance with another embodiment.
Figure 1G:
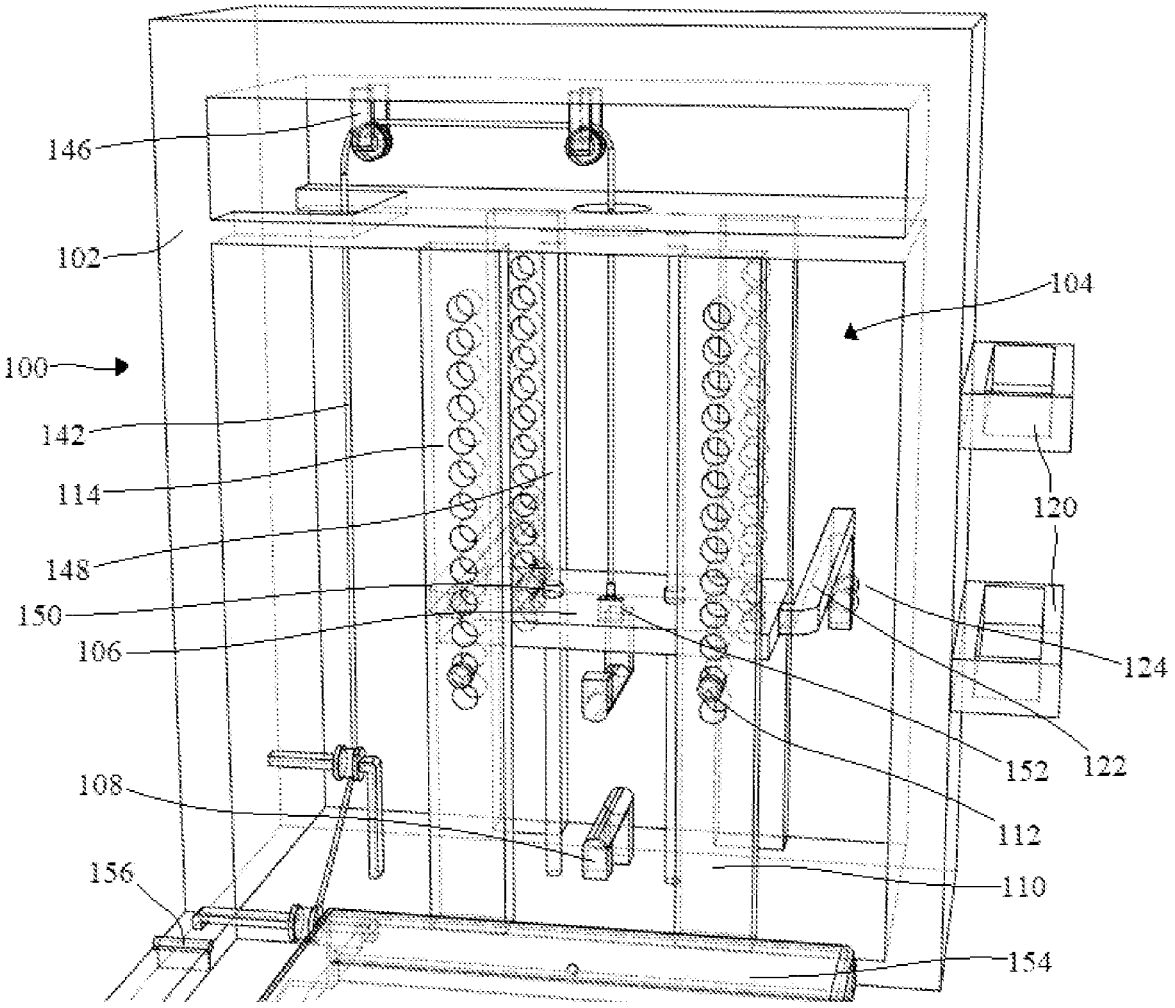
Figure 1H:
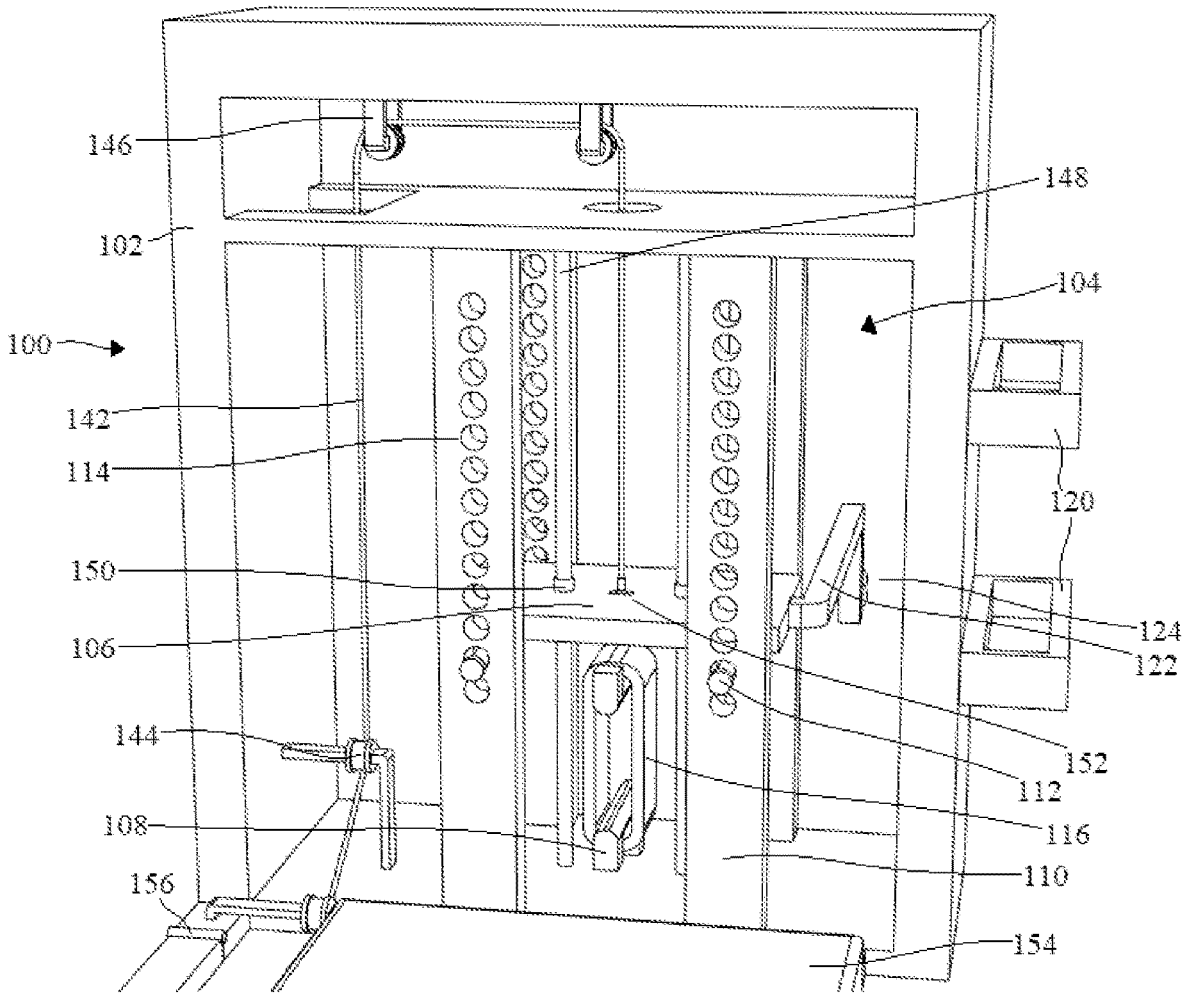

Belts, cables, cams, pulleys, or any combination thereof may be used in the cable-pulley variable resistance system. The configuration of the cable-pulley variable resistance system may be in any arrangement based on the exercise. Since different exercises have different ranges of motion, the number of safety bar holes will vary. Also, the safety bars determine the starting position of an exercise. The cable-pulley variable resistance system has a primary source of variably increasing resistance (elastic resistance band 116) that is looped around the resistance band hooks as shown in FIG. 1C-1D. The cable-pulley variable resistance system may or may not have a pair of guide rods 148. This means that without the pair of guide rods the top plate will not have a shaft collar 150. A joined safety bar 118 may be used instead for convenience as shown in FIG. 1E. All types of resistance bands as well as springs may be used as a primary source of variably increasing resistance with the resistance band exercise machine.

On one side of the cable-pulley variable resistance system housing is a container 120 to hold items such as towels, cleaning agent spray bottle, water bottle, resistance bands, safety bars, etc. The material of the cable-pulley variable resistance system housing may be made of stainless steel, or any other material known in the art.

Figure 1I:
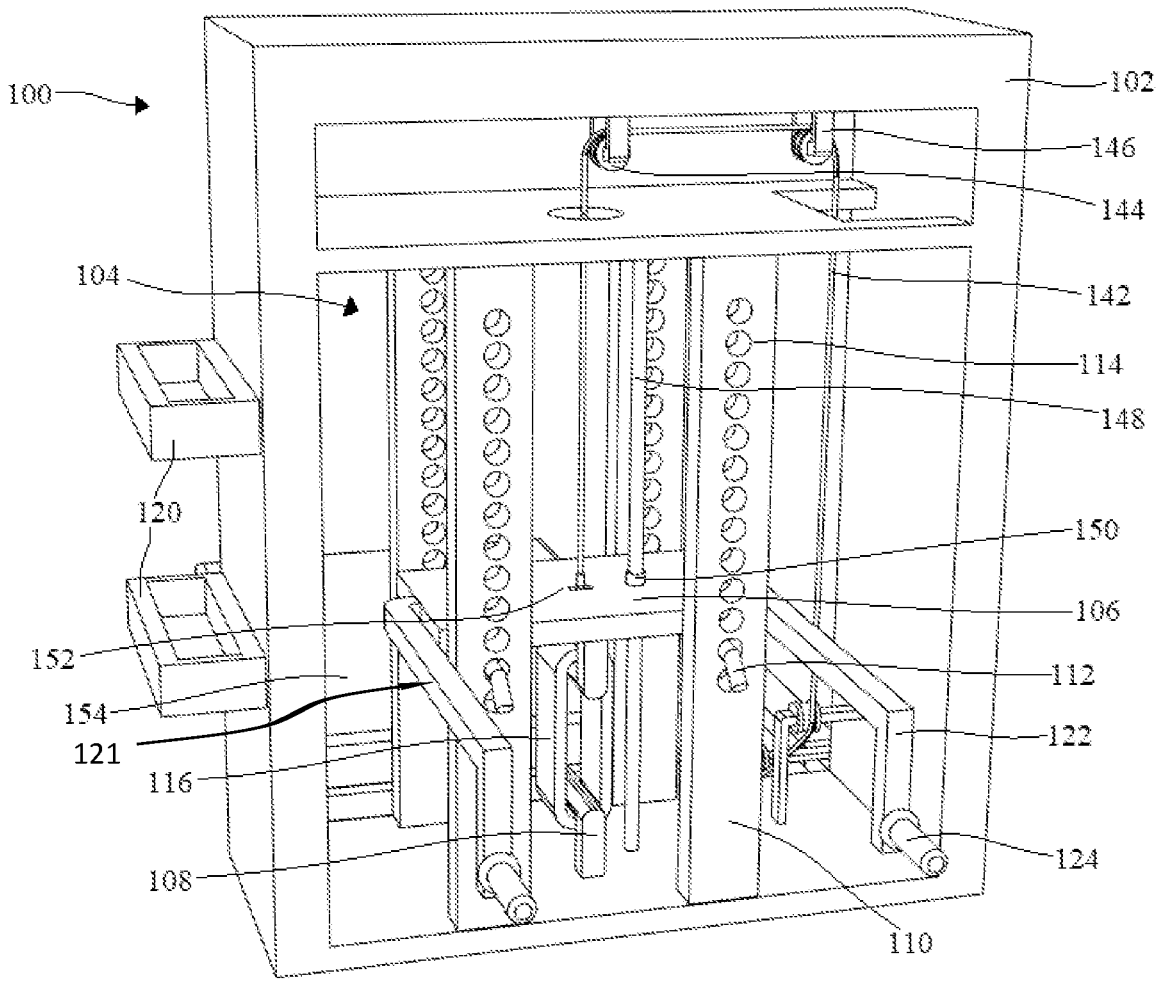
Figure 1J:
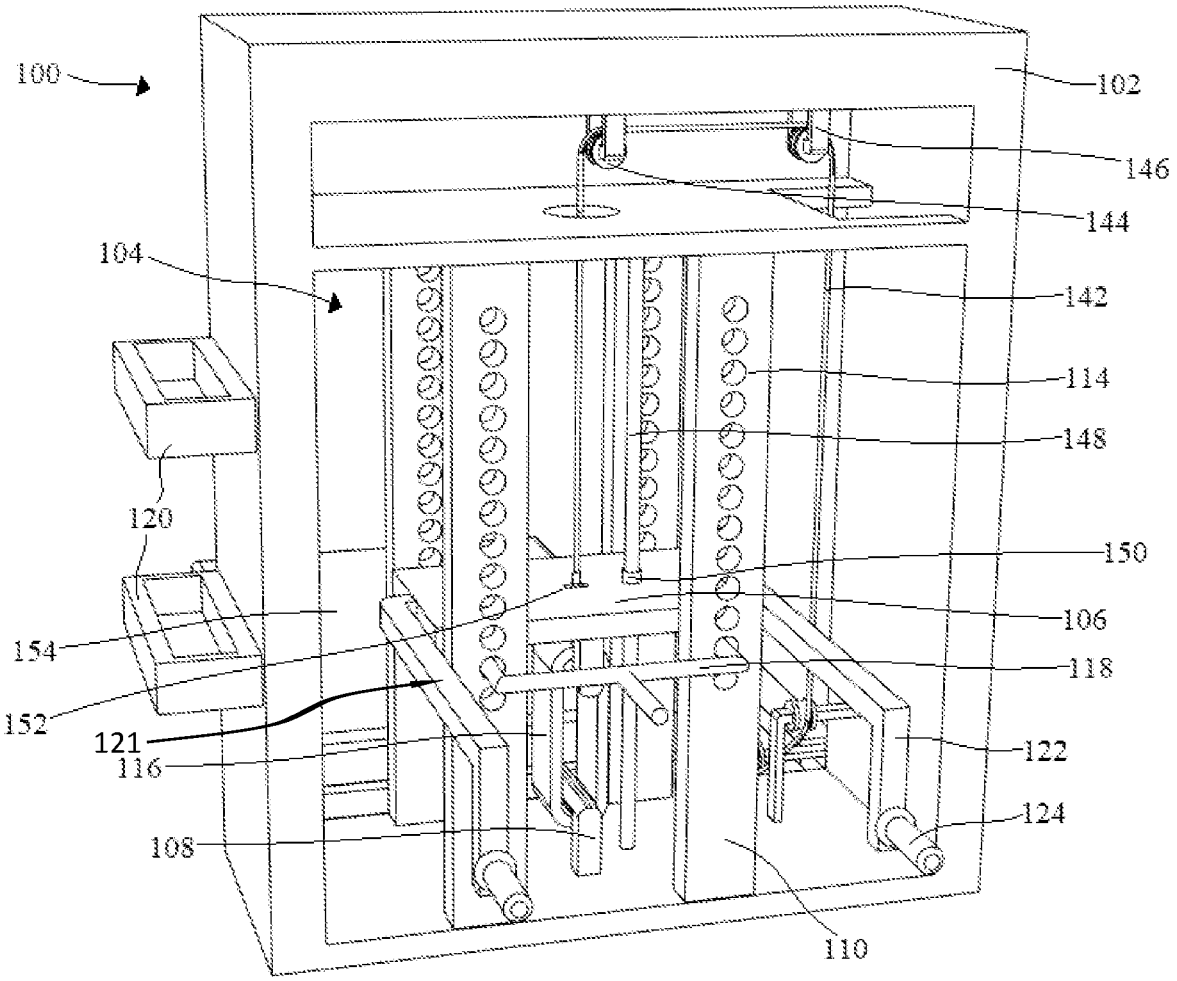

Referring now to FIGS. 1F-1L, another exemplary embodiment of a resistance band exercise machine 100 is disclosed. This exemplary embodiment is the same as the one above shown in FIGS. 1A-1E with the addition of a training partner assistantship feature ("TPAF") 121. As best depicted in FIG. 1I, TPAF 121 is in operable communication with the cable-pulley variable resistance system via input lifting arm 122. Lifting arm 122 can be welded, bolted, or connected in any manner, either directly or indirectly, to top plate 106.

TPAF 121 further includes one or more handle grips 124 extending externally from housing 102. Handle grips 124 provide a training partner with an accessible component to manipulate the TPAF 121 and in turn alter the force experienced by the user 162. When multiple handle grips 124 are included (e.g., two handle grips 124 as shown in FIG. 1I), they may be laterally spaced from each other to allow a user to stand between the two handle grips and grip each with a single hand. In addition, handle grips 124 may be located at a lower location relative to housing 102 (e.g., between 7 and 24 inches from the ground) to allow a training partner to employ a deadlift-like lift to assist the user.

Figure 1K:
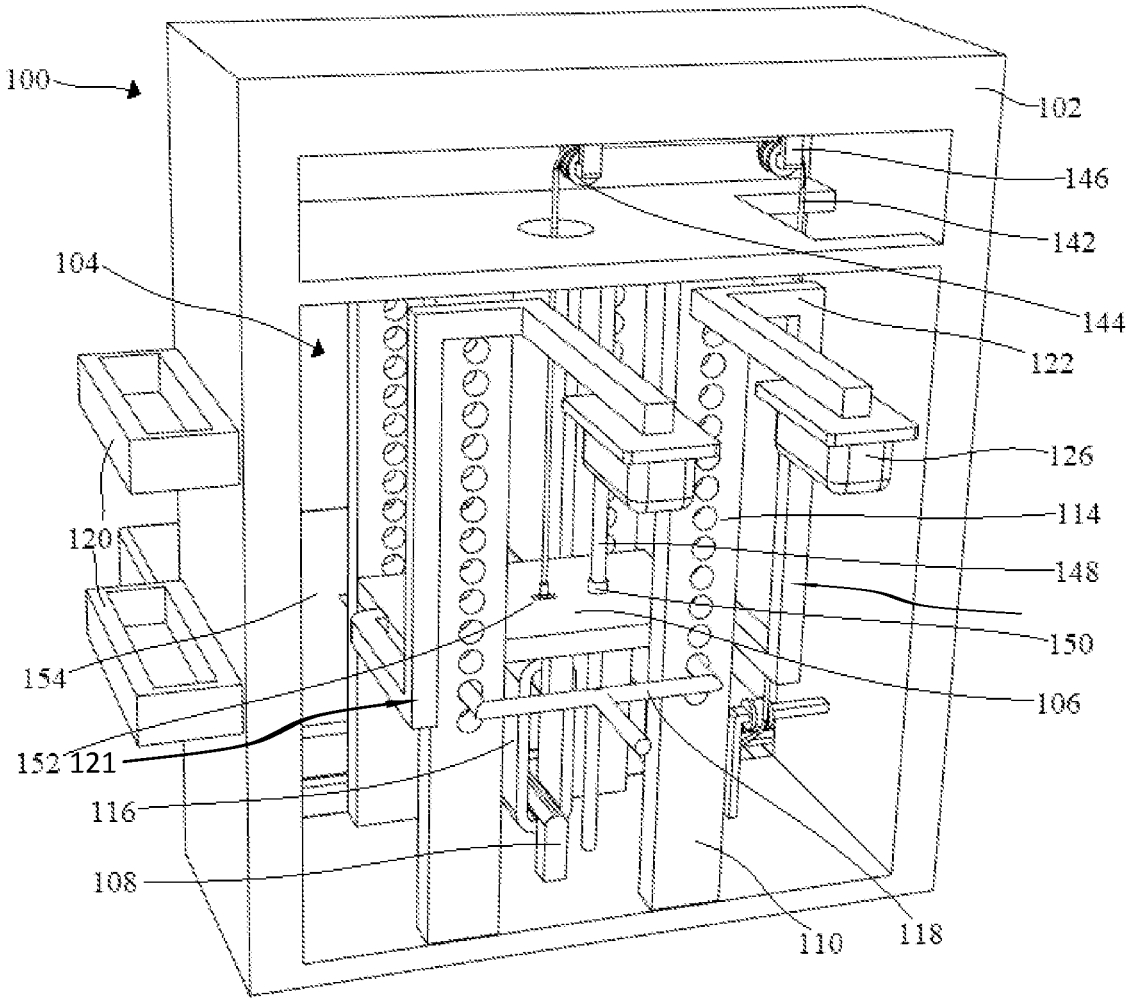
Figure 1L:
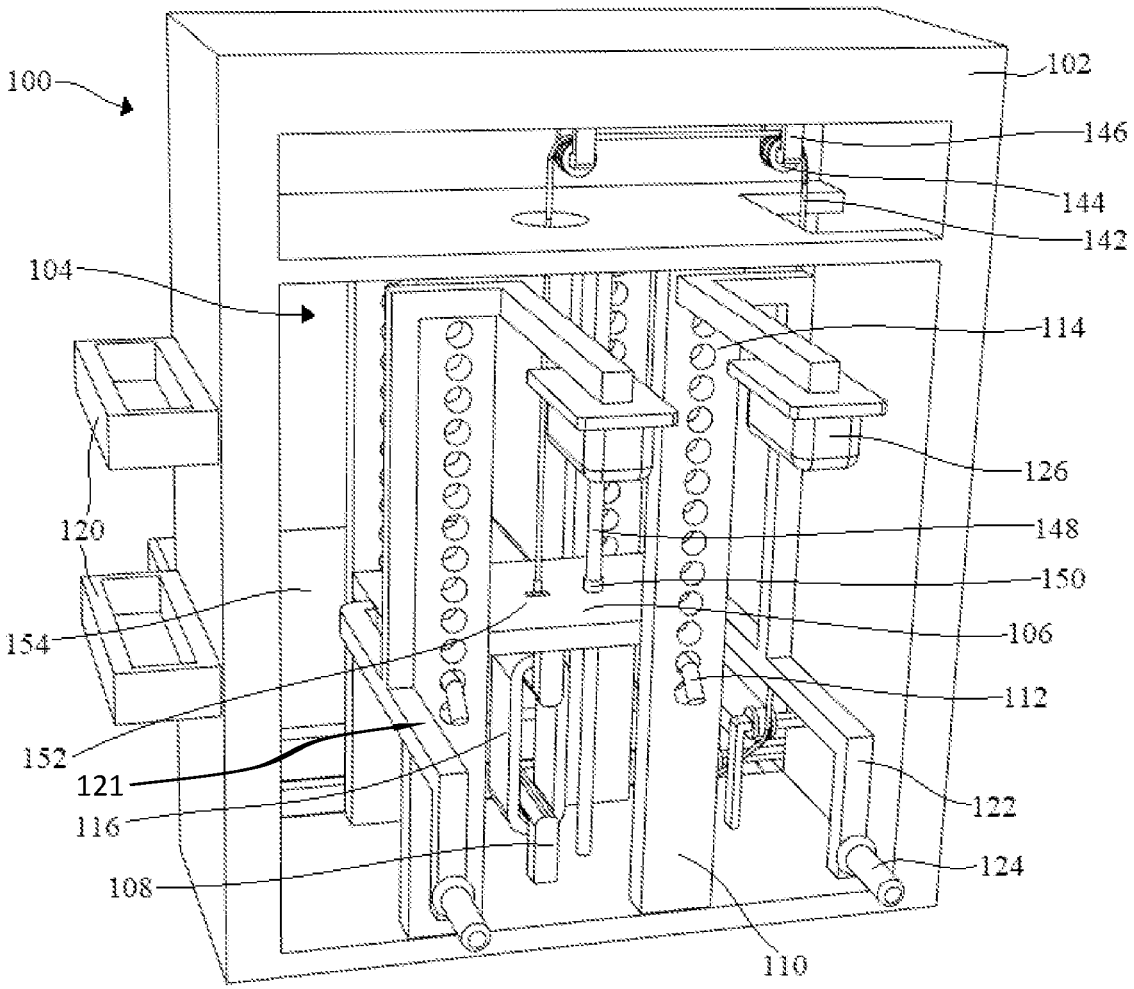
Figure 1M:
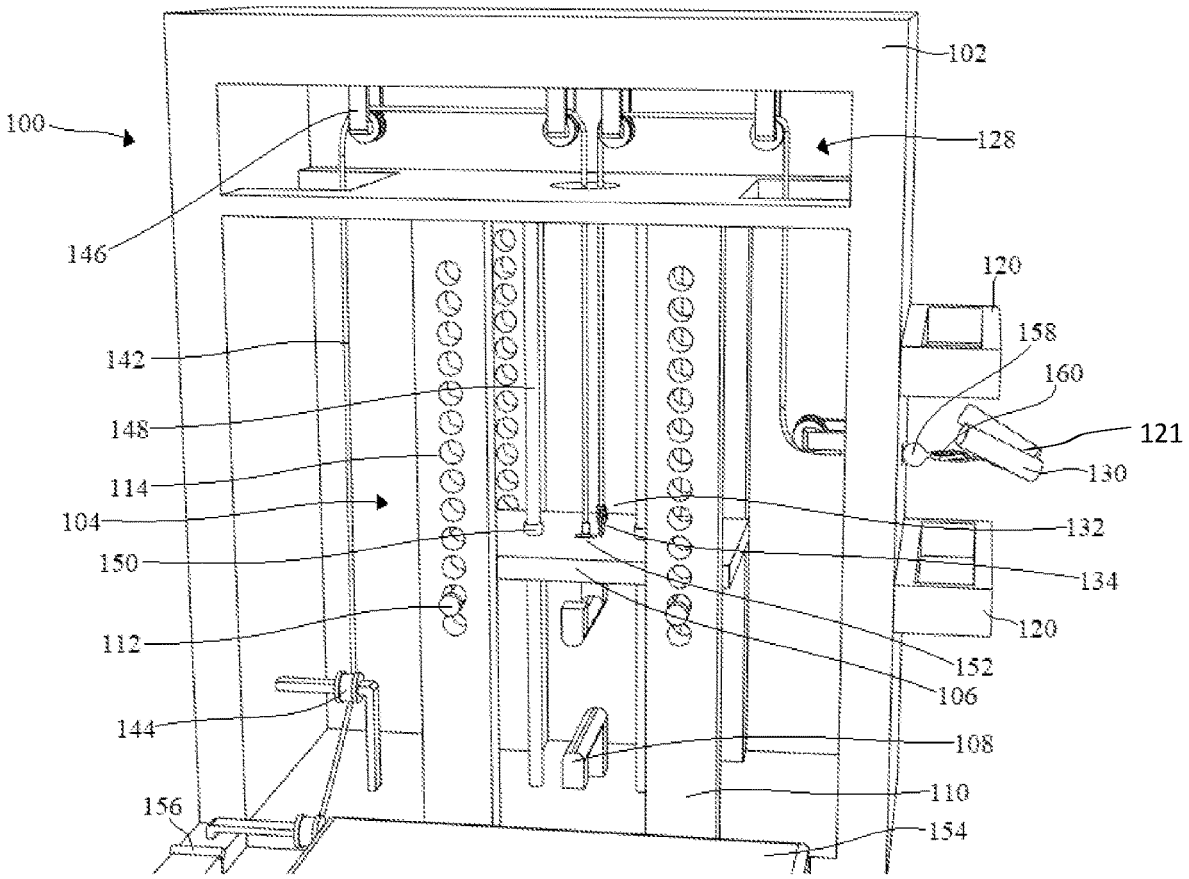
FIGS. 1M to 1P show a perspective view of resistance band exercise machine and in start position of an exercise's range of motion in accordance with another embodiment.
Figure 1N:
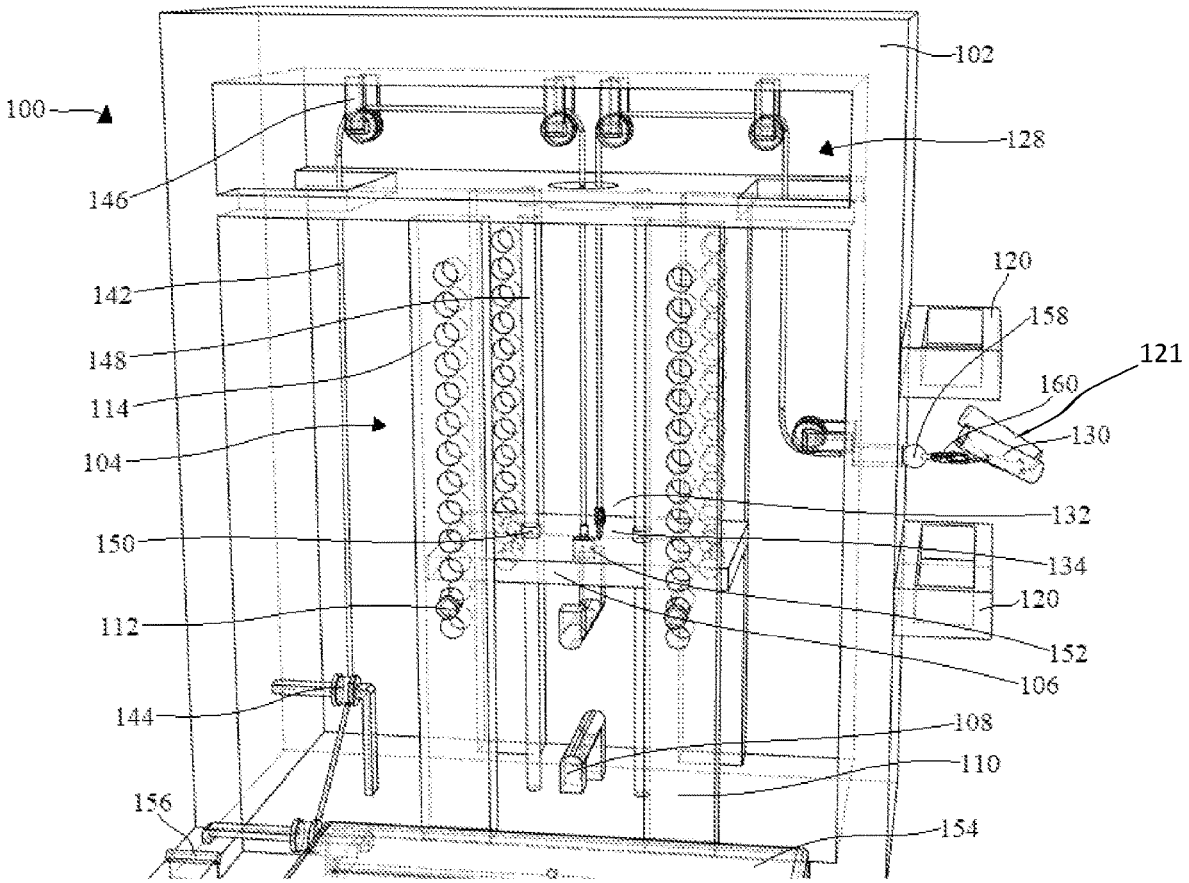
Figure 1O:
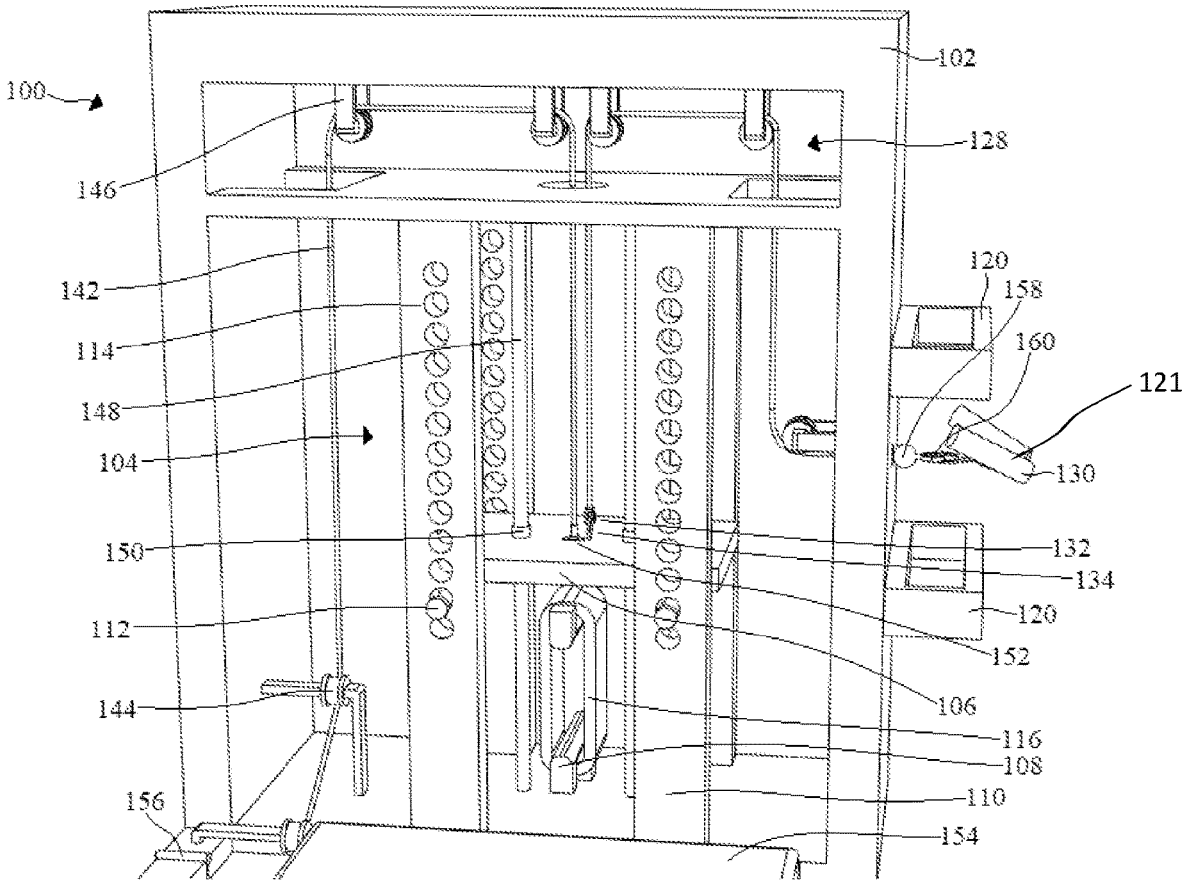
Figure 1P:
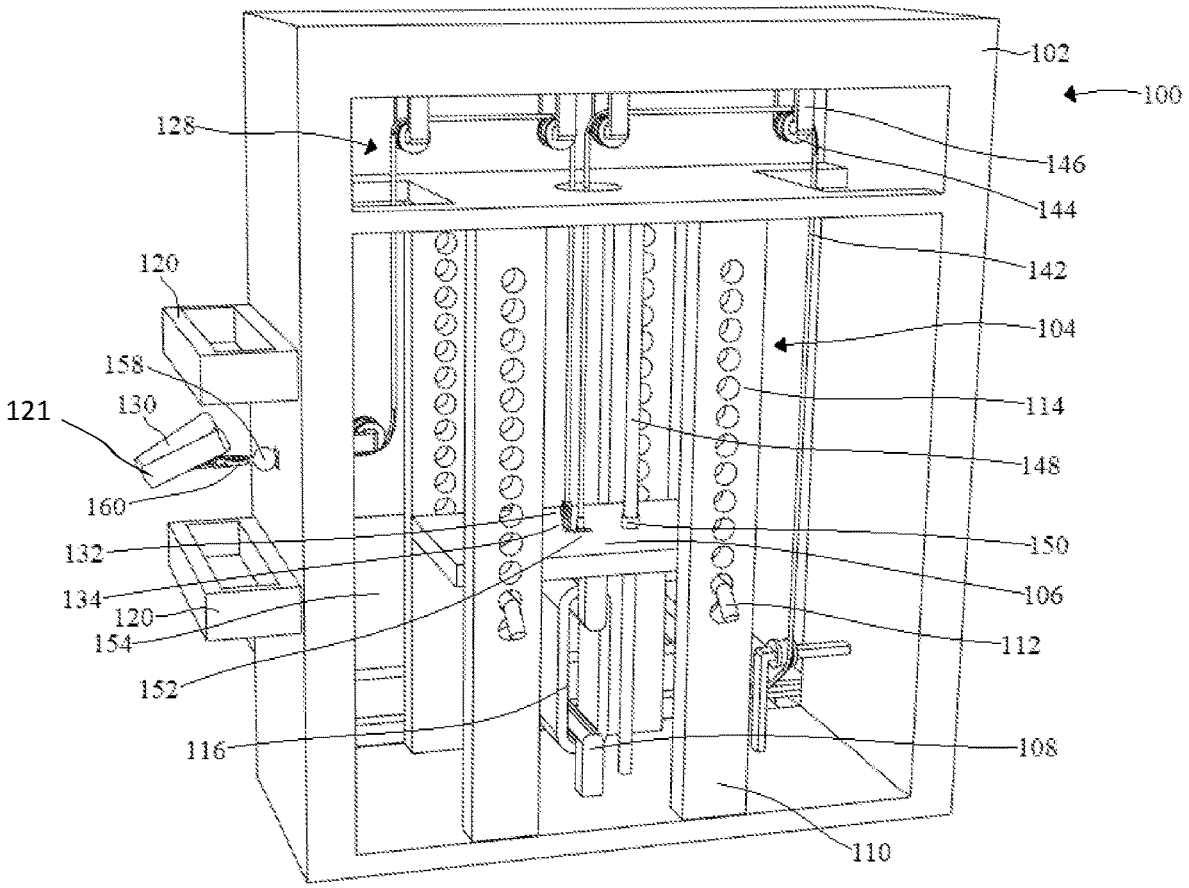
Figure 2A:
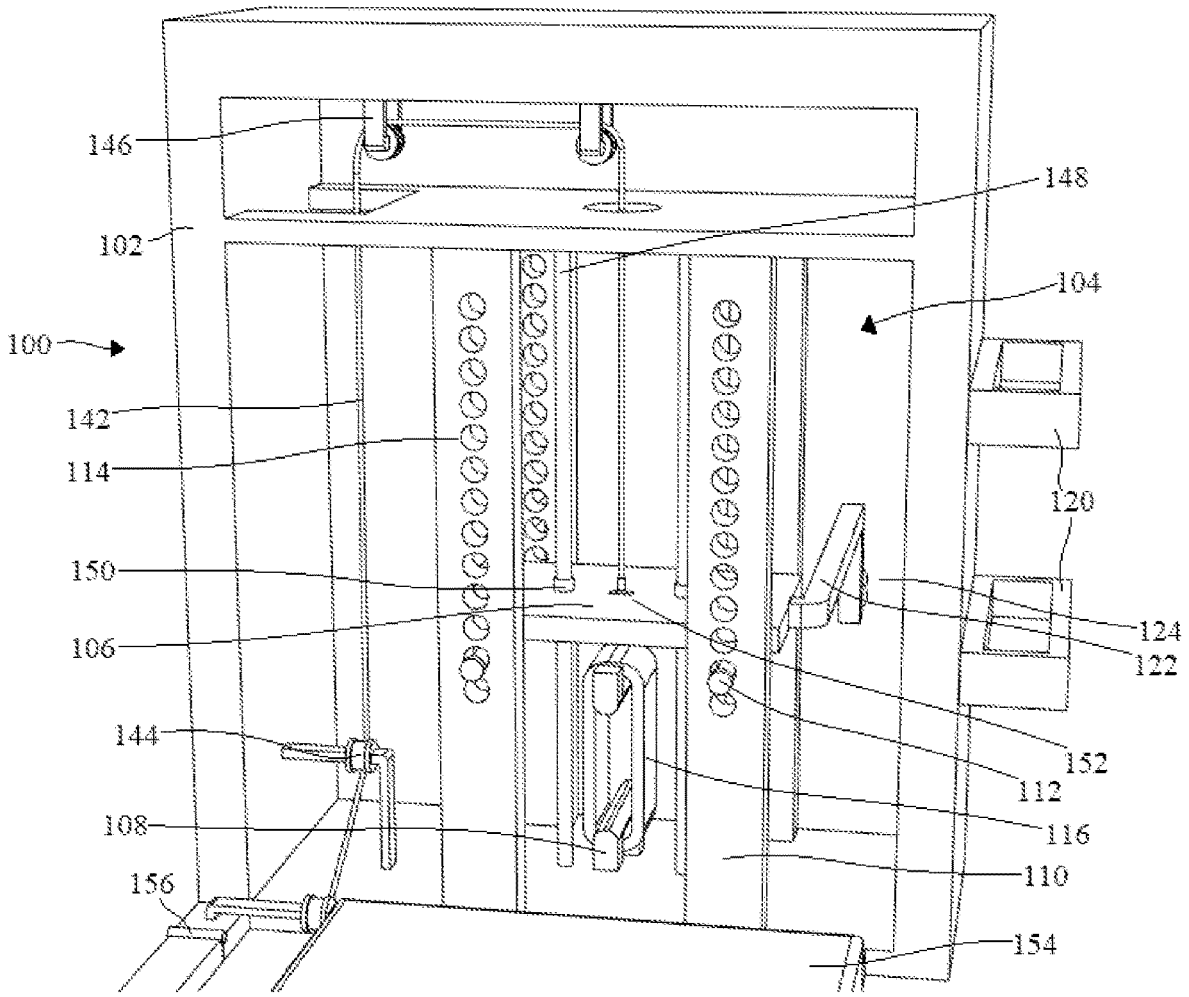
FIGS. 2A to 2D show resistance band exercise machine in start, mid, and end positions of an exercise's range of motion in accordance with another embodiment.
Figure 2B:
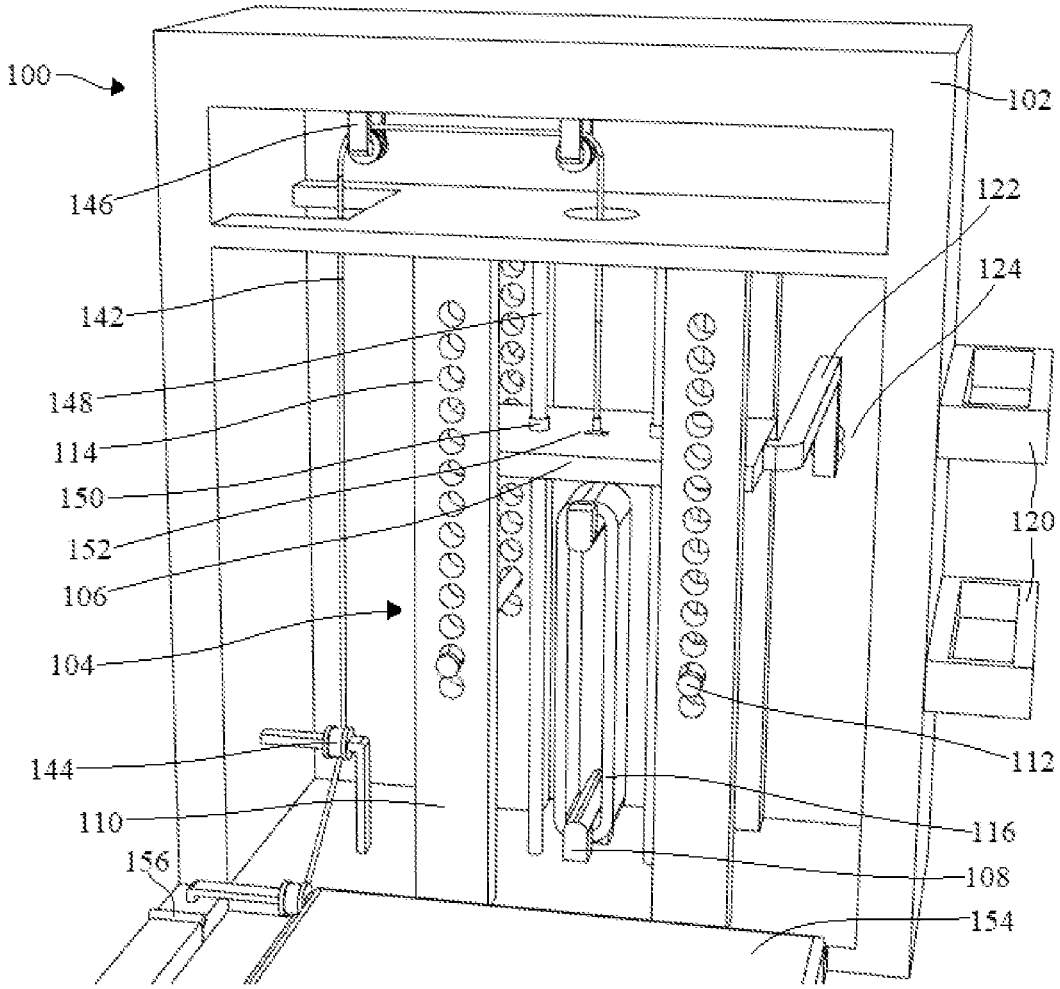
Figure 2C:
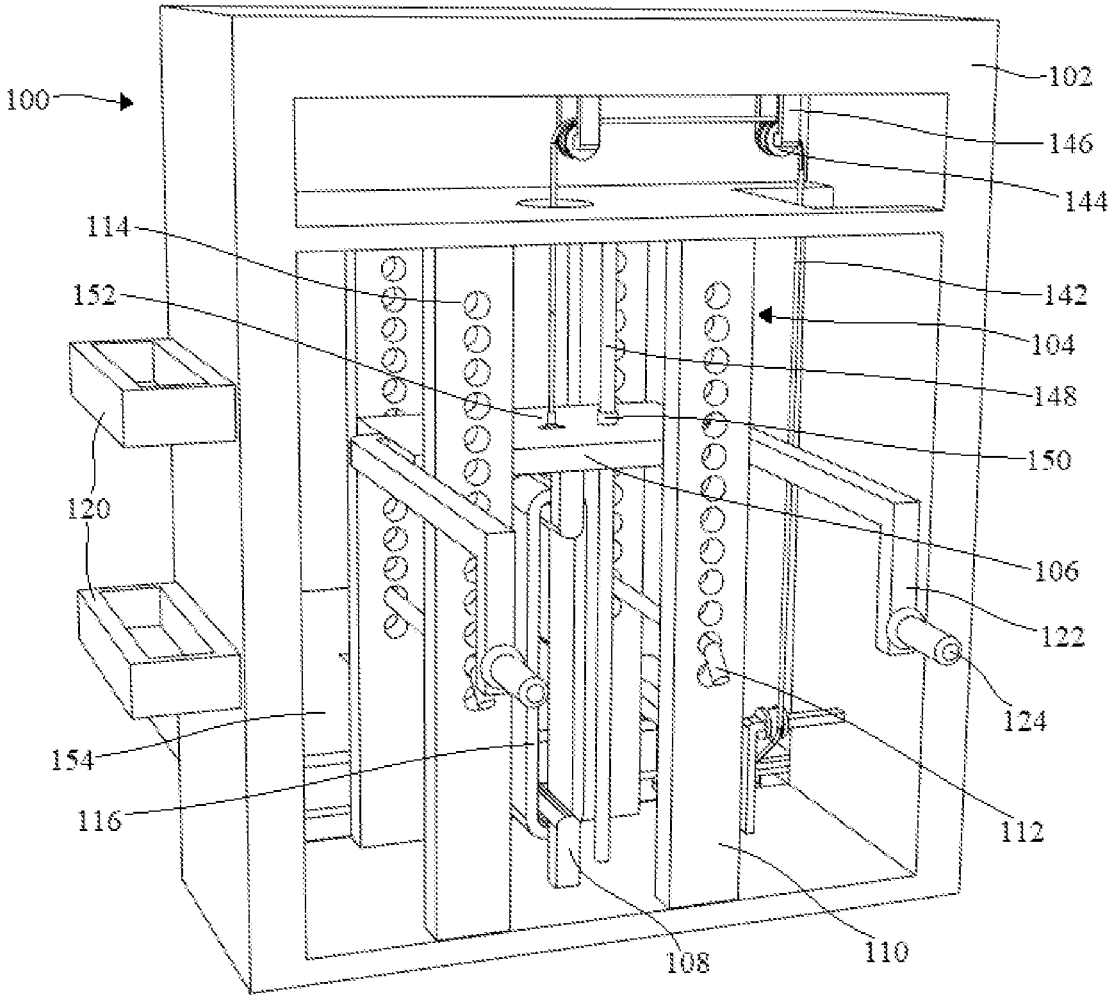
Figure 2D:
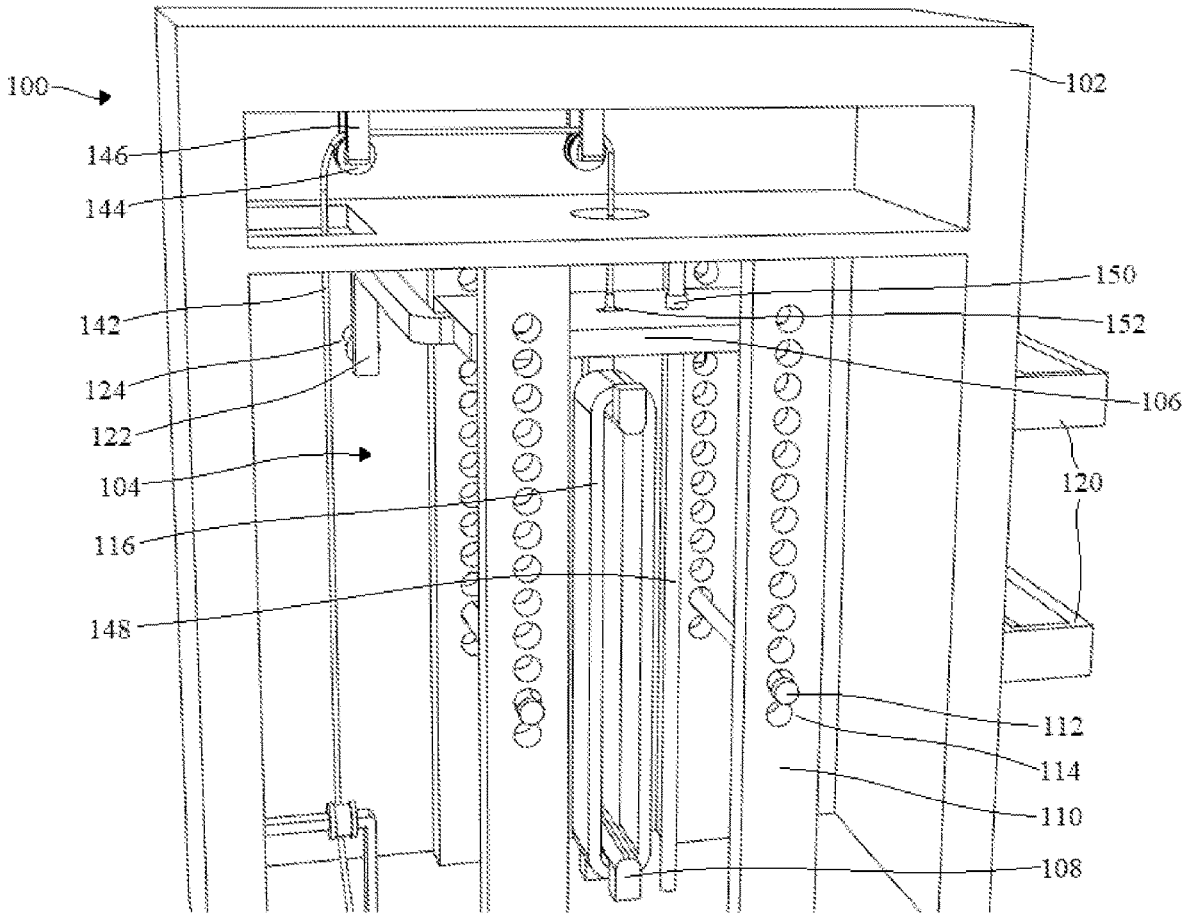
Figure 13A:
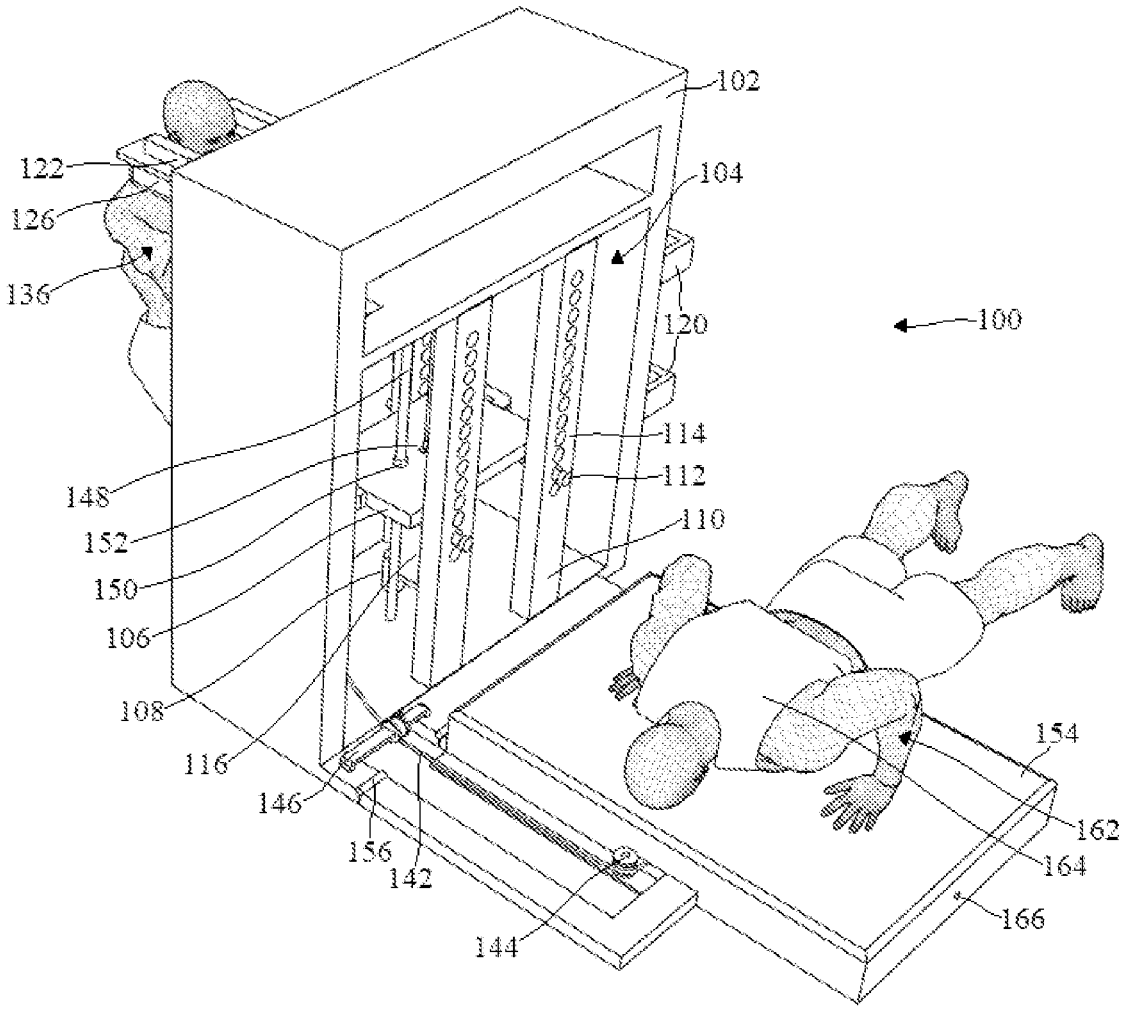
FIGS. 13A to 13F show another method of reducing an exercise's range of motion and method of performing isometrics with interaction between user and resistance band exercise machine in accordance with another embodiment.
Figure 13B:
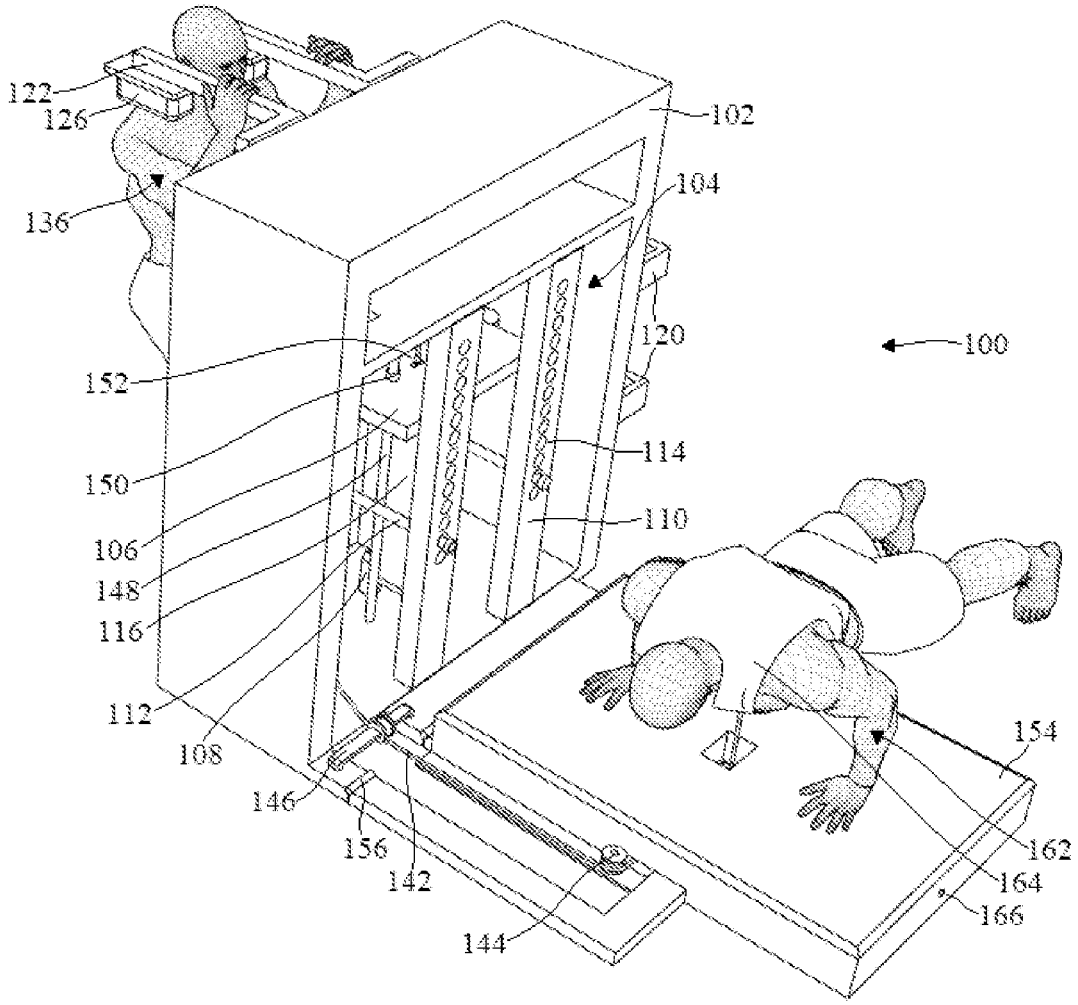
Figure 13C:
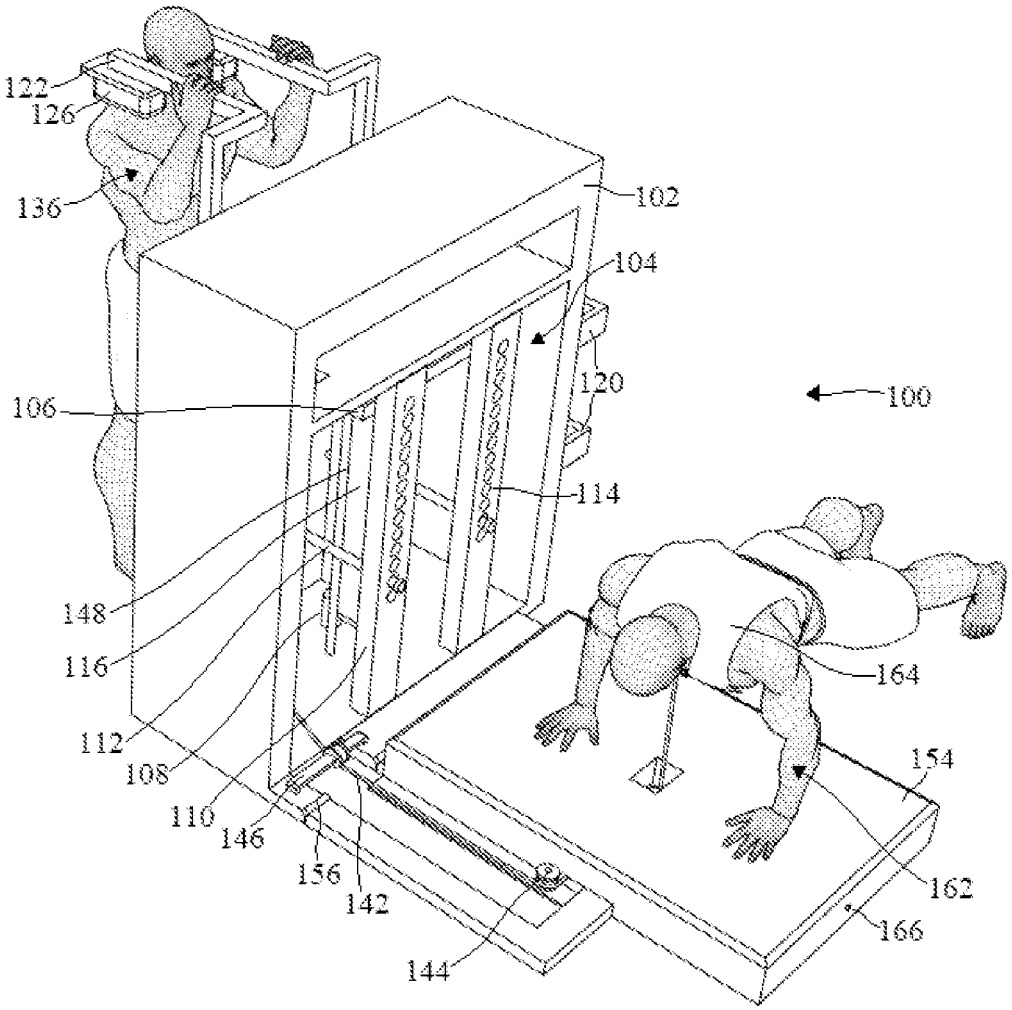
Figure 13D:
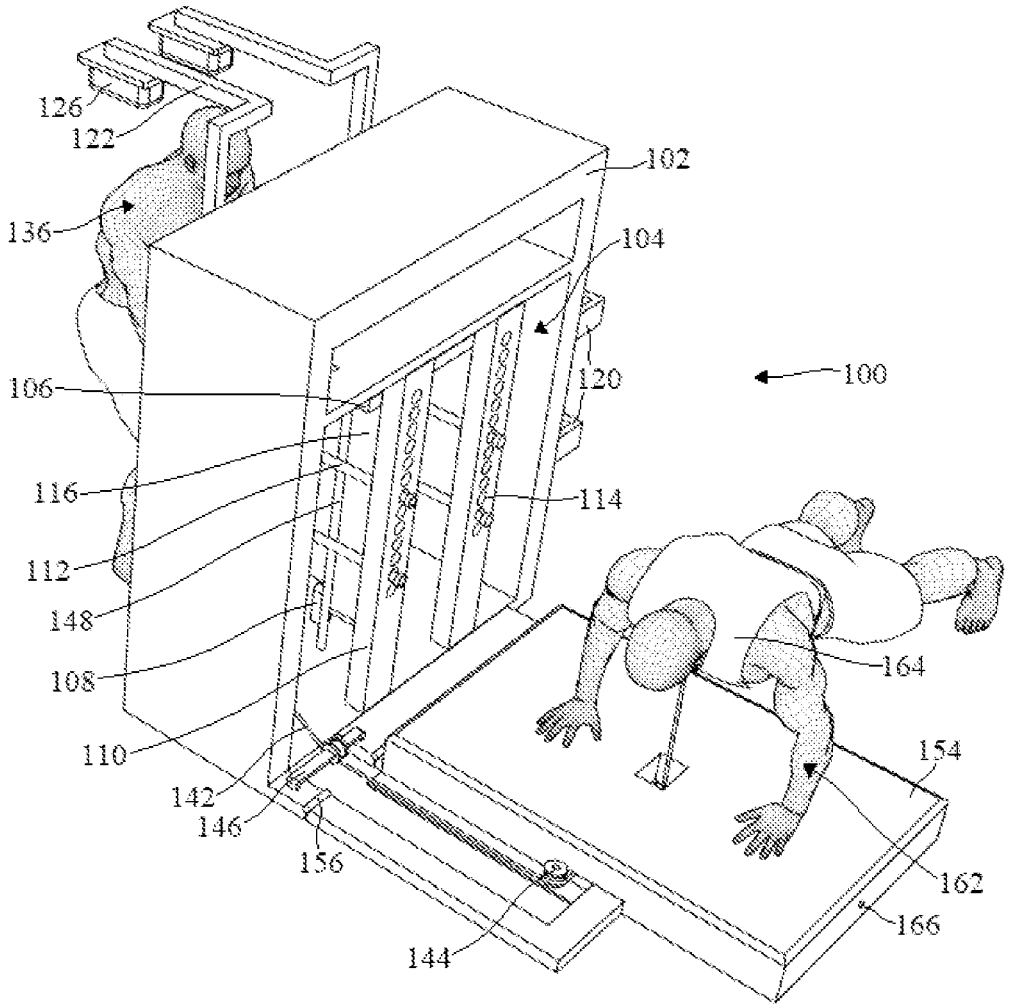
Figure 13E:
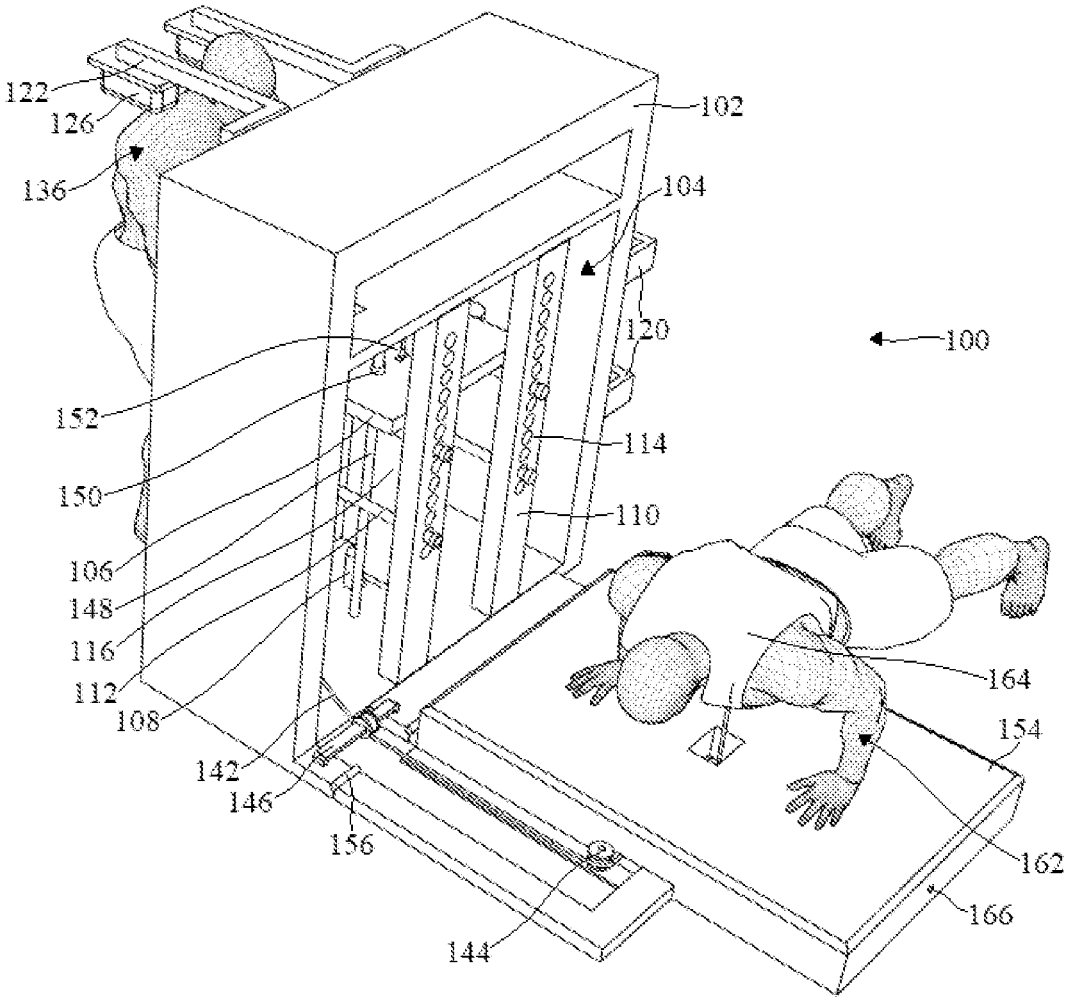
Figure 13F:
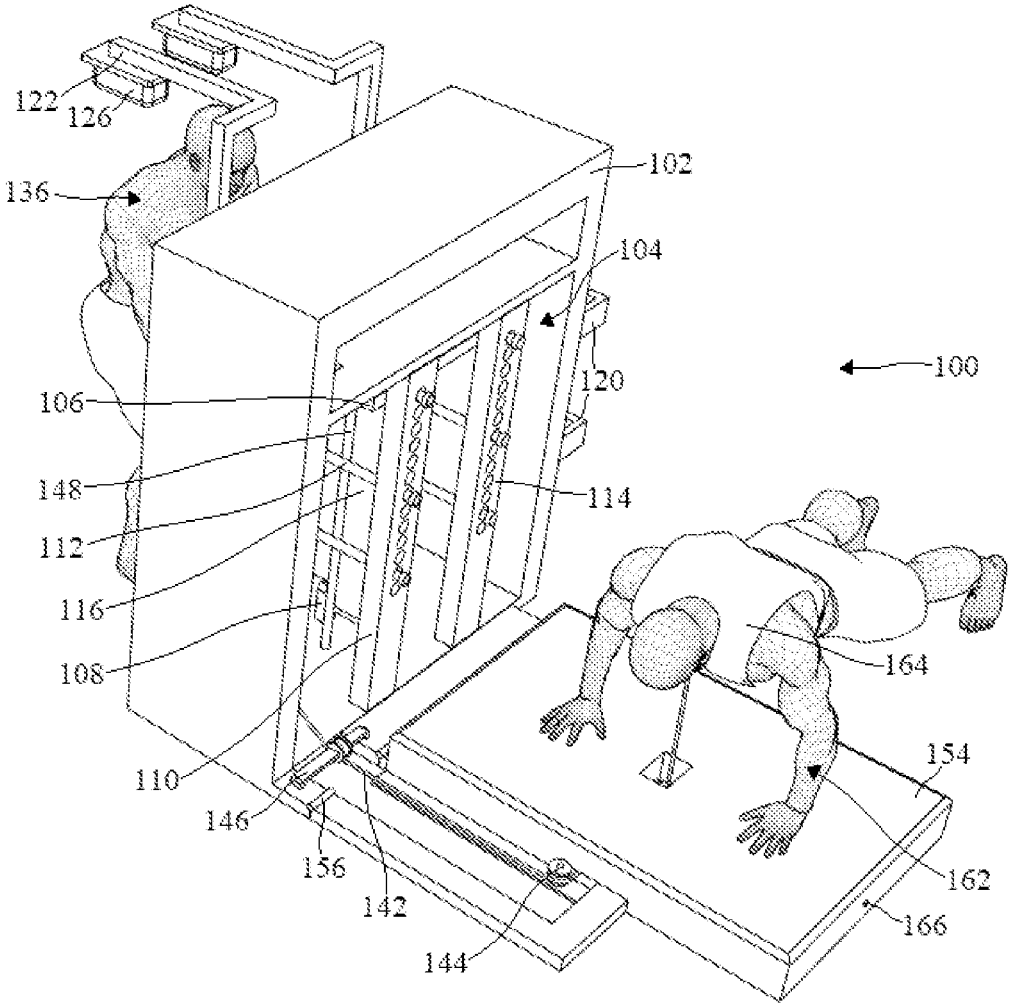

In some embodiments, as depicted in FIG. 1K, TPAF 121 includes shoulder padding (or "shoulder pads") 126 interconnected with input lifting arm 122. Shoulder pads 126 can include two pads residing towards the upper end of housing 102 with each pad laterally spaced relative to each other. This position allows a training partner to engage each shoulder padding 126 with each shoulder while in a generally upright stance as exemplified in FIG. 13B. Some embodiments as shown in FIG. 1L include both shoulder pads 126 and handle grips 124.

Referring now to FIGS. 1M-1P, another exemplary embodiment of a resistance band exercise machine 100 is disclosed. This exemplary embodiment is the same as the one shown in FIGS. 1F-1L but with a different TPAF 121. In this embodiment, TPAF 121 includes cable-pulley system 128 in operable communication with top plate 106. In some embodiments, a first end of cable-pulley system 128 has an exercise handle attachment 130 and the second end of cable-pulley system 128 includes a snap link hook 132 that connects to O ring 134 on the other end that is welded or connected in any manner to top plate 106. Any exercise handle attachment may be used.

As depicted, the first end of cable-pulley system 128 passes through an opening in a lateral wall of housing 102 about halfway between the top and bottom of housing 102. This location results in three pulleys to direct the cable between top plate 106 and the opening in the lateral wall of housing 102 while ensuring that a tension force applied to the cable through handle 130 causes top plate 106 to experience an upwardly direct force, which reduces the load experienced by a user. More pulleys may be used to reduce the force needed by a training partner to move top plate 106. In addition, less pulleys may be used by altering the location of handle 130. For example, only two pulleys are needed if the opening in the lateral wall is in line with the horizontally extending section of cable near the upper section of housing 102.

In some embodiments, TPAF 121 includes cable-pulley system 128, handle grips 124, and/or shoulder pads 126. In some embodiments, handle grips 124 and/or shoulder pads 126 are operably connected with top plate 106 through a cable-pulley system instead of input lifting arm 122. The cable pulley system may include one or more pulleys arranged in a multitude of ways to vary the required input force necessary to move top plate 106.

Referring now to FIGS. 2A-2D, an exercise is performed through a full range of motion from start to end position stretching the resistance band without the help of a training partner 136.

Figure 3A:
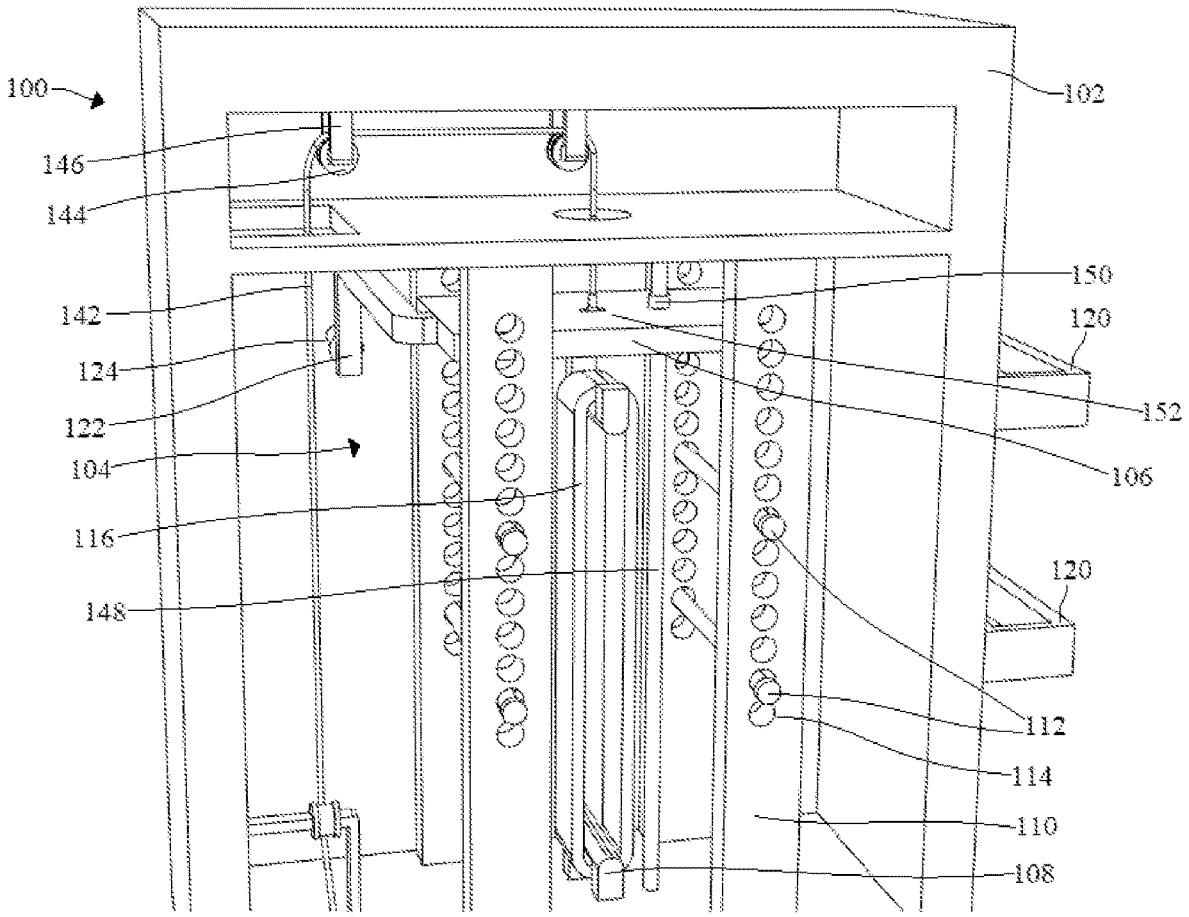
FIGS. 3A to 3C show a method of reducing an exercise's range of motion and method of performing isometrics in resistance band exercise machine in accordance with another embodiment.
Figure 3B:
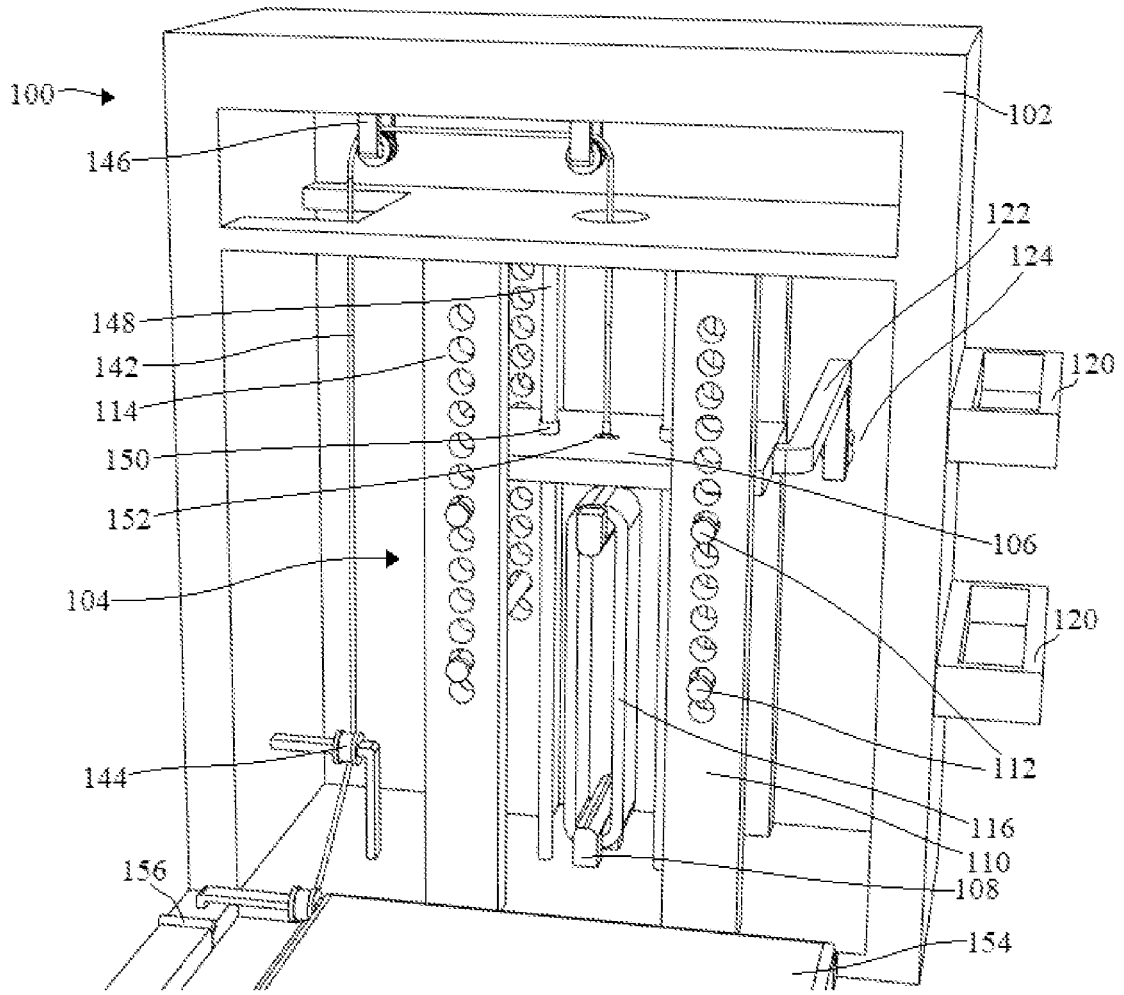
Figure 3C:
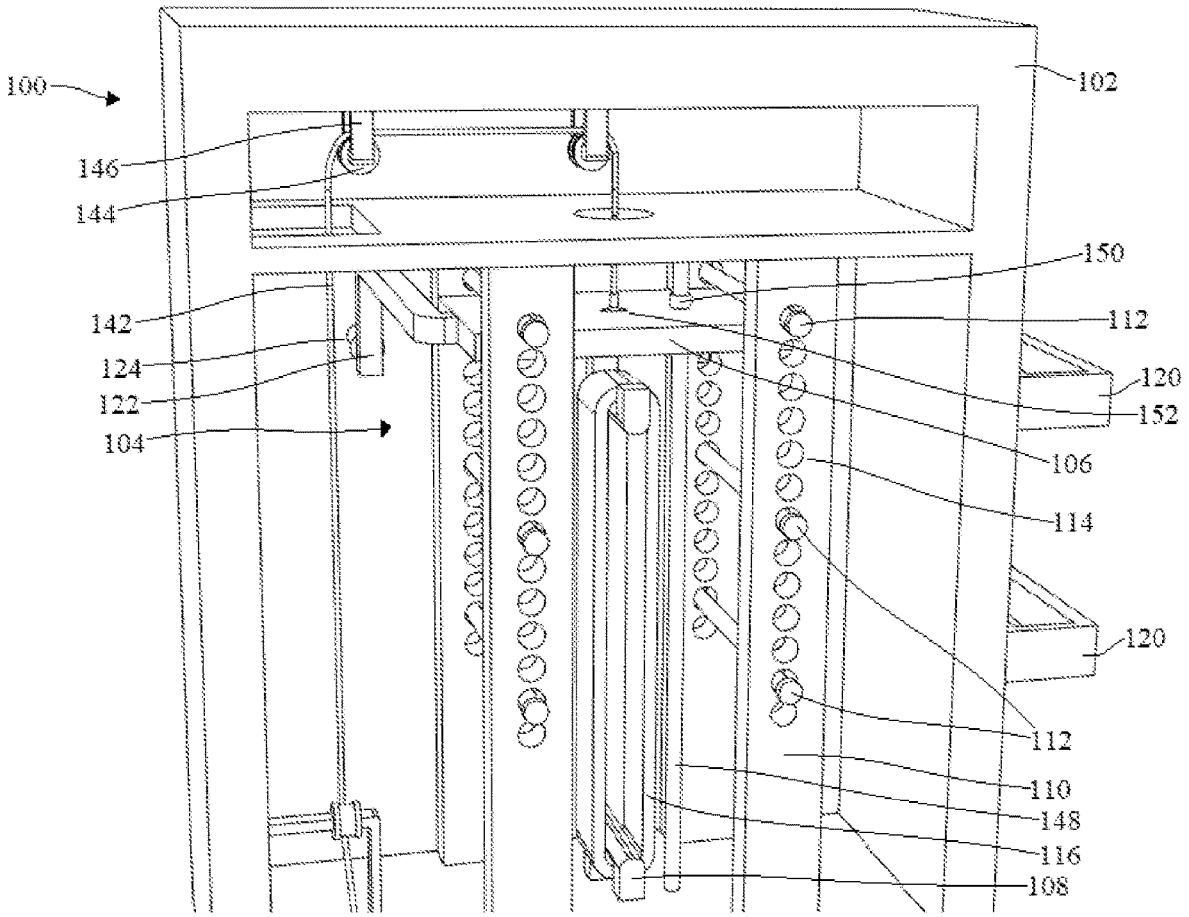
Figure 4A:
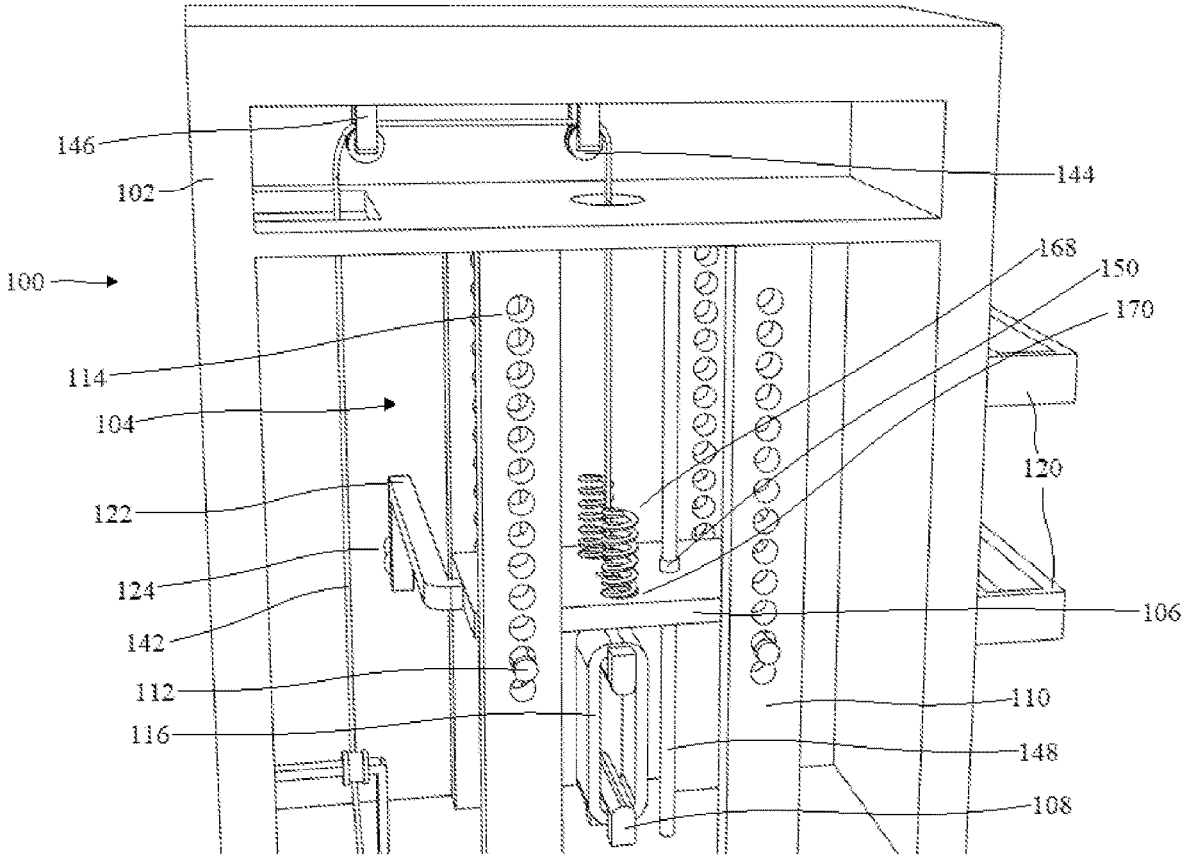
FIGS. 4A to 4D show a method of adding a secondary source of variably increasing resistance that a user contracts against towards the end position of an exercise in addition to a primary source of variably increasing resistance that a user contracts against from start to end position of an exercise in resistance band exercise machine in accordance with another embodiment.
Figure 4B:
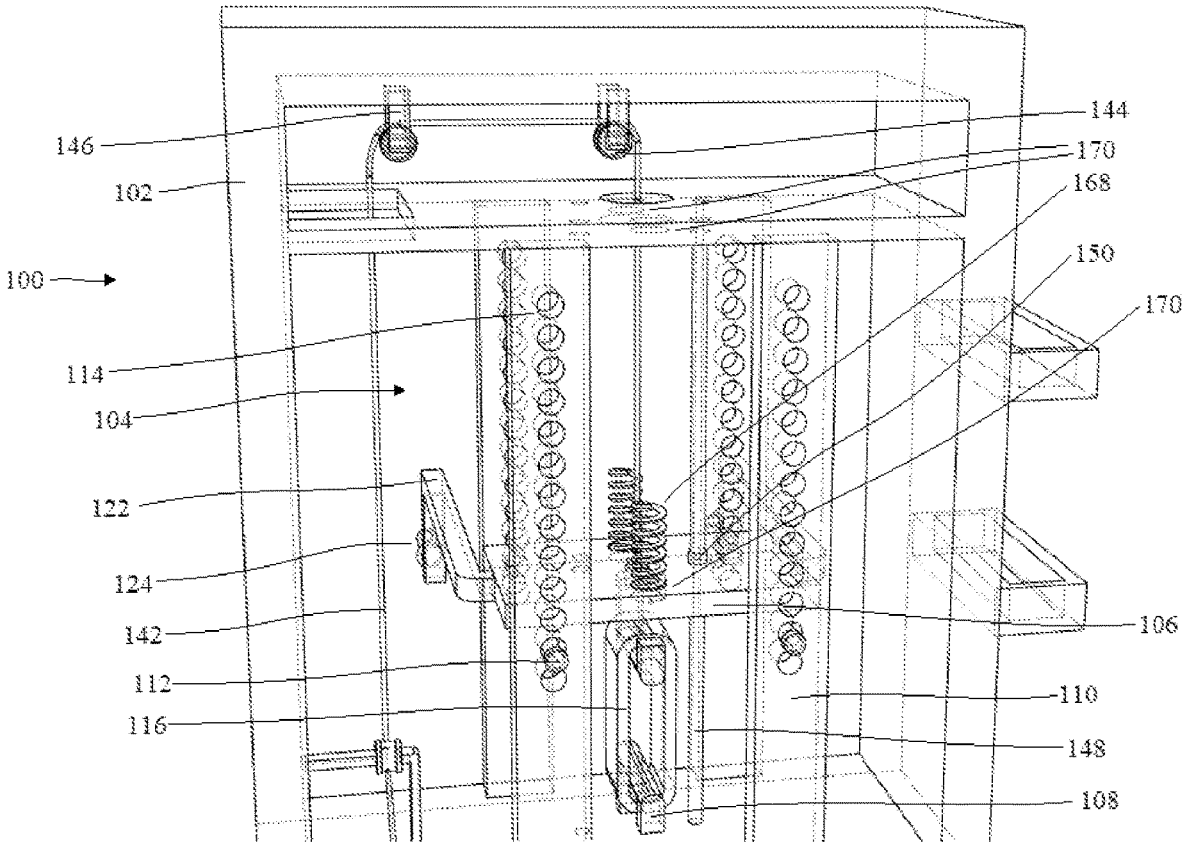
Figure 4C:
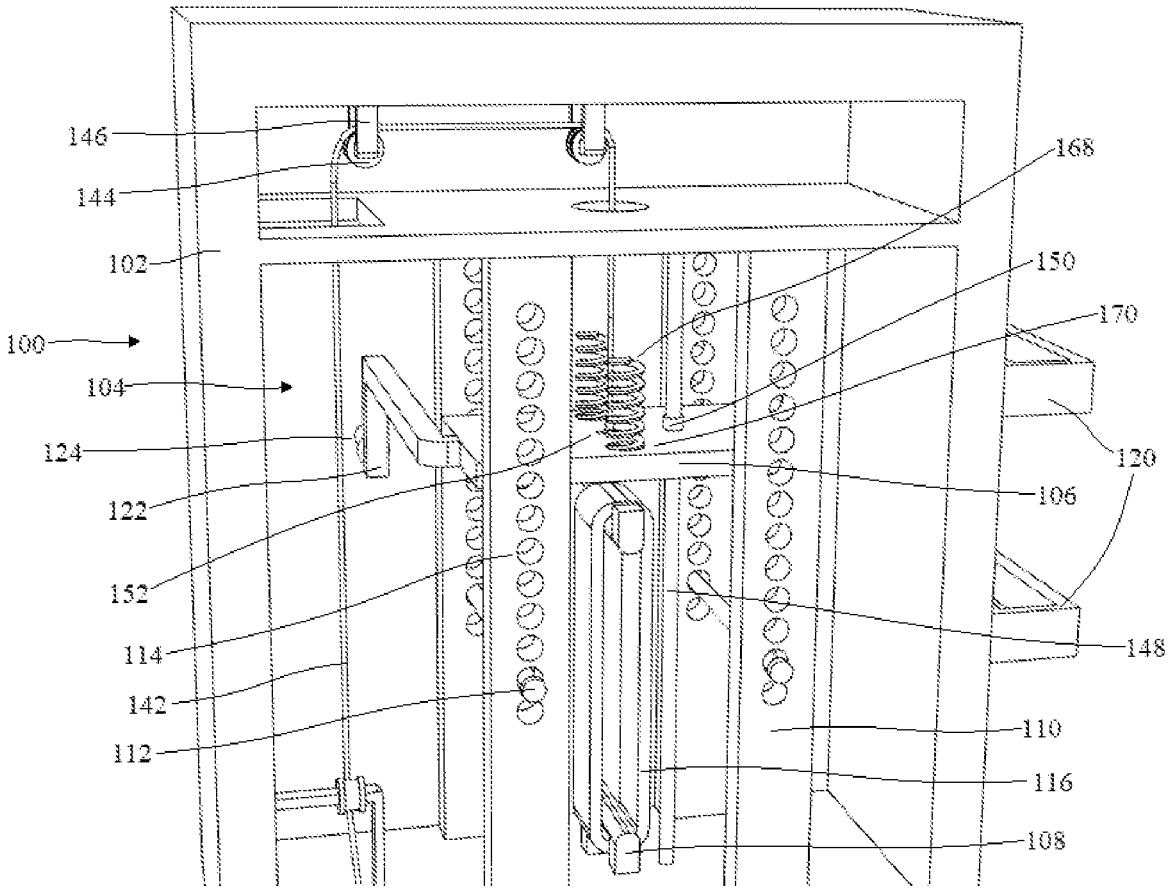
Figure 4D:
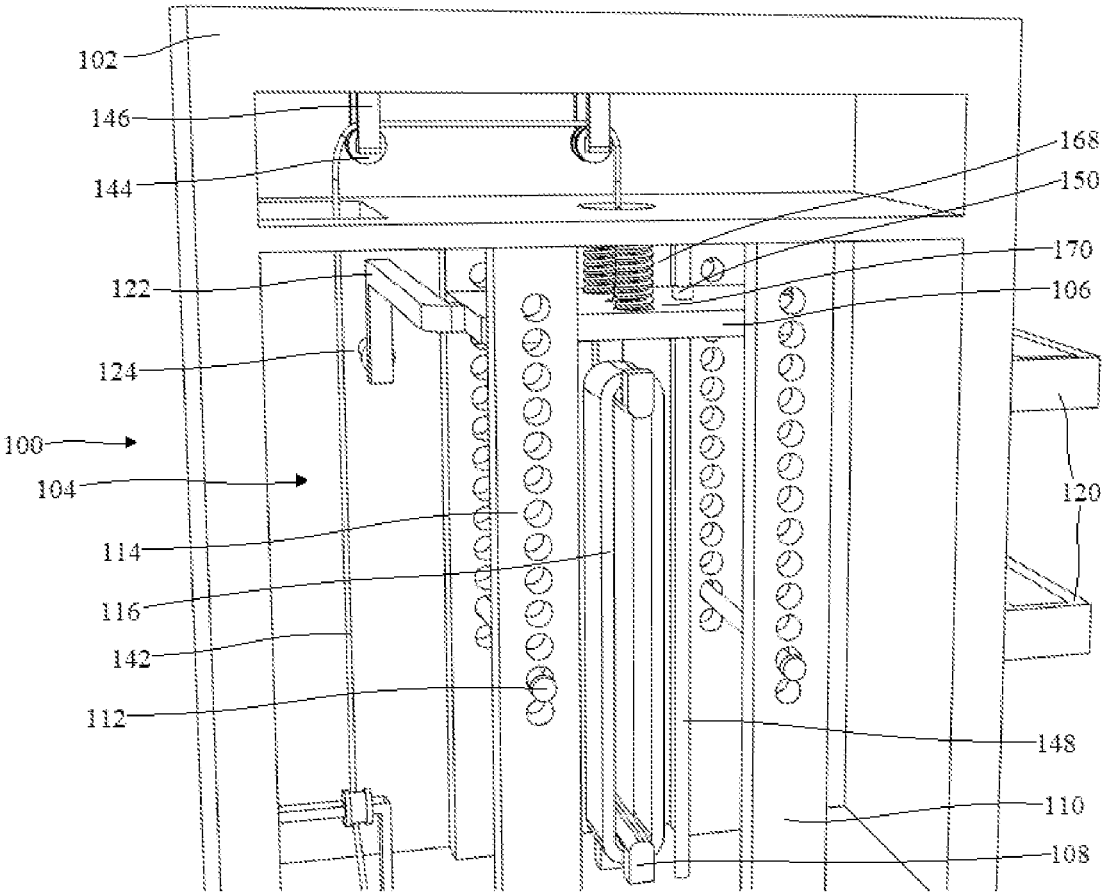

Referring now to FIGS. 3A-3C, the training partner inserts additional pair of safety bars 112 into the safety bar hole after an exercise is performed to the end position to reduce the exercise's range of motion and perform isometrics.

Referring now to FIGS. 4A-4D, another exemplary embodiment of a resistance band exercise machine 100 is disclosed. The cable-pulley variable resistance system has the resistance band and a secondary source of variably increasing resistance (springs 168). An exercise is performed through a full range of motion from a start position to an end position contracting against the resistance band and then the springs at the end position of an exercise. The springs are placed on the top plate into a recessed spring pocket 170 with another recessed spring pocket on the upper frame member of the cable-pulley variable resistance system housing to keep the springs in place at the end position of an exercise. The addition of the springs to the resistance band increases the variability in resistance level from the start position to the end position of an exercise matching the user's muscle group strength curve. The springs may be placed on top where the recessed spring pocket is on the cable-pulley variable resistance system housing and held in place by any means known in the art. A plurality of springs from the cable-pulley variable resistance system may be used in the resistance band exercise machine and placement of the recessed spring pocket may be anywhere on the top plate and the cable-pulley variable resistance system housing. Any means known in the art other than the recessed spring pocket to keep the springs in place may be used in the resistance band exercise machine.

Referring now to FIGS. 14A-14E, another exemplary embodiment of a resistance band exercise machine 100 is disclosed. This exemplary embodiment is the same as the one shown in FIGS. 1M-1P and 4A-4D with the addition of a negative repetition assistance feature ("NRAF") 172. However, NRAF 172 can be implemented with each of the other embodiments described herein.

NRAF 172 includes a weight receiving system, such as platform 178. Applying a weight or a force to platform 178 applies an additional force on the top plate in a manner that increases the perceived force applied to the user. NRAF 172 is particularly useful when a user wants to execute a repetition and then add weight at the top end of the repetition such that the eccentric ("negative") portion of the repetition includes a greater force applied to the user in comparison to the concentric ("positive") portion of the repetition.

To achieve the desired functionality, NRAF 172 is in operable communication with top plate 106 in a way that increases the total force vector on top plate 106. In some embodiments, this is achieved through cable-pulley system 174. The first end of the cable is interconnected with platform 178 and the second end is secured to the bottom of top plate 106. Thus, any tension force applied to platform 178, and in turn the cable in cable-pulley system 174, imparts a force onto top plate 106 in a direction that is generally in the same general direction as the force imparted by resistance band(s) 116.

In some embodiments, platform 178 may be located within platform housing 176. The top surface of platform 178 is operably connected to the first end of at least one cable in cable-pulley system 174 and is directed through the system via a series of pulleys to ultimately connect to the bottom surface of top plate 106. Some embodiments include a pair of cables in cable-pulley system 174 with each pair attached to opposing lateral sides of platform 178. Some embodiments may include more or less pulleys than depicted depending on where the NRAF 172 is located relative to top plate 106.

Housing 176 may include side walls with an open upper area to receive a weight or a training partner's limb. The open upper area is sufficiently sized to receive a foot, dumbbell, kettlebell, and/or weight plate. The upper region also includes a pair of overhanging shoulder sections to engage the lateral portions of the top surface of platform 178 when a user has moved into the top end of the repetition as shown in FIG. 15K. Each overhanging shoulder also provides a mounting surface for a pulley and includes an aperture to allow passage of the cable from the pulley, through the shoulder, and to platform 178.

Figure 14A:
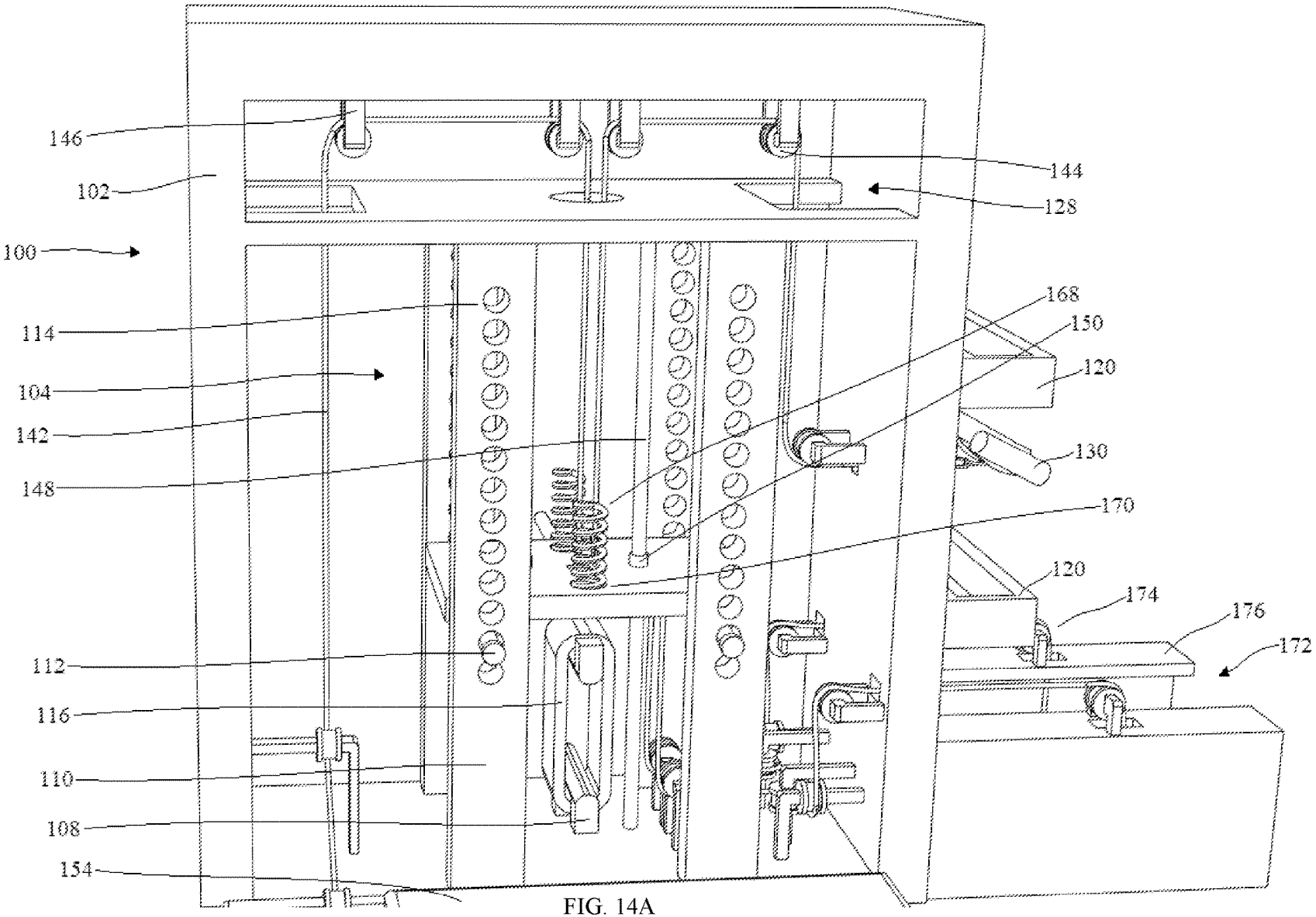
FIGS. 14A to 14E show a perspective view of resistance band exercise machine and in start, mid, and end positions of an exercise's range of motion in accordance with another embodiment.
Figure 14B:
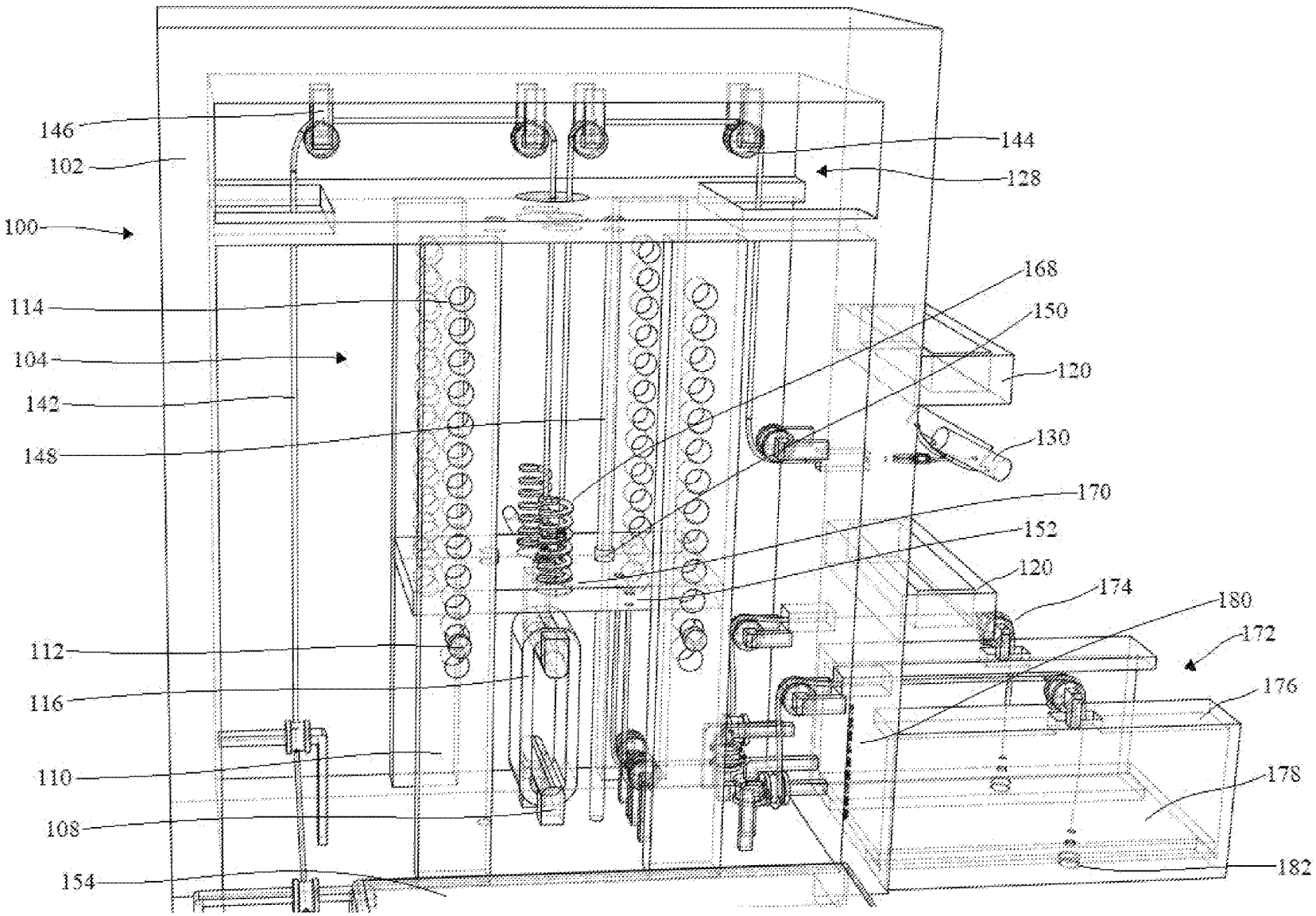
Figure 14C:
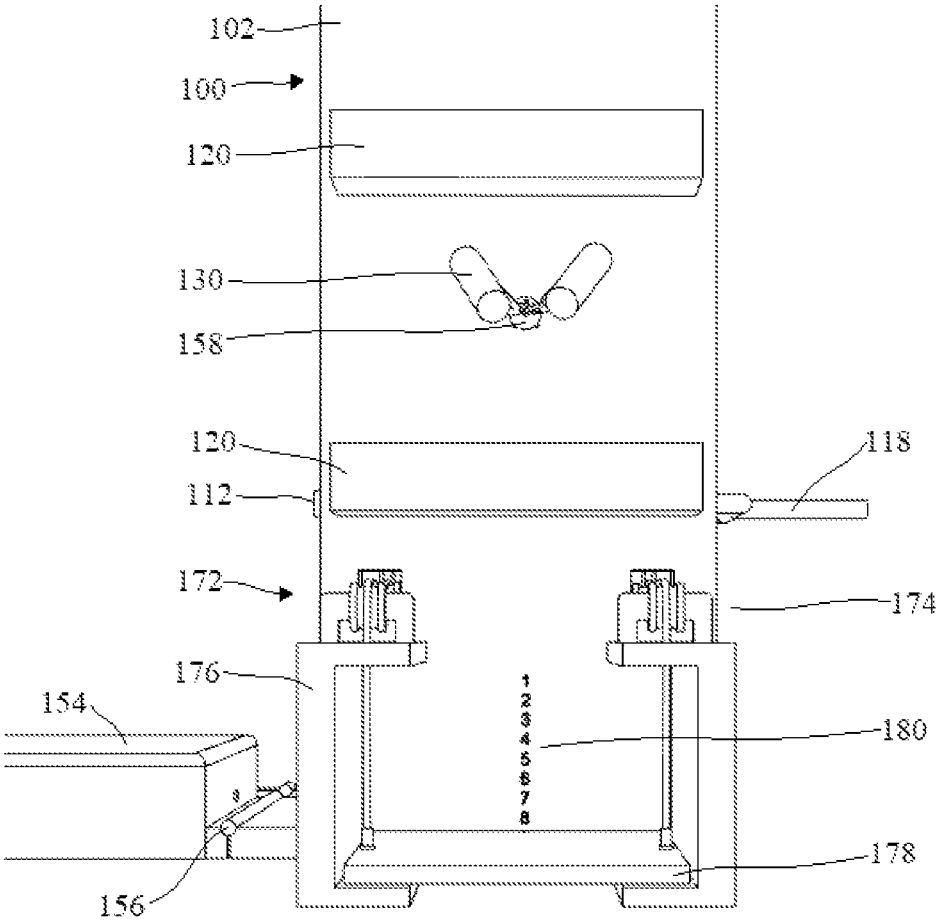
Figure 14D:
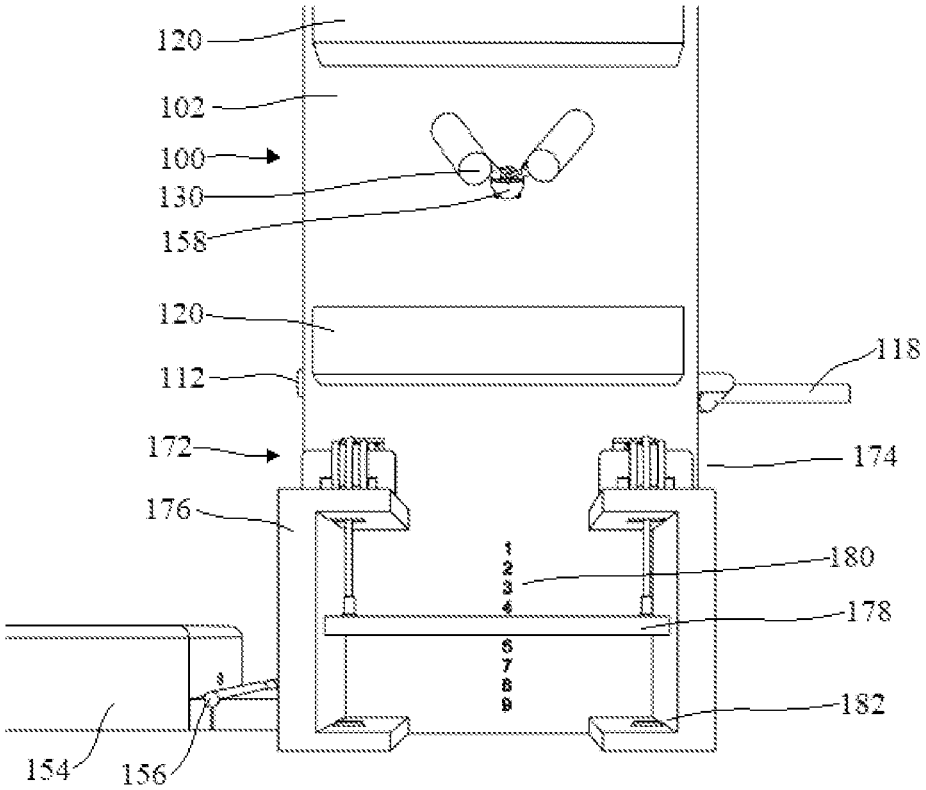
Figure 14E:
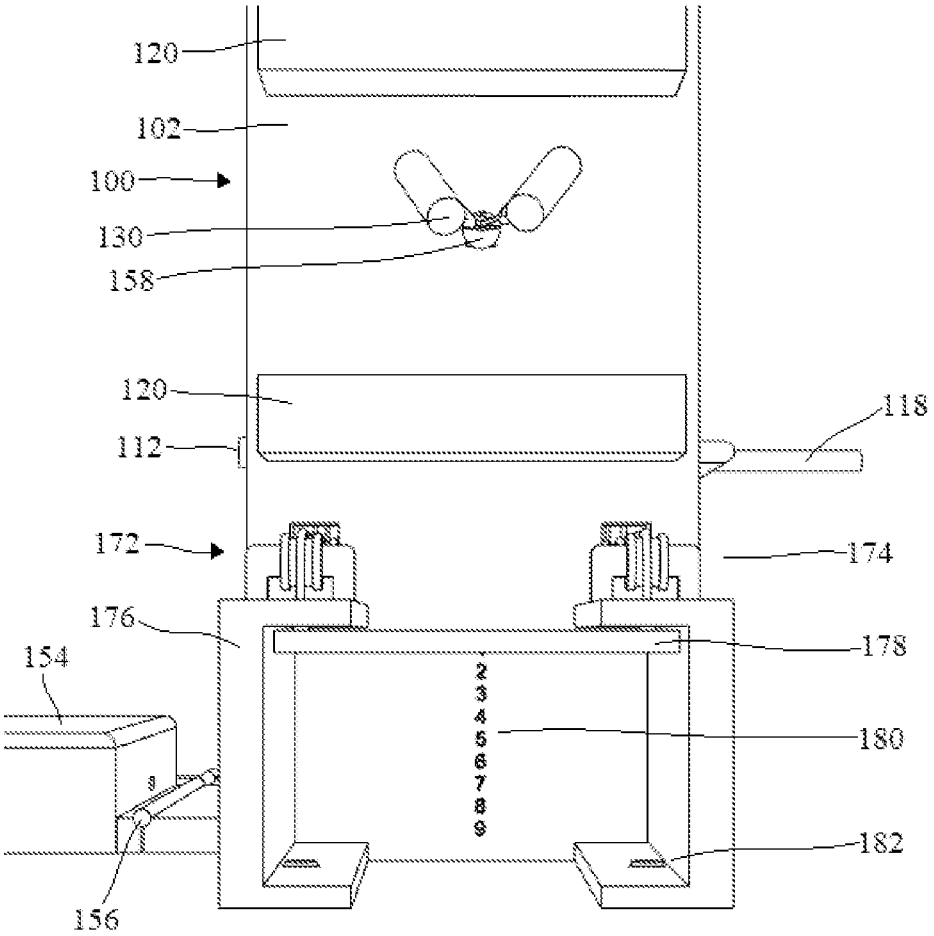

As best depicted in FIGS. 14C-14E, NRAF 172 may include indicia located on a side wall of housing 102 or a back wall of housing 176. The indicia may be a series of alphanumeric characters, such as sequential numbers or may be holes or decals.

In some embodiments, the components of NRAF 172 are used as a TPAF. Such embodiments include additional pulleys located at alternative locations to connect the first end of the cable in cable-pulley system 174 to the top surface of top plate 106 rather than the bottom surface. As a result, the components of NRAF 172 can be used to reduce the perceived force applied to the user thus acting as a TPAF. Put another way, the total force vector on top plate 106 would be reduced in such an embodiment when weight or force is applied to platform 178 since any tension force applied to the cable in cable-pulley system 174 imparts a force onto top plate 106 in a direction that is opposite of the direction of the force imparted by resistance band(s) 116.

The resistance band exercise machine includes, but is not limited to, exercises from U.S. patent application publication 20190374814-A1. The resistance band exercise machine applies to all other exercises targeting different muscle groups in the human body.

The exercise from U.S. patent application publication 20190374814-A1 is shown in FIGS. 5-13 as an example of interaction between a user 162 and the resistance band exercise machine.

Operation—FIGS. 5, 6, 7, 8, 9, 10, 11, 12, 13, and 15

Figure 5A:
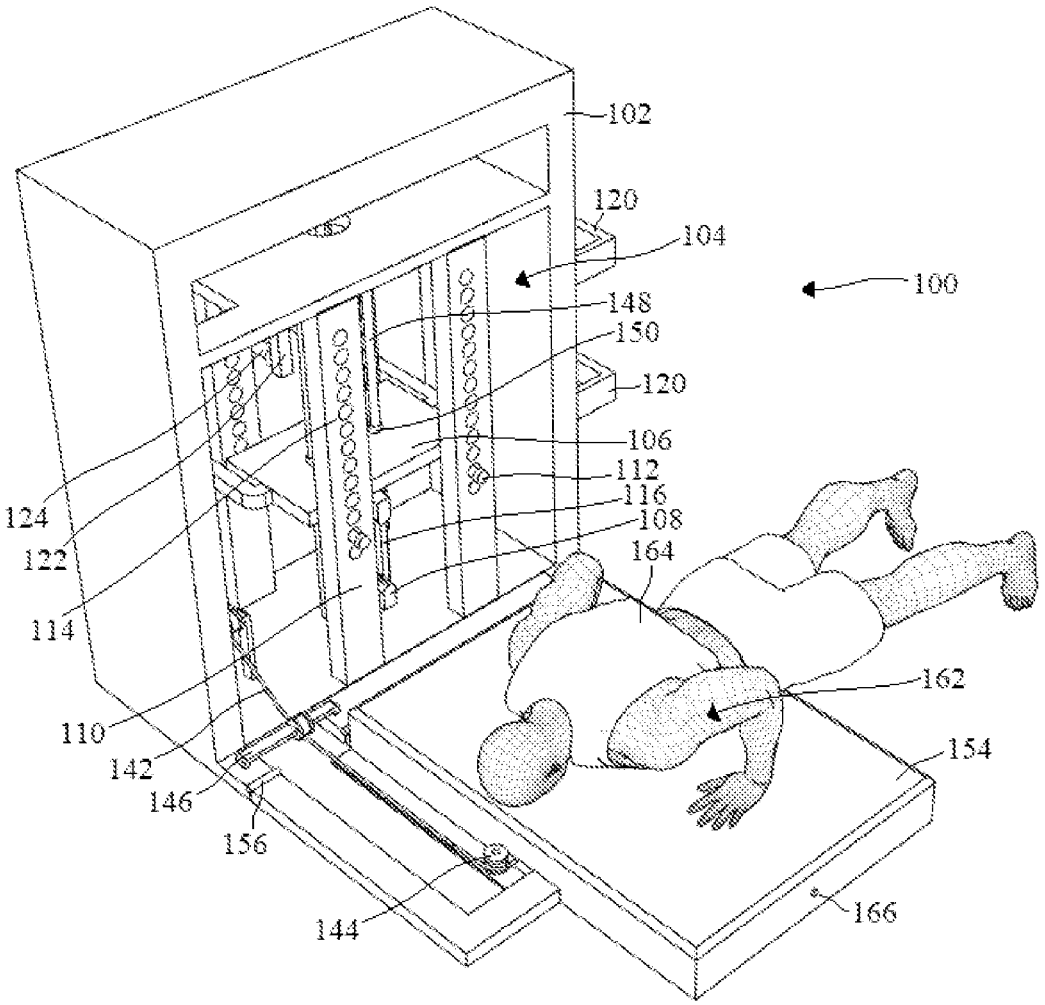
FIGS. 5A to 5C show interaction between user and resistance band exercise machine through a full range of motion exercise in accordance with another embodiment.
Figure 5B:
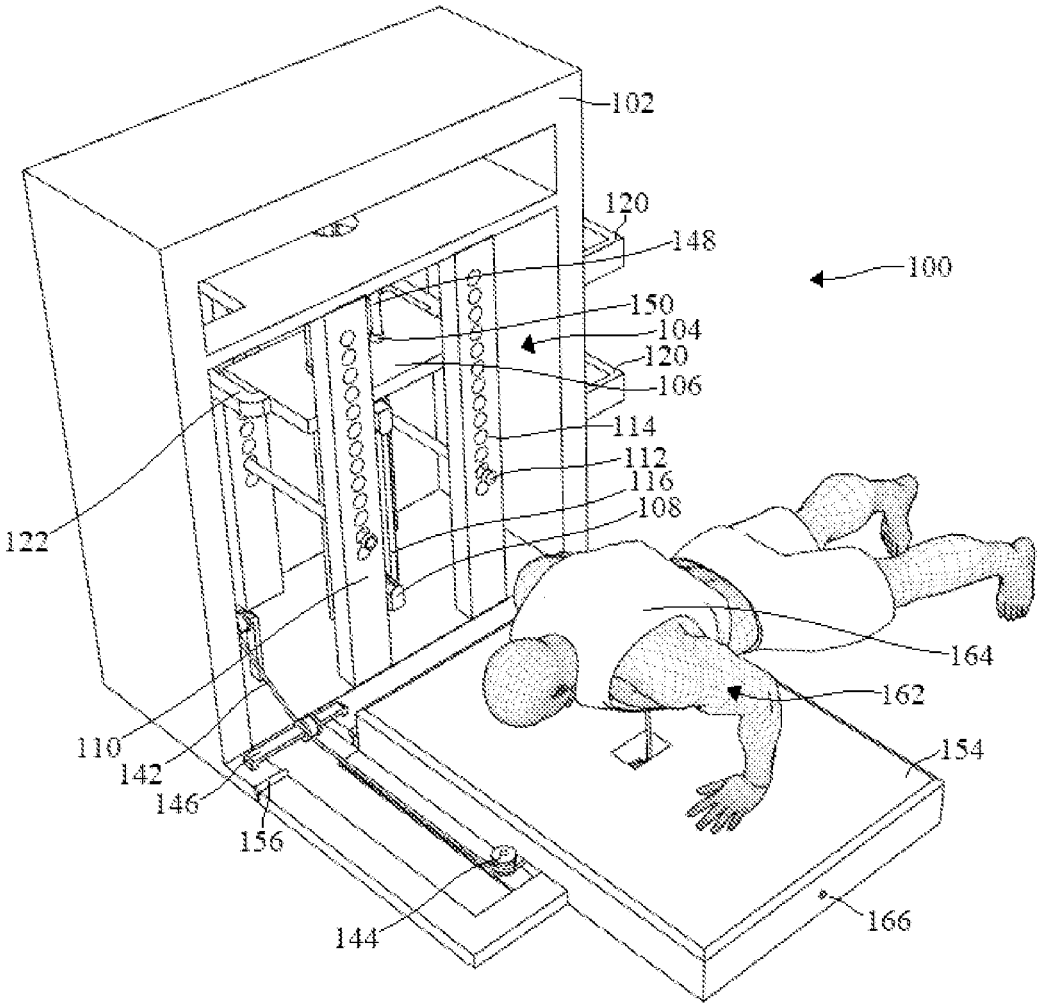
Figure 5C:
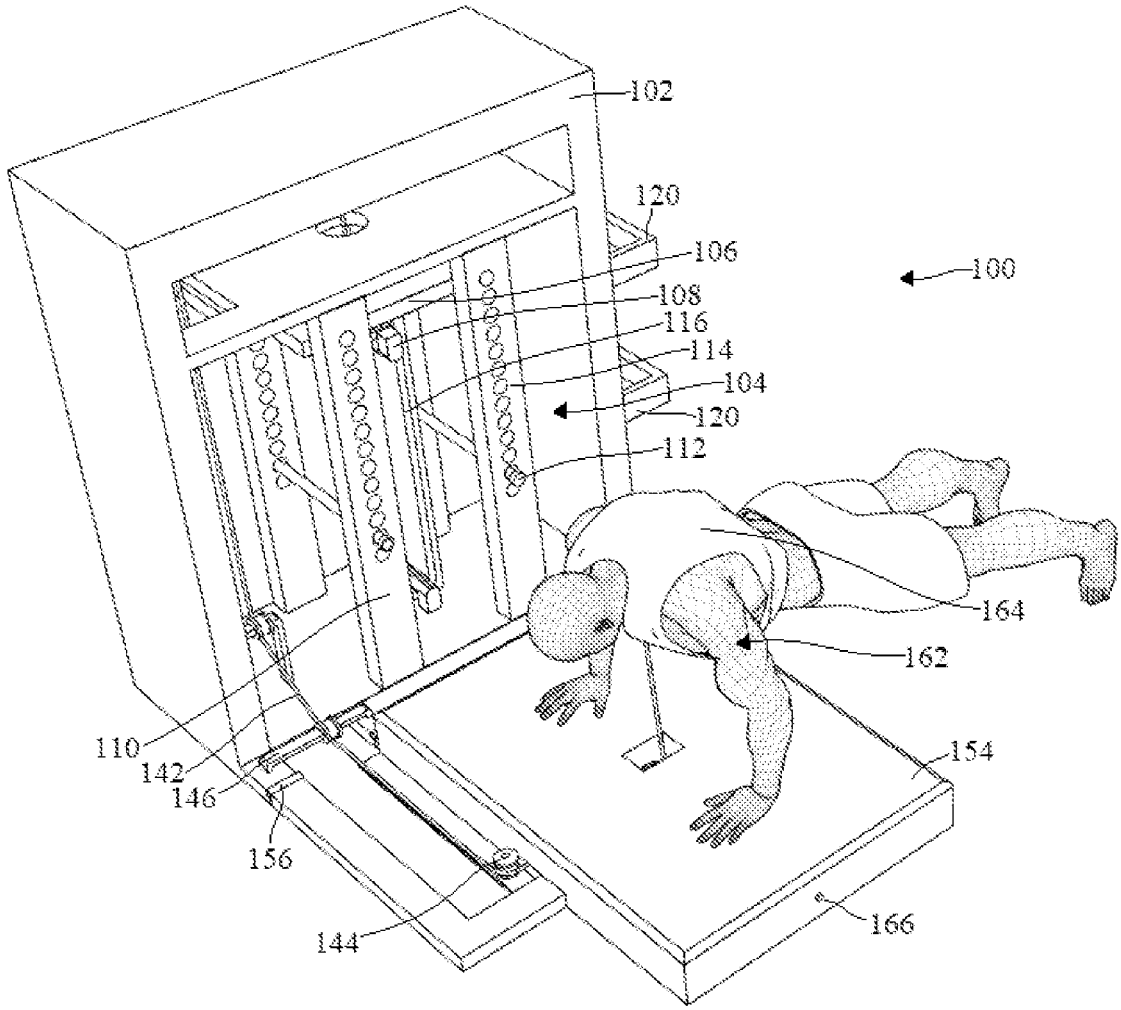
Figure 6A:
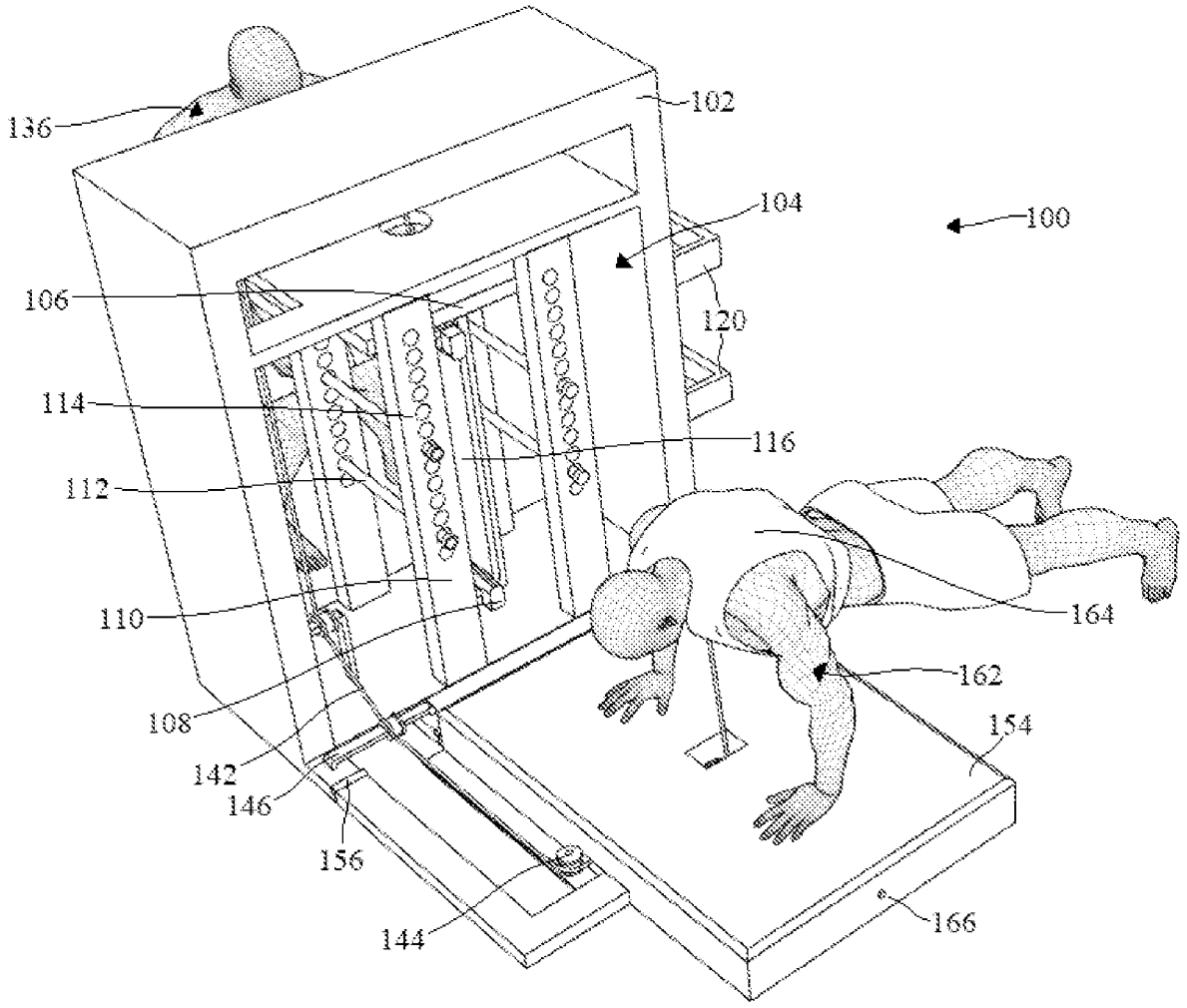
FIGS. 6A to 6C show a method of reducing an exercise's range of motion and method of performing isometrics with interaction between user and resistance band exercise machine in accordance with another embodiment.
Figure 6B:
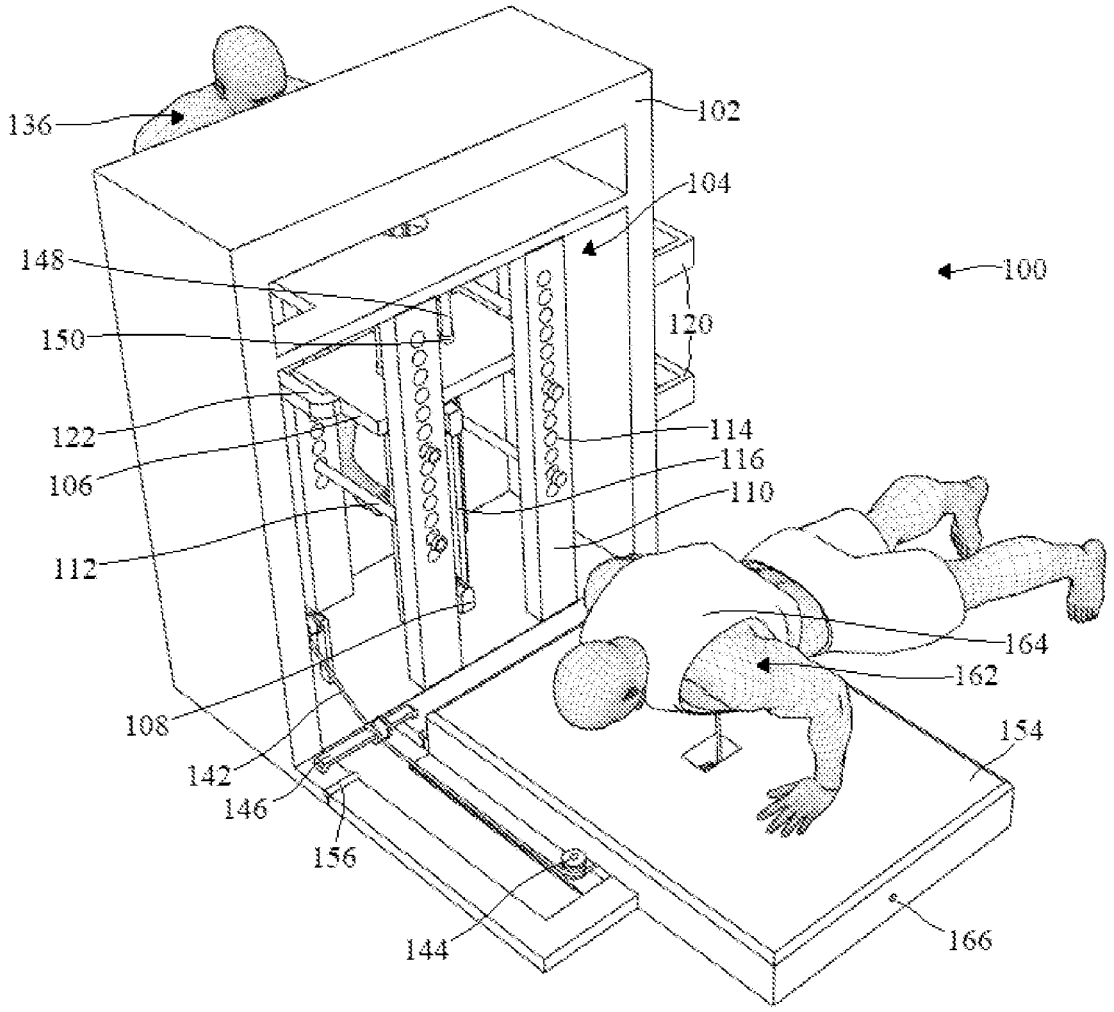
Figure 6C:
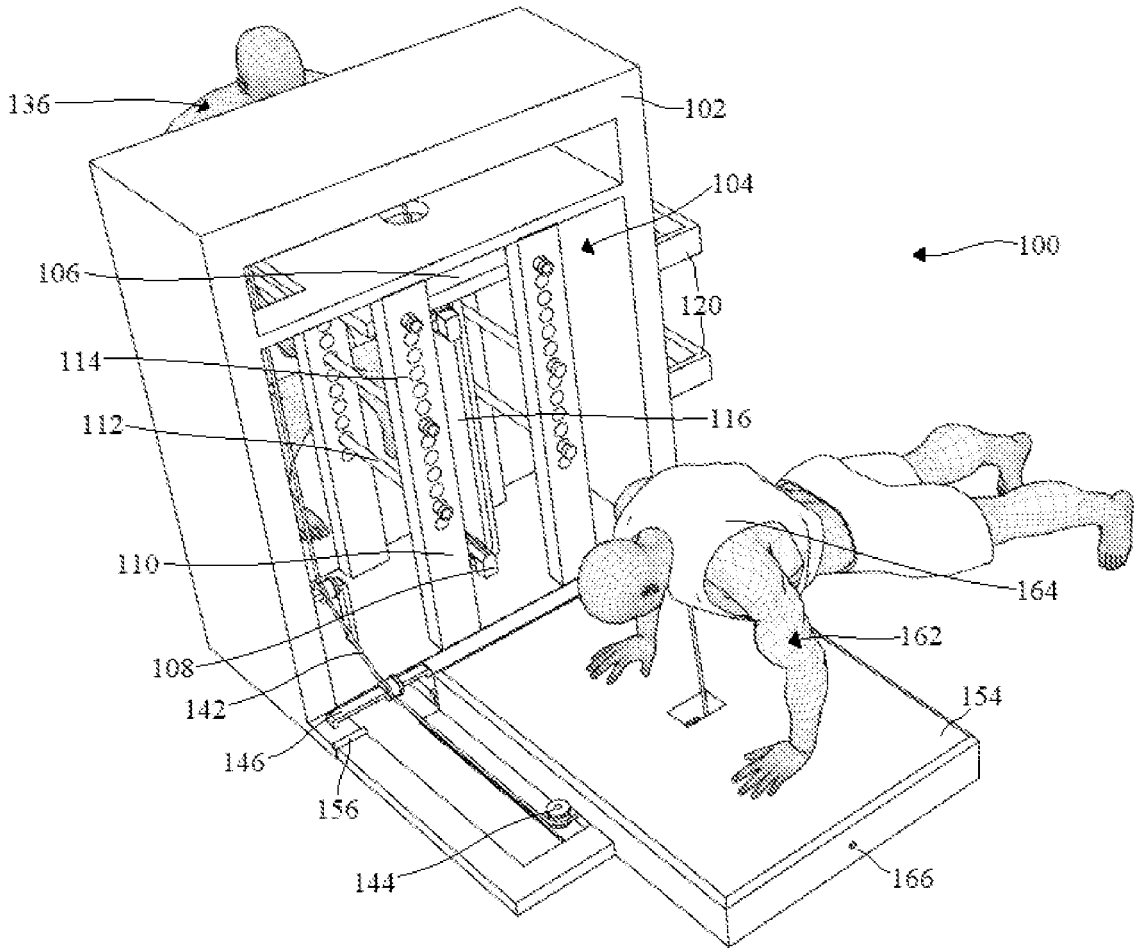

The user performs the exercise with their hands on a platform 154 through full range of motion for a number of repetitions on the resistance band exercise machine against the resistance band that is variably increasing in resistance from start to end position of the exercise by wearing a harness or belt 164 having snap link hook suspended from it and configured to connect to a cable 142 as shown in FIGS. 5A-5C. When the user cannot perform another full range of motion repetition, the training partner inserts the safety bars into the safety bar hole to reduce the exercise's range of motion as shown in FIG. 6A. The user performs a number of partial range of motion repetitions and the training partner inserts the safety bars into the safety bar hole so that the user can perform isometrics against the safety bars when they cannot perform another partial range of motion repetition as shown in FIGS. 6B and 6C. The user may begin the exercise with reduced range of motion by first performing a full range of motion repetition so that the training partner can insert the safety bars into the safety bar hole.

Figure 7A:
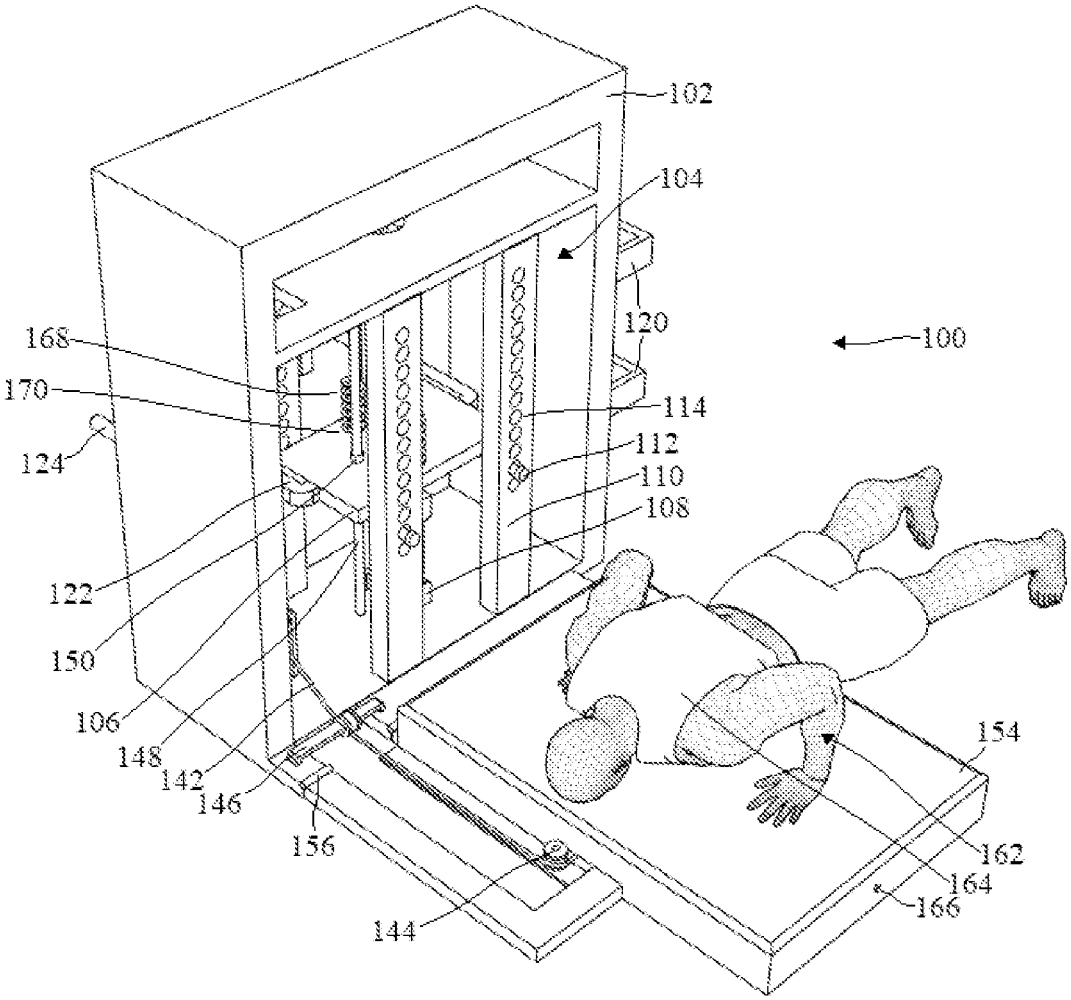
FIGS. 7A to 7C show interaction between user and resistance band exercise machine through a full range of motion exercise using primary and secondary sources of variably increasing resistance in accordance with another embodiment.
Figure 7B:
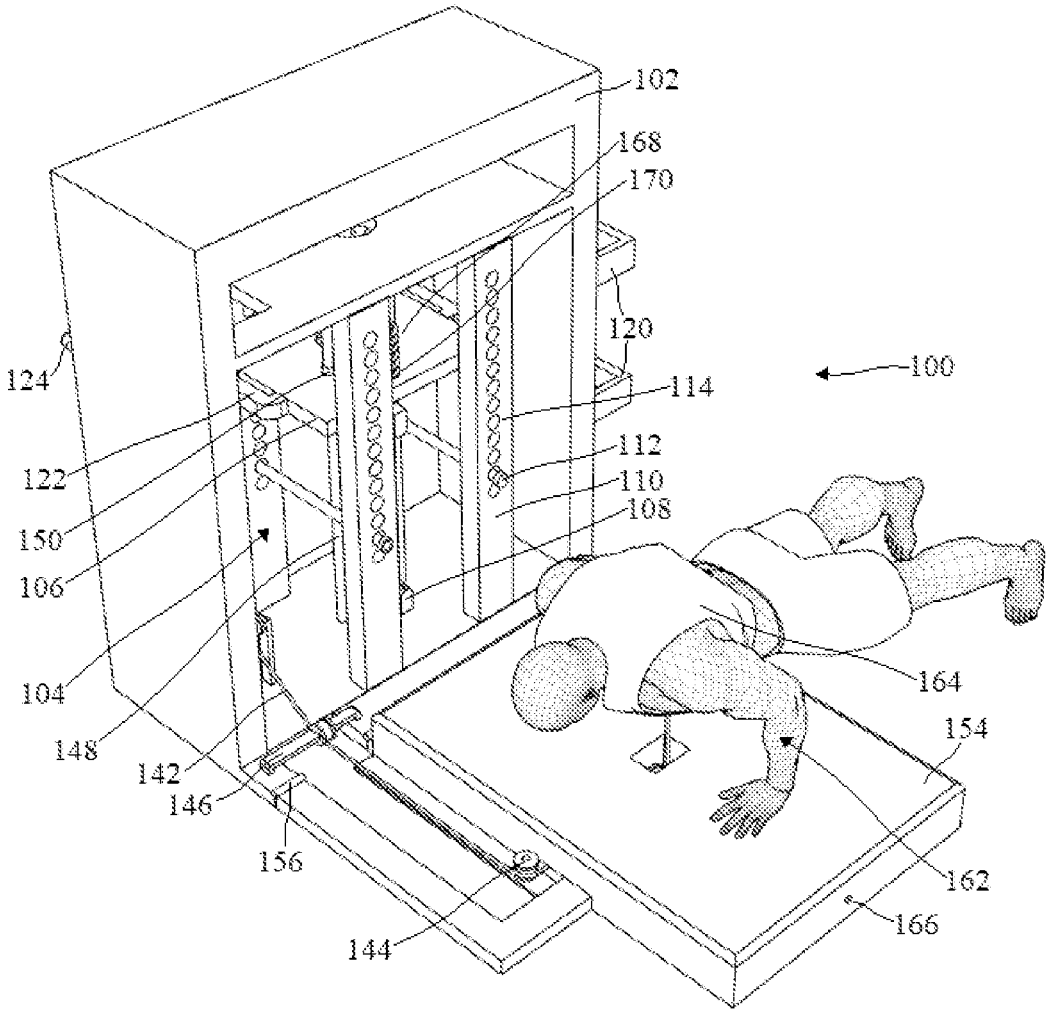
Figure 7C:
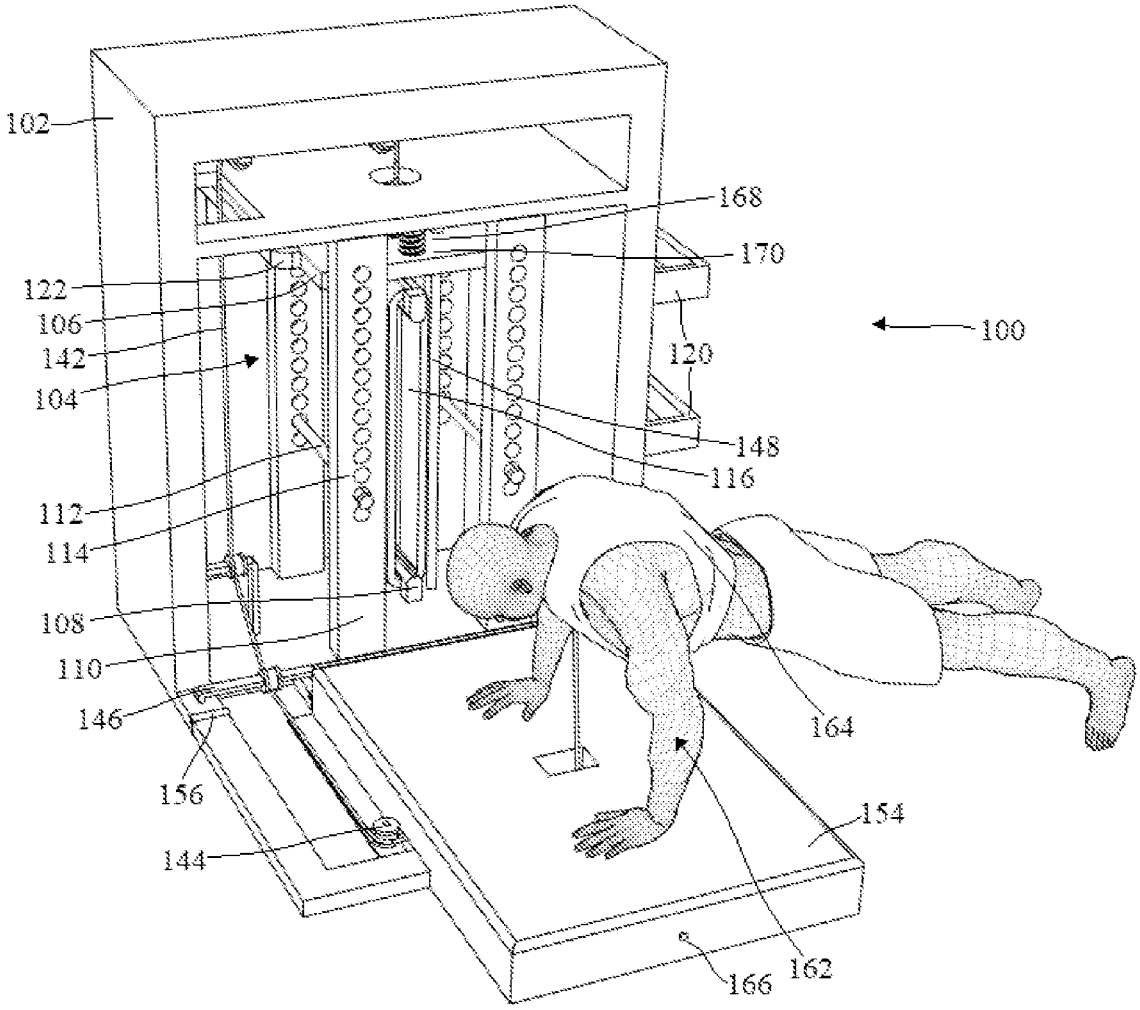
Figure 8A:
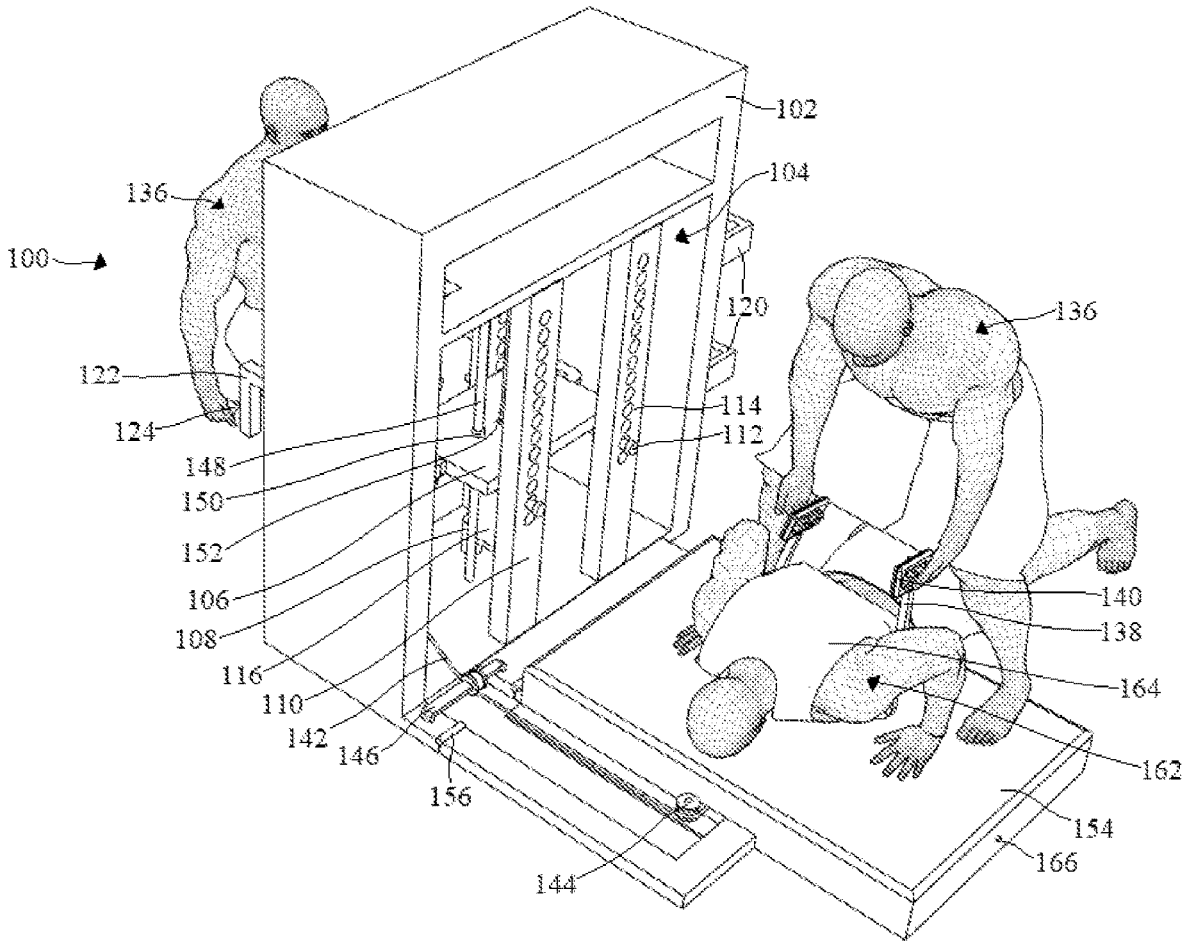
FIGS. 8A to 8F show a method of performing a negative full range of motion repetition only with interaction between user and resistance band exercise machine in accordance with another embodiment.
Figure 8B:
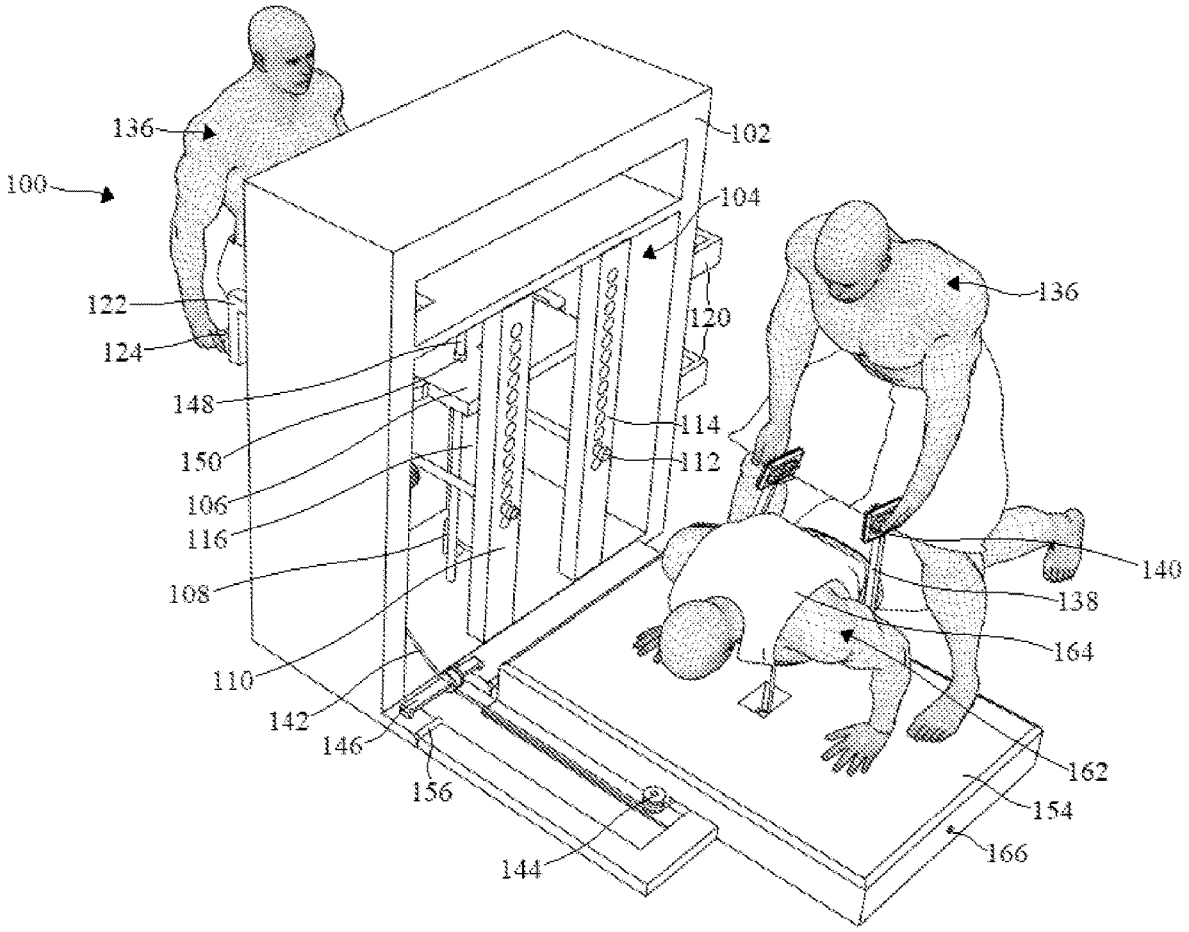
Figure 8C:
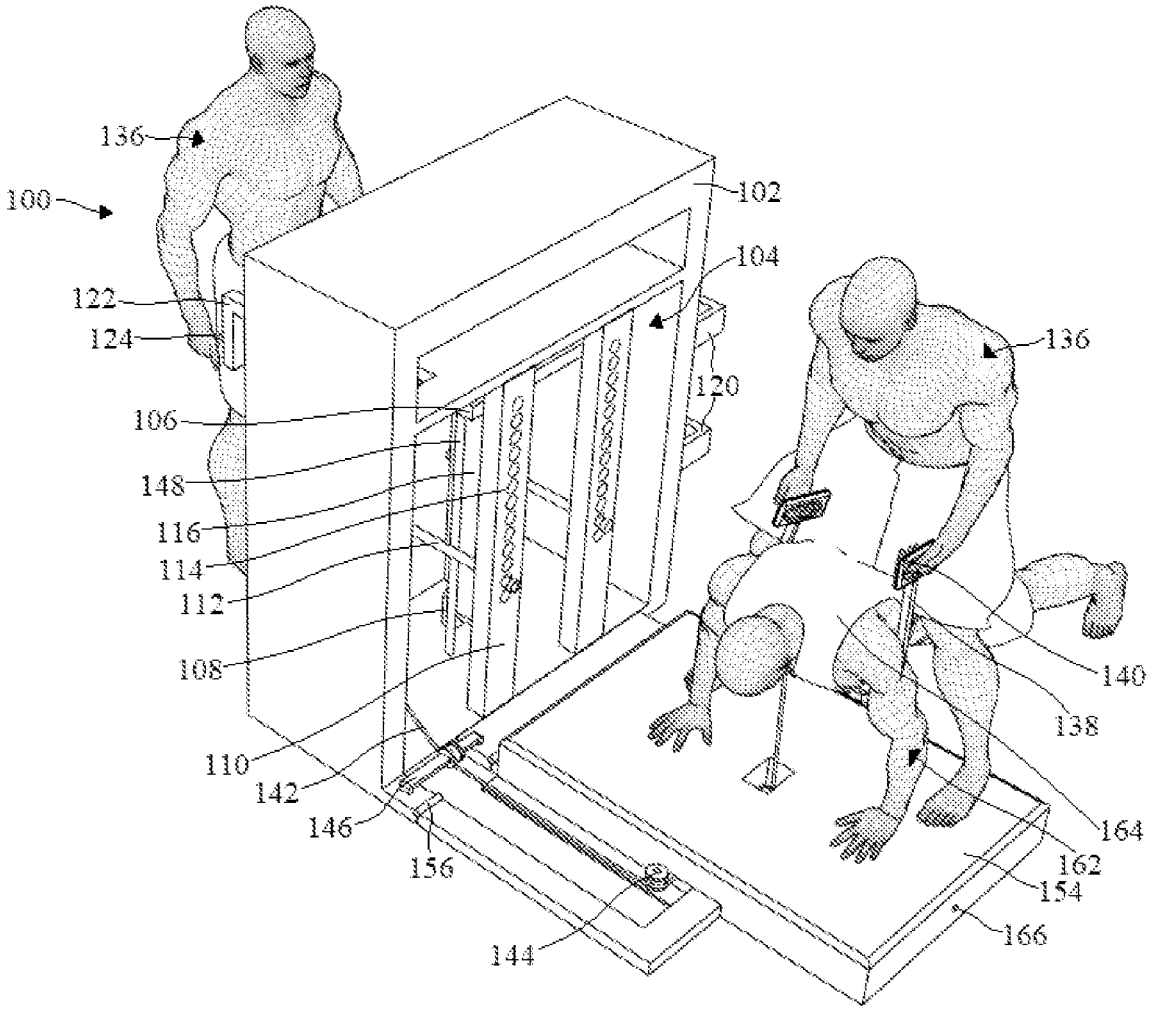
Figure 8D:
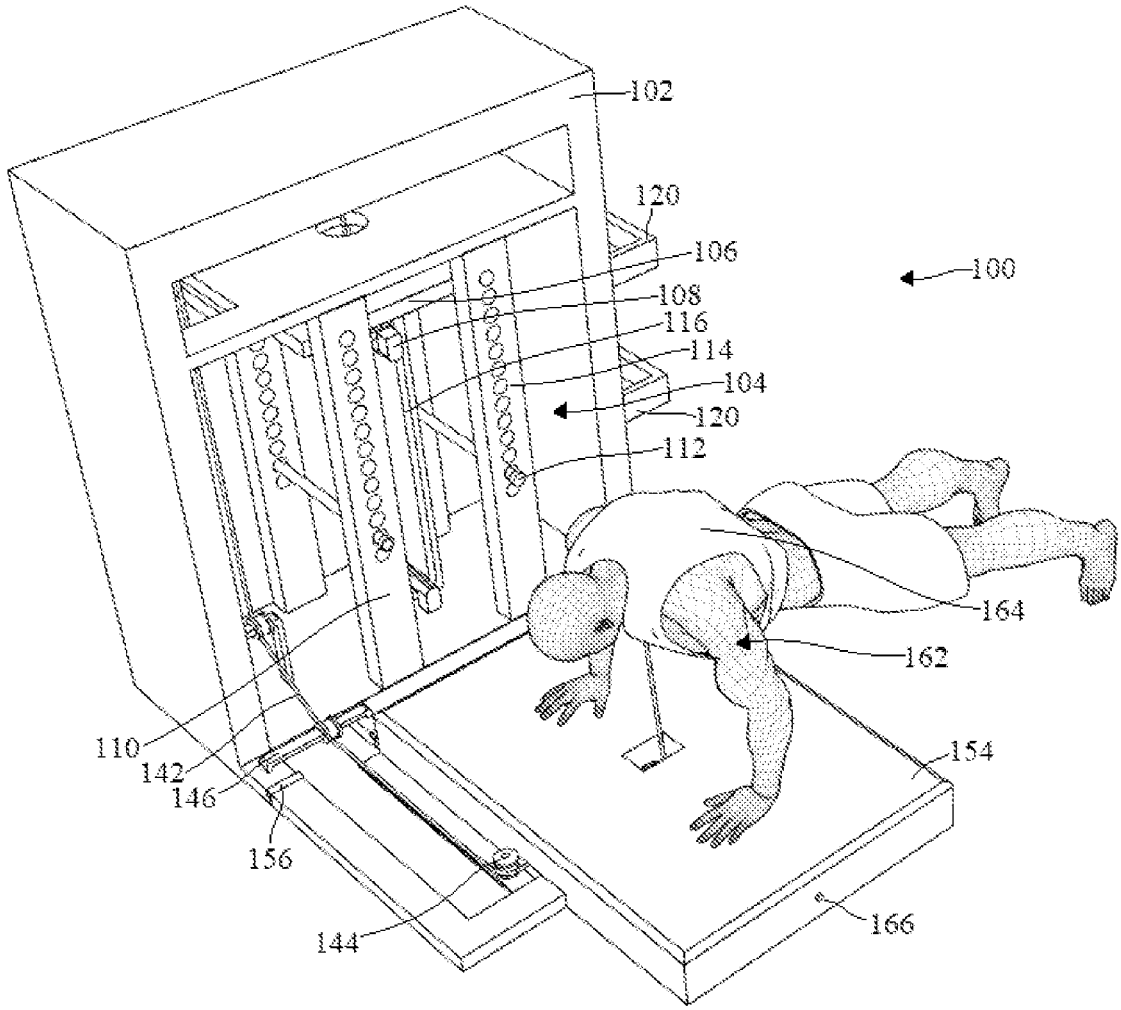
Figure 8E:
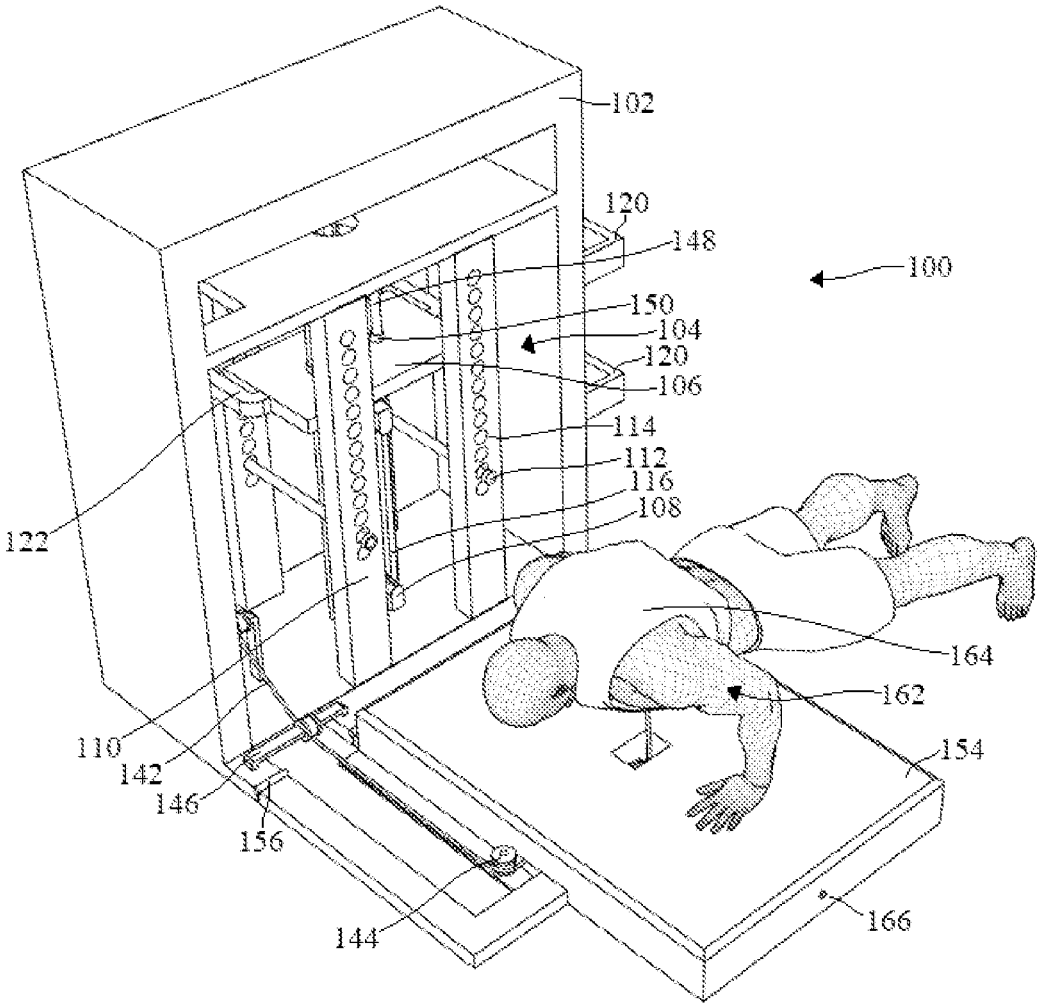
Figure 8F:
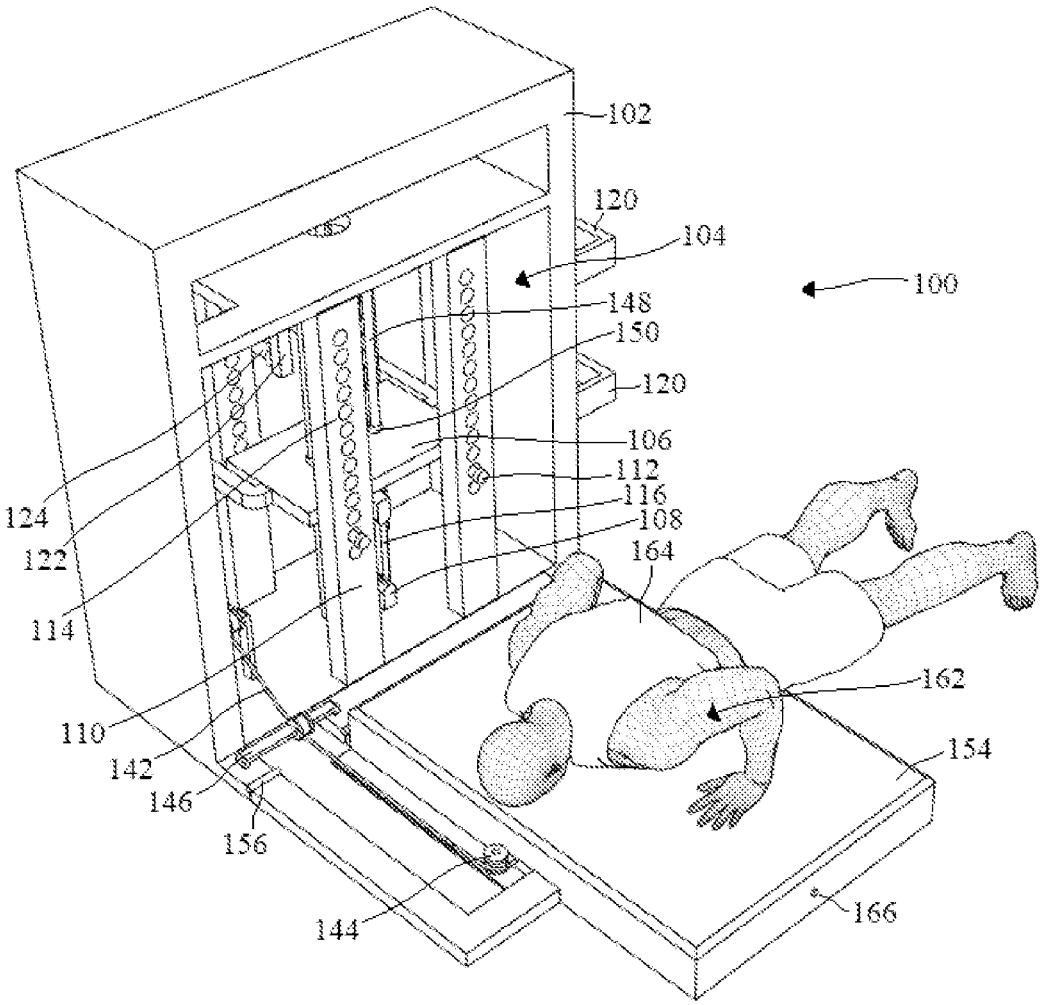
Figure 9A:
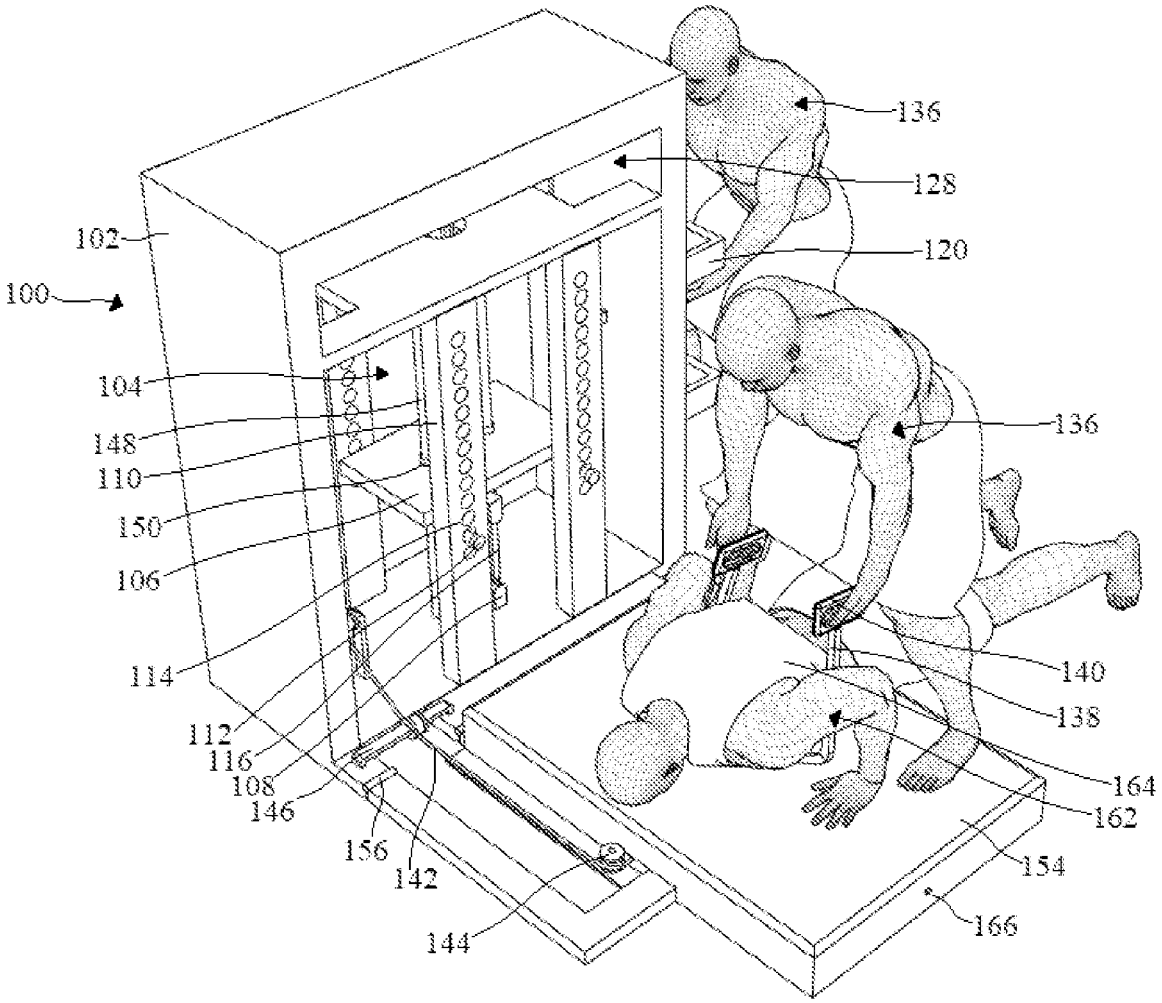
FIGS. 9A to 9F show a method of performing a negative full range of motion repetition only with interaction between user and resistance band exercise machine in accordance with another embodiment.
Figure 9B:
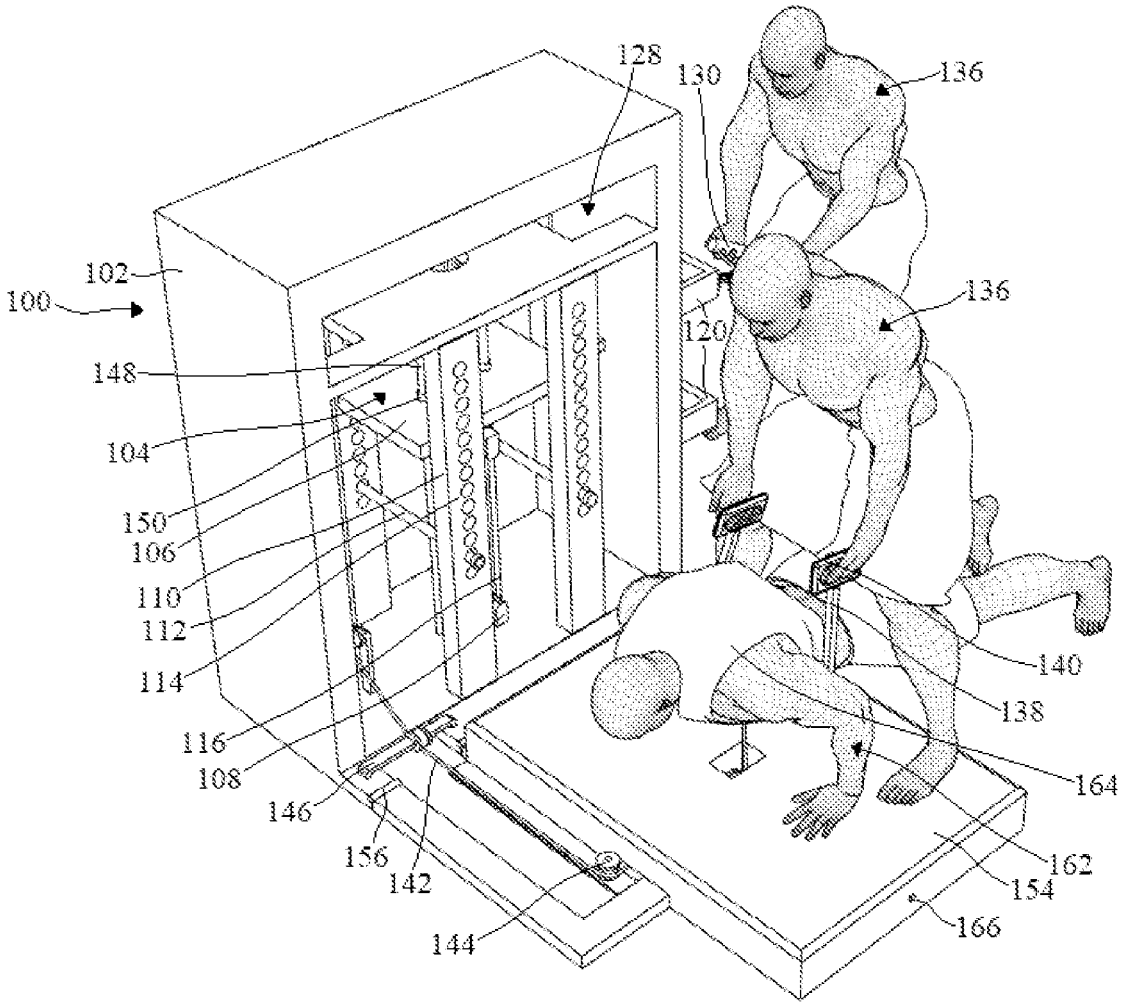
Figure 9C:
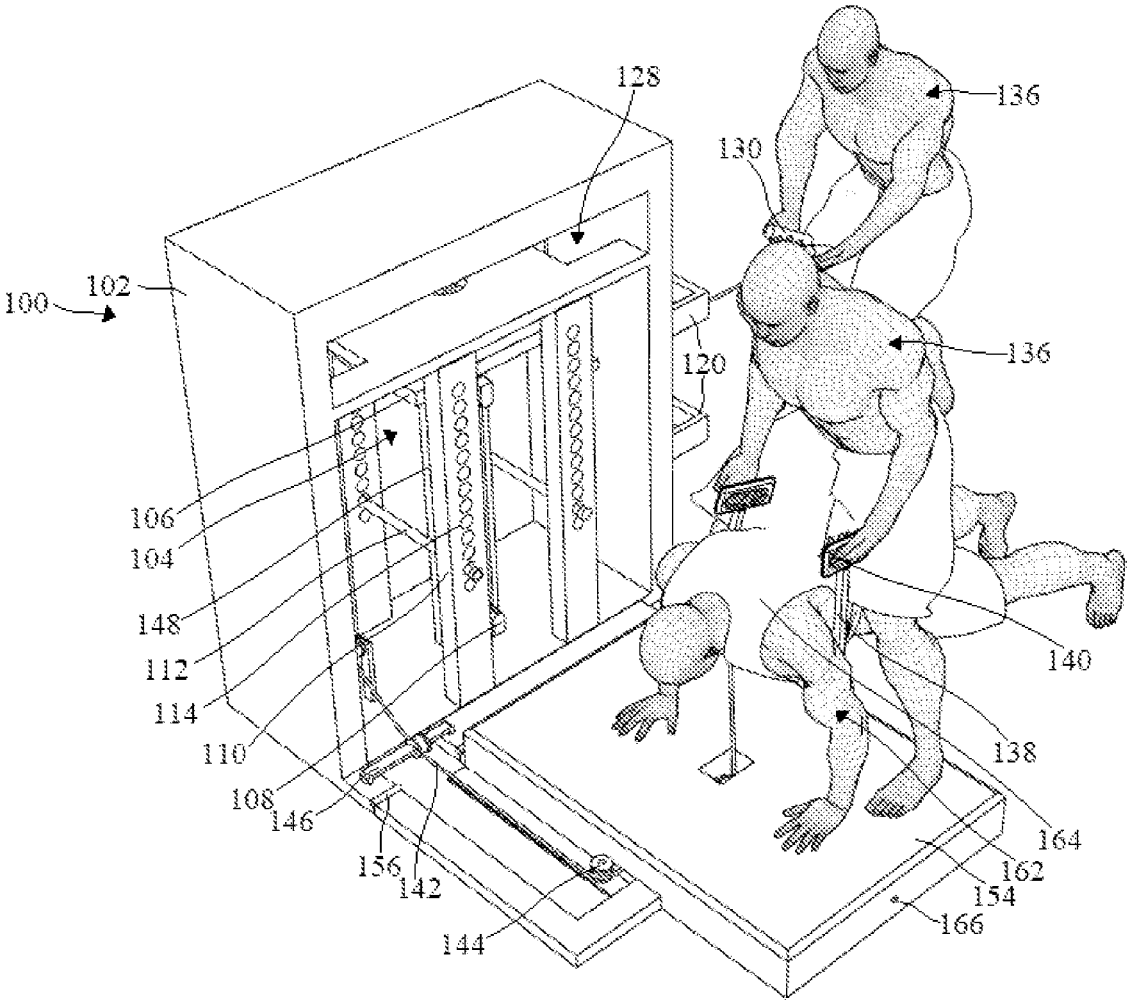
Figure 9D:
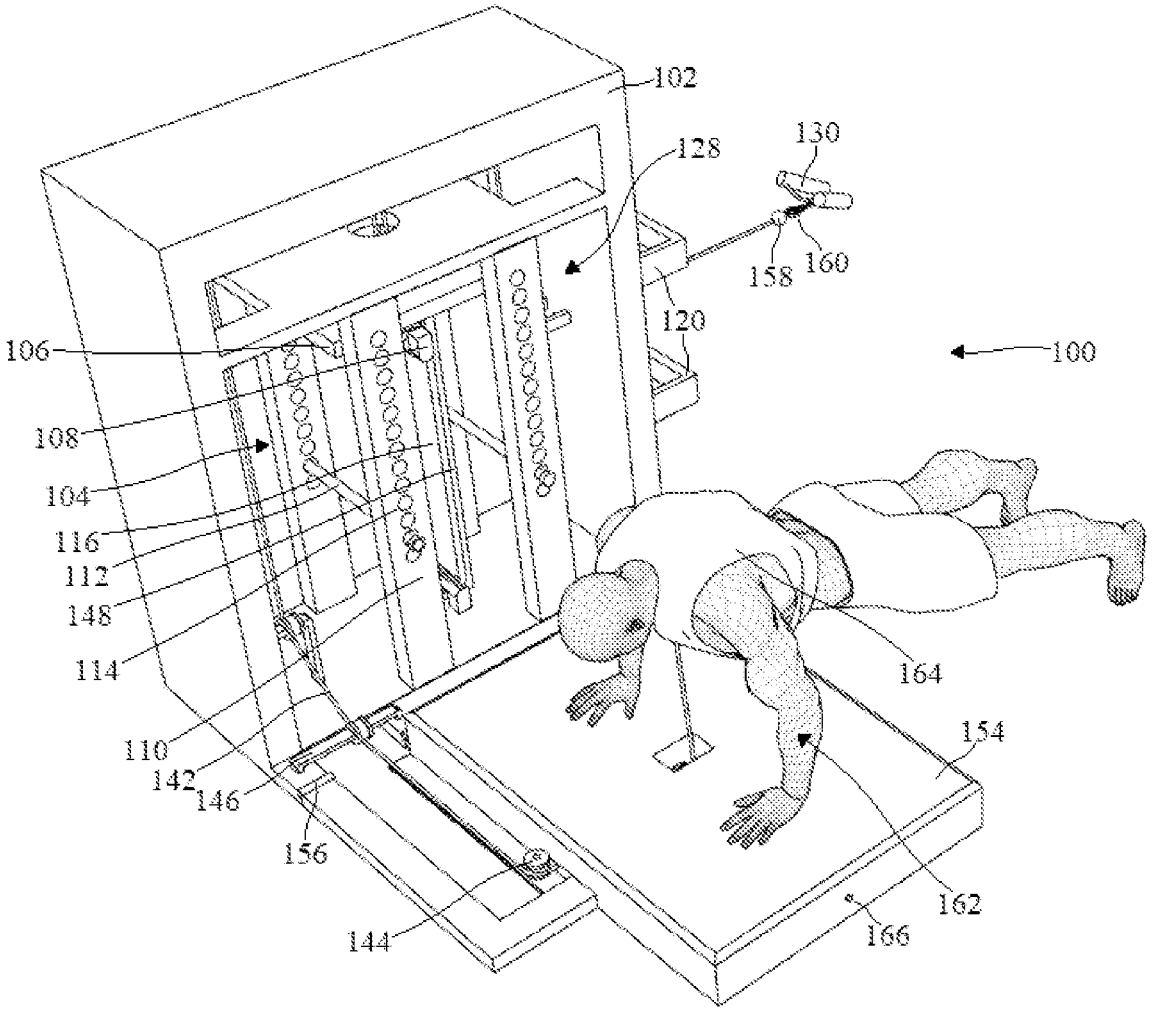
Figure 9E:
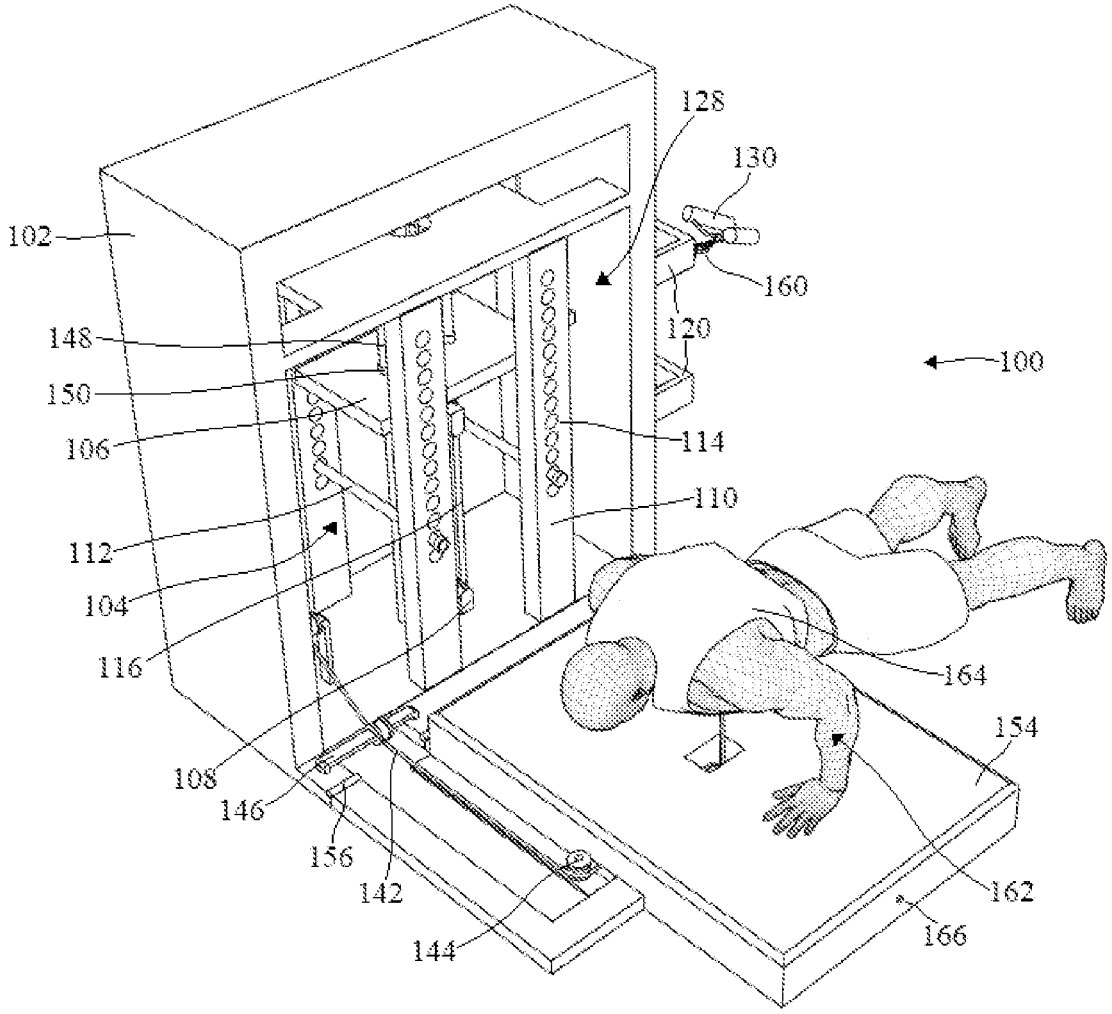
Figure 9F:
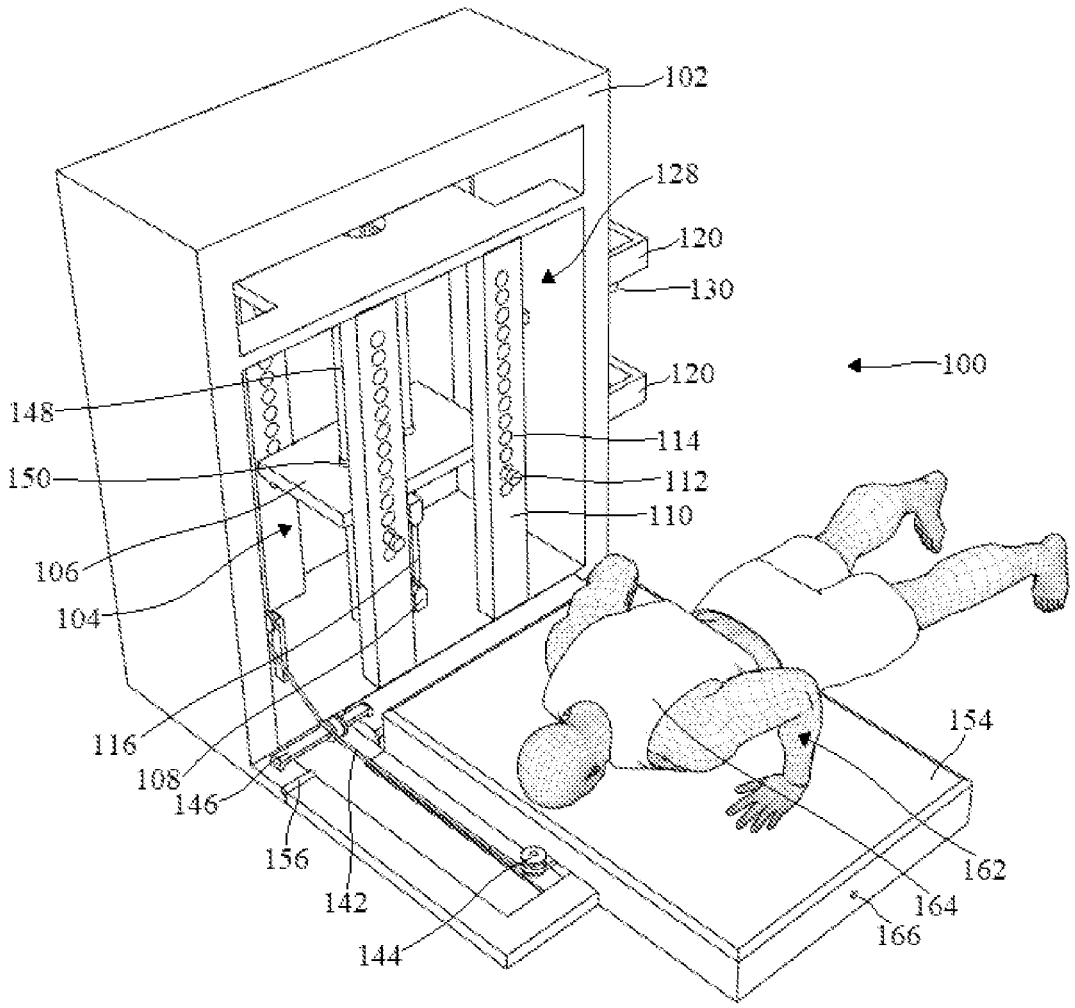

The user can add the springs by placing them on the top plate into the recessed spring pocket to perform the exercise through a full range of motion from start to end position contracting against the resistance band then the springs approaching the end position of the exercise as shown in FIGS. 7A-7C.

The user can perform full range of motion negative repetitions (lowering phase of an exercise; eccentric muscle contraction) only using training partners. One training partner lifts the user using a strap 138 with a strap handle grip 140 in this particular exercise because it's a bodyweight exercise while the other training partner assists by performing a much more powerful exercise than the exercise the user is going to perform to set the user to the end position of the exercise in order to perform full range of motion negative repetitions only. The powerful exercise the training partner performs in this scenario is deadlifts using an input lifting arm 122 with a handle grip 124 like one performing deadlifts using a trap bar or also known as hex bar as shown in FIGS. 8A-8F. In other non-bodyweight exercises, one training partner assisting by performing a more powerful exercise than the exercise the user will perform will be enough. In the absence of a training partner assistantship feature of having an input lifting arm 122 with a handle grip 124, the training partner may help the user get into the end position of an exercise by any means using exercise machine features for user to perform full range of motion negative repetitions only. Because the resistance band variably increases in resistance from start to end position of an exercise, it is easier to assist the user to get into the end position of an exercise than if fixed amounts of weights were used.

FIGS. 9A-9F, show another way the user can perform full range of motion negative repetitions only using training partners and the training partner assistantship cable-pulley system. In this scenario, the exercise the training partner performs is like pulling a rope as in a tug of war game. The difference between FIGS. 8A-8F and this is the training partner assistantship cable-pulley system. The configuration of the training partner assistantship cable-pulley system may be in any arrangement based on the exercise. With the training partner assistantship cable-pulley system, the direction of force applied by the training partner can be in any direction based on the configuration of the training partner assistantship cable-pulley system. This allows for any exercise to be performed by the training partner based on the configuration of the training partner assistantship cable-pulley system. Whereas in FIGS. 8A-8F, the direction of force applied by the training partner is upwards limiting the number of exercises that can be performed.

Figure 10A:
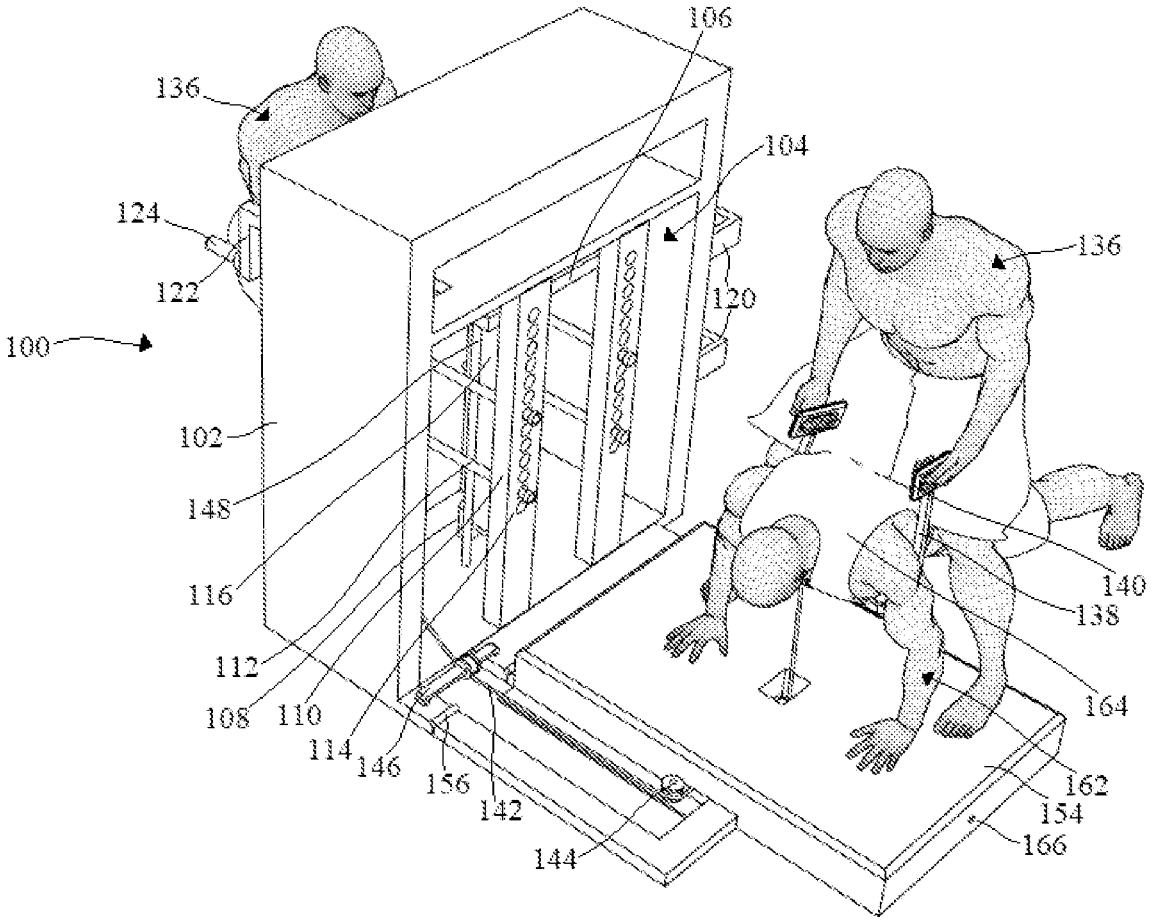
FIGS. 10A to 10C show a method of performing a negative partial range of motion repetition only and method of performing isometrics with interaction between user and resistance band exercise machine in accordance with another embodiment.
Figure 10B:
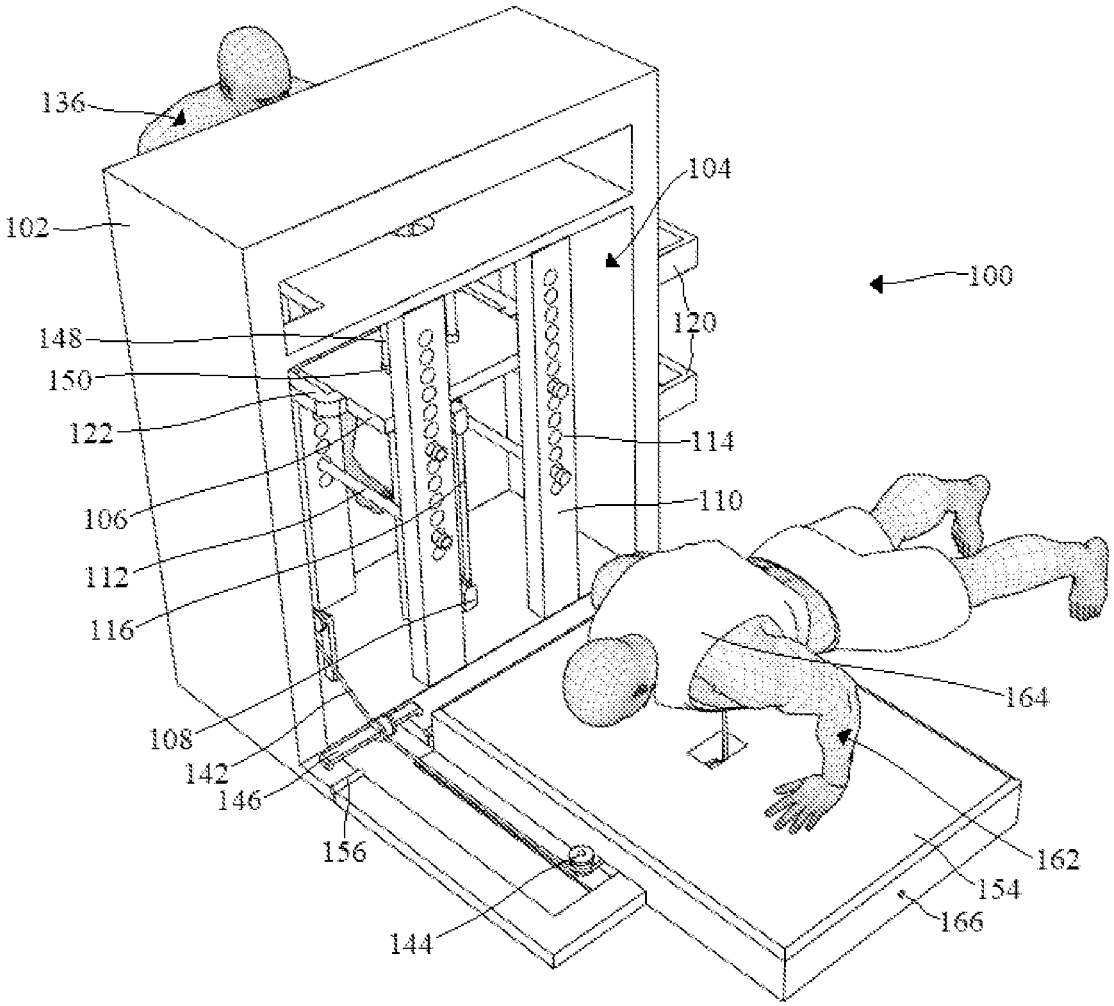
Figure 10C:
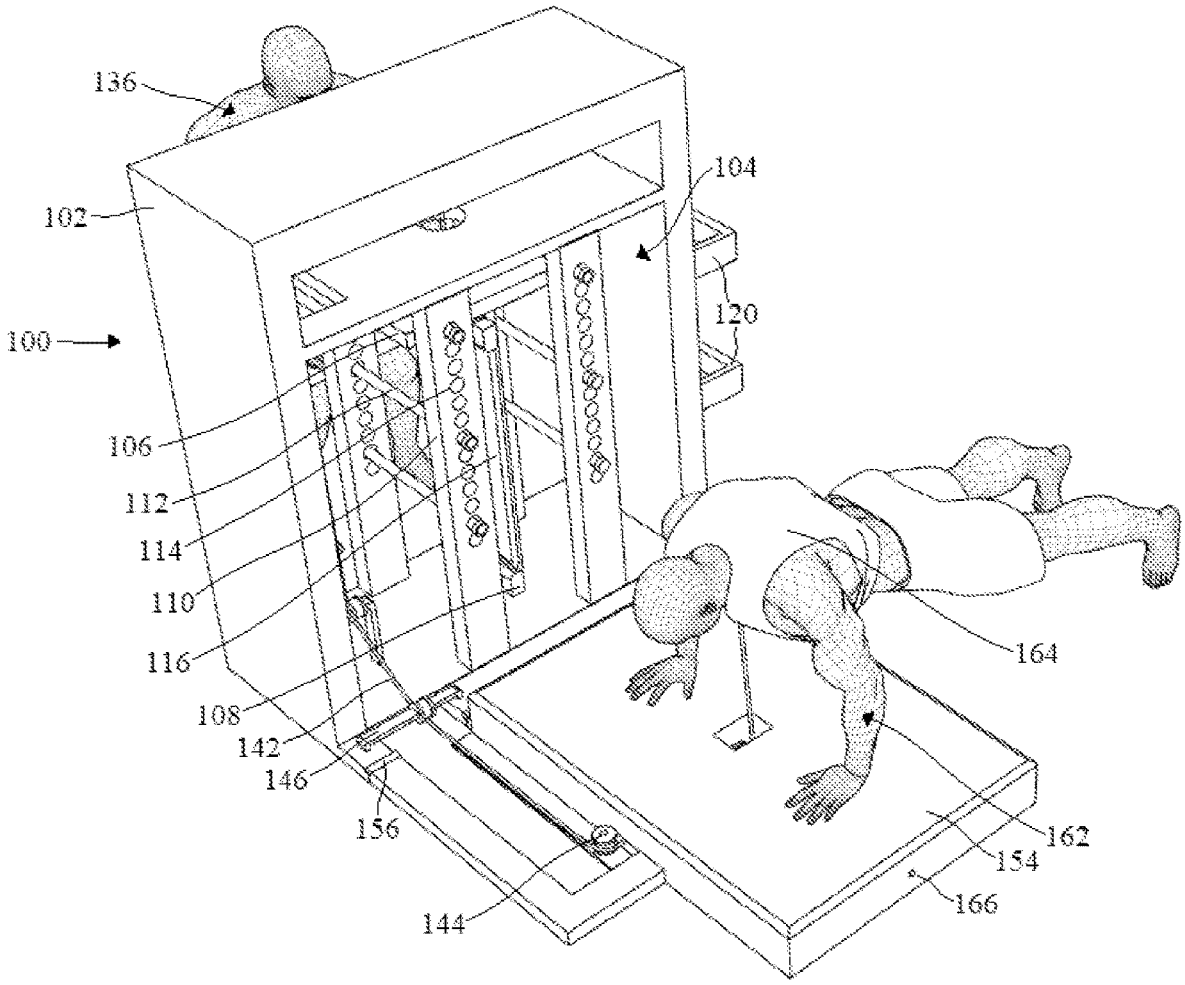

When the user cannot perform another full range of motion negative repetition only as shown in FIGS. 8A-8F, the training partners assist by lifting the user and inserting the safety bars into the safety bar hole so the user can perform negative partial range of motion repetitions as shown in FIGS. 10A and 10B. When the user cannot perform another negative partial range of motion repetition, the user performs isometrics against the safety bars as shown in FIG. 10C. The user may begin the exercise performing partial range of motion repetitions and end the exercise performing isometrics against the safety bars by having the training partners assist by lifting the user and inserting the safety bars into the safety bar hole as shown in FIGS. 10A-10C.

Figure 11A:
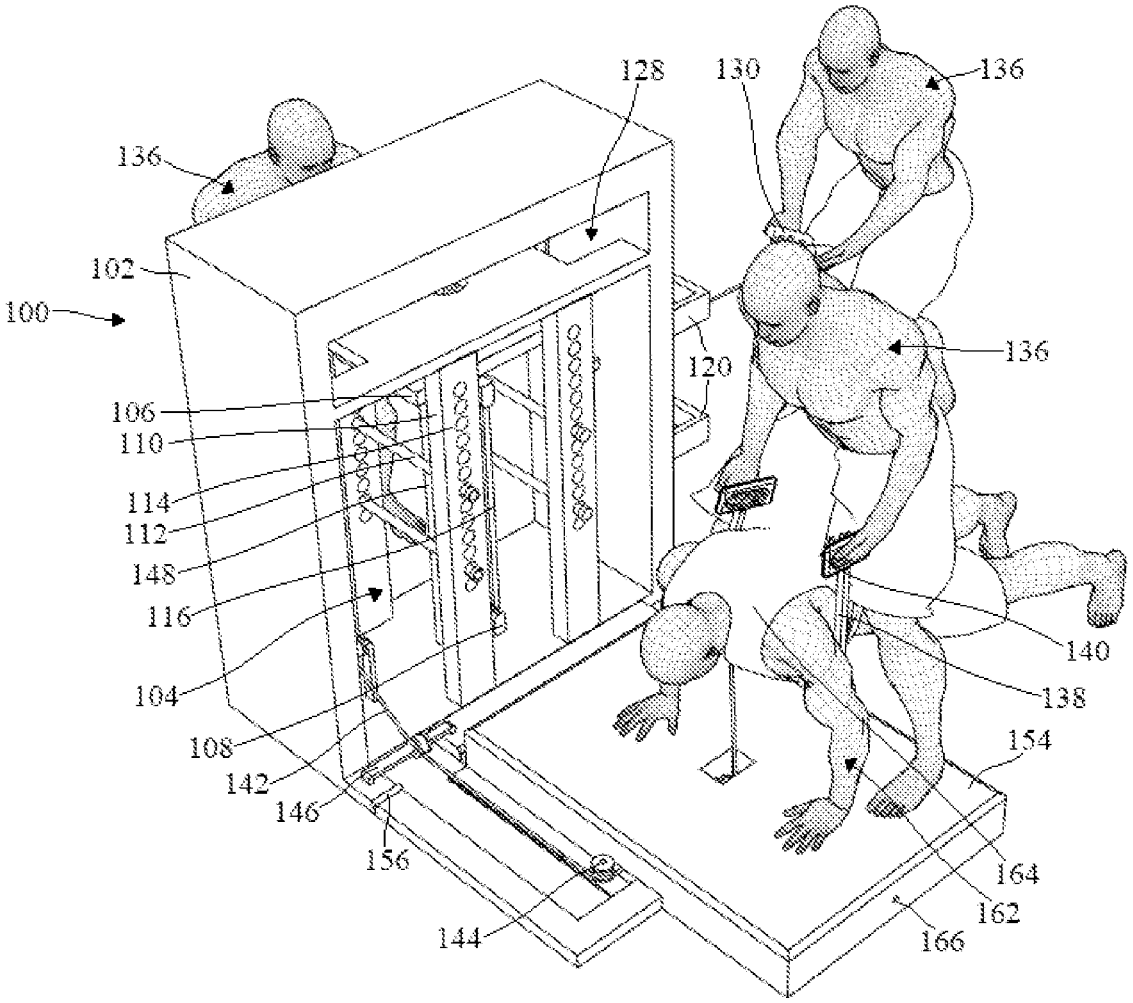
FIGS. 11A to 11D show a method of performing a negative partial range of motion repetition only and method of performing isometrics with interaction between user and resistance band exercise machine in accordance with another embodiment.
Figure 11B:
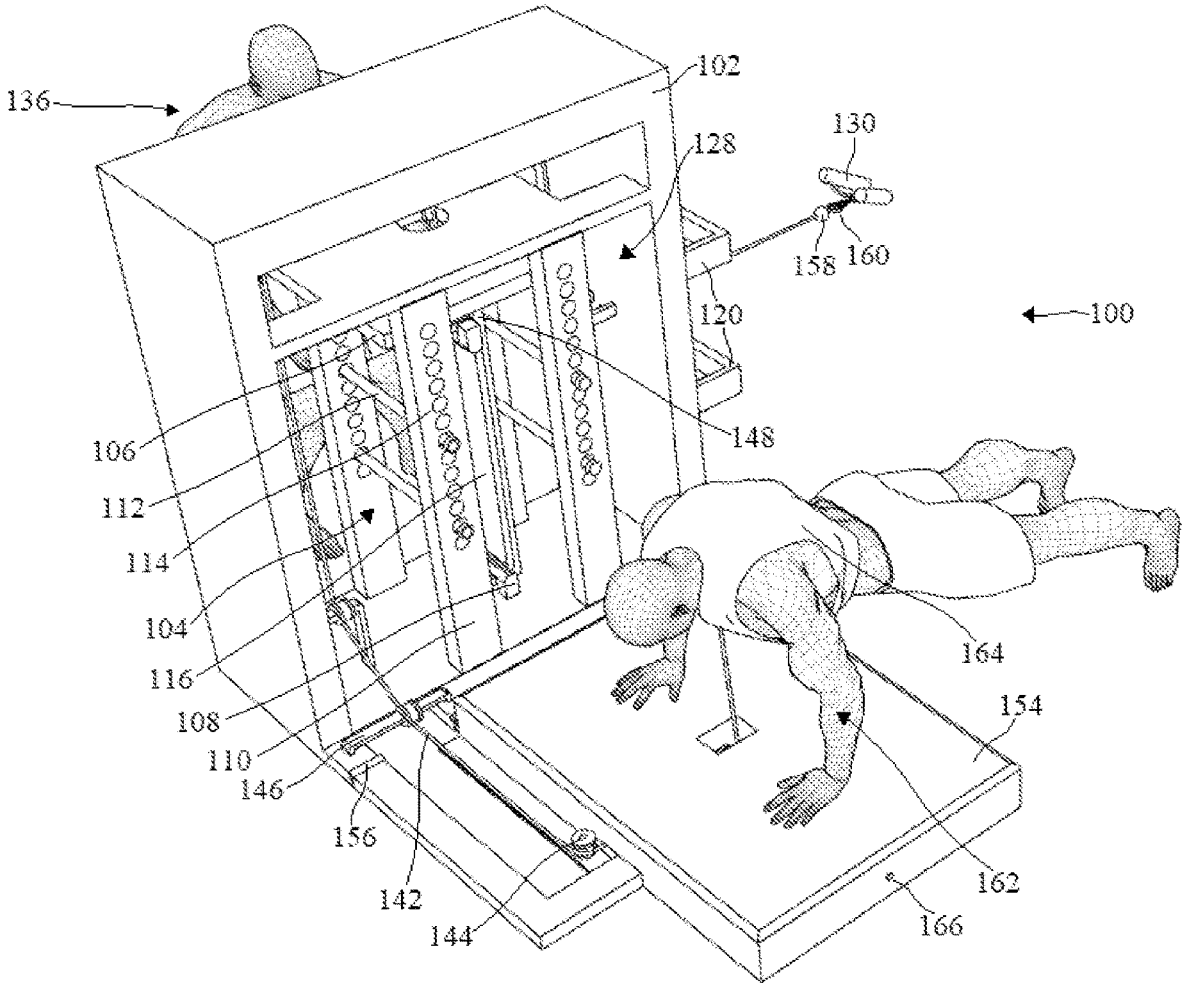
Figure 11C:
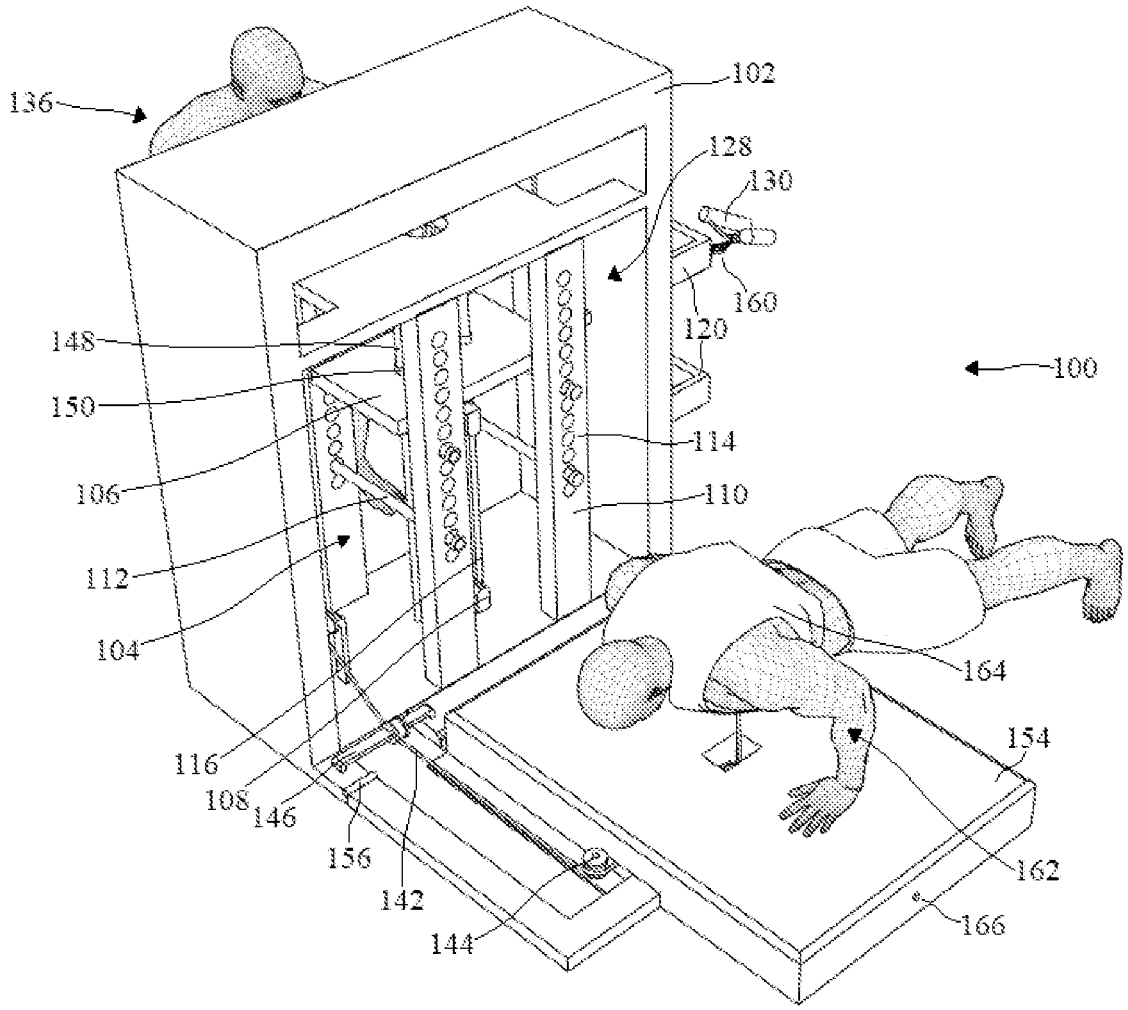
Figure 11D:
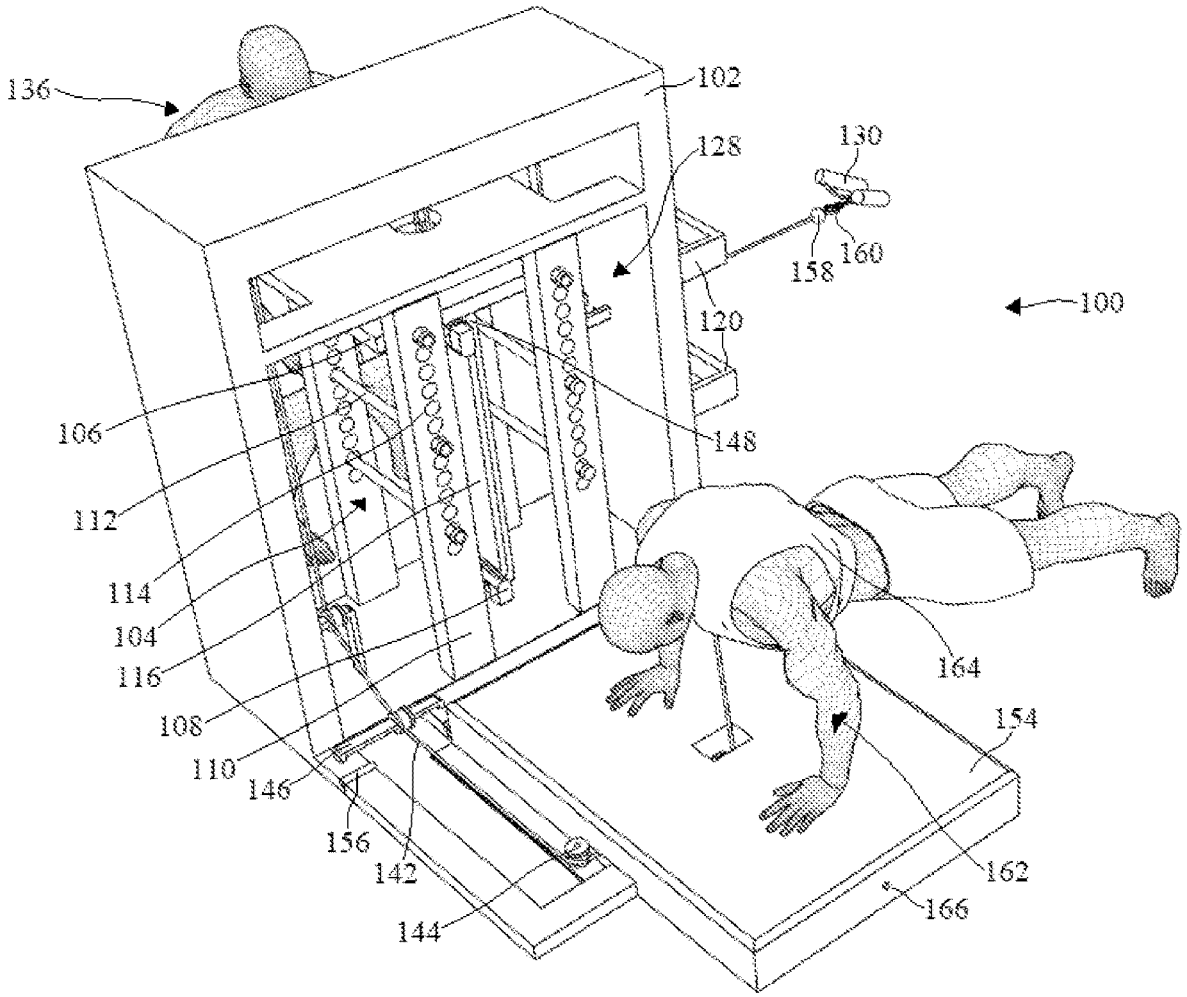

When the user cannot perform another full range of motion negative repetition only as shown in FIG. 9A-9F, the training partners assist by lifting the user and inserting the safety bars into the safety bar hole so the user can perform negative partial range of motion repetitions as shown in FIGS. 11A-11C. When the user cannot perform another negative partial range of motion repetition, the user performs isometrics against the safety bars as shown in FIG. 11D. The user may begin the exercise performing partial range of motion repetitions and end the exercise performing isometrics against the safety bars by having the training partners assist by lifting the user and inserting the safety bars into the safety bar hole as shown in FIGS. 11A-11D.

Figure 12A:
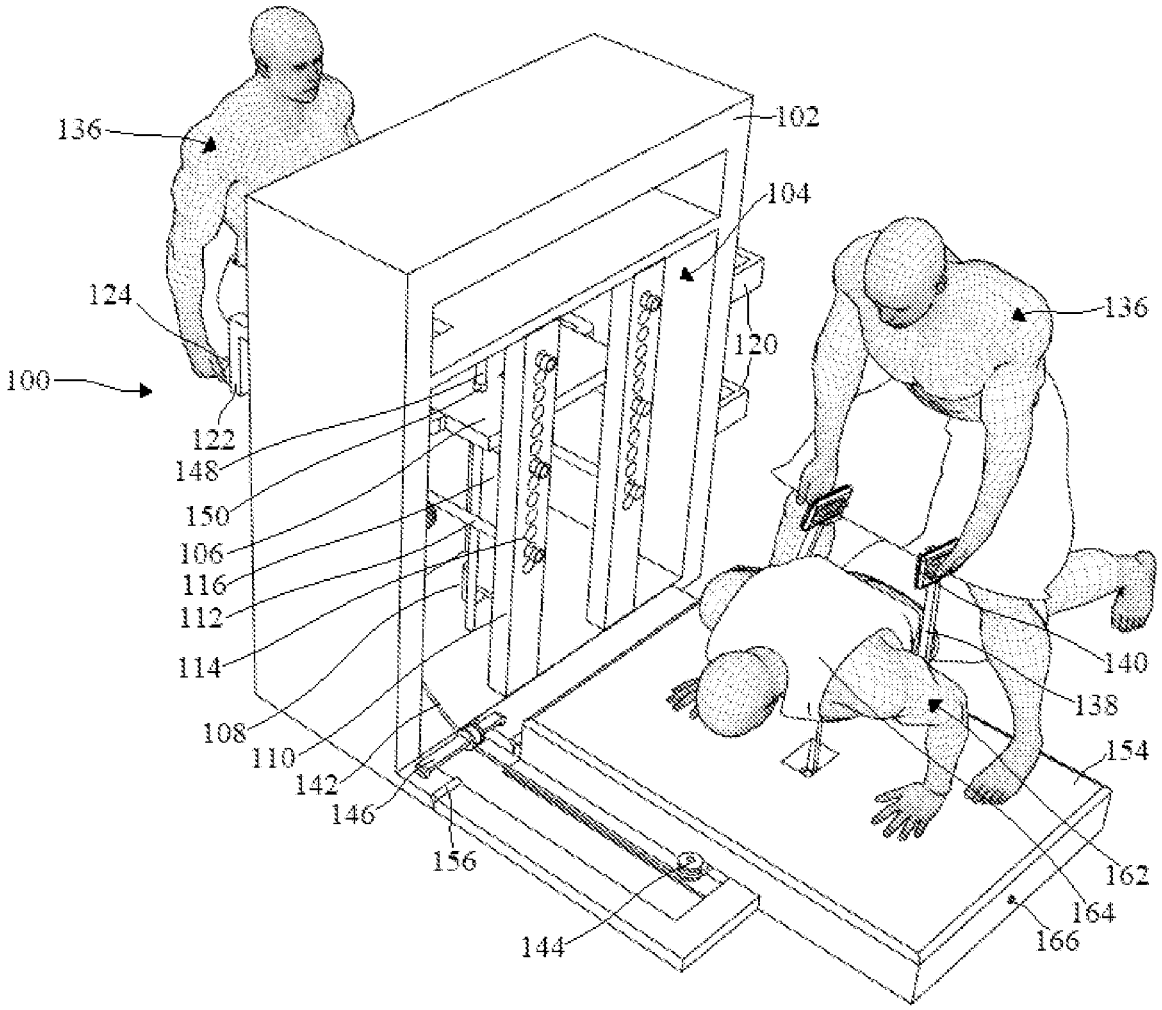
FIGS. 12A to 12C show a method of performing a negative partial range of motion repetition only with interaction between user and resistance band exercise machine in accordance with another embodiment.
Figure 12B:
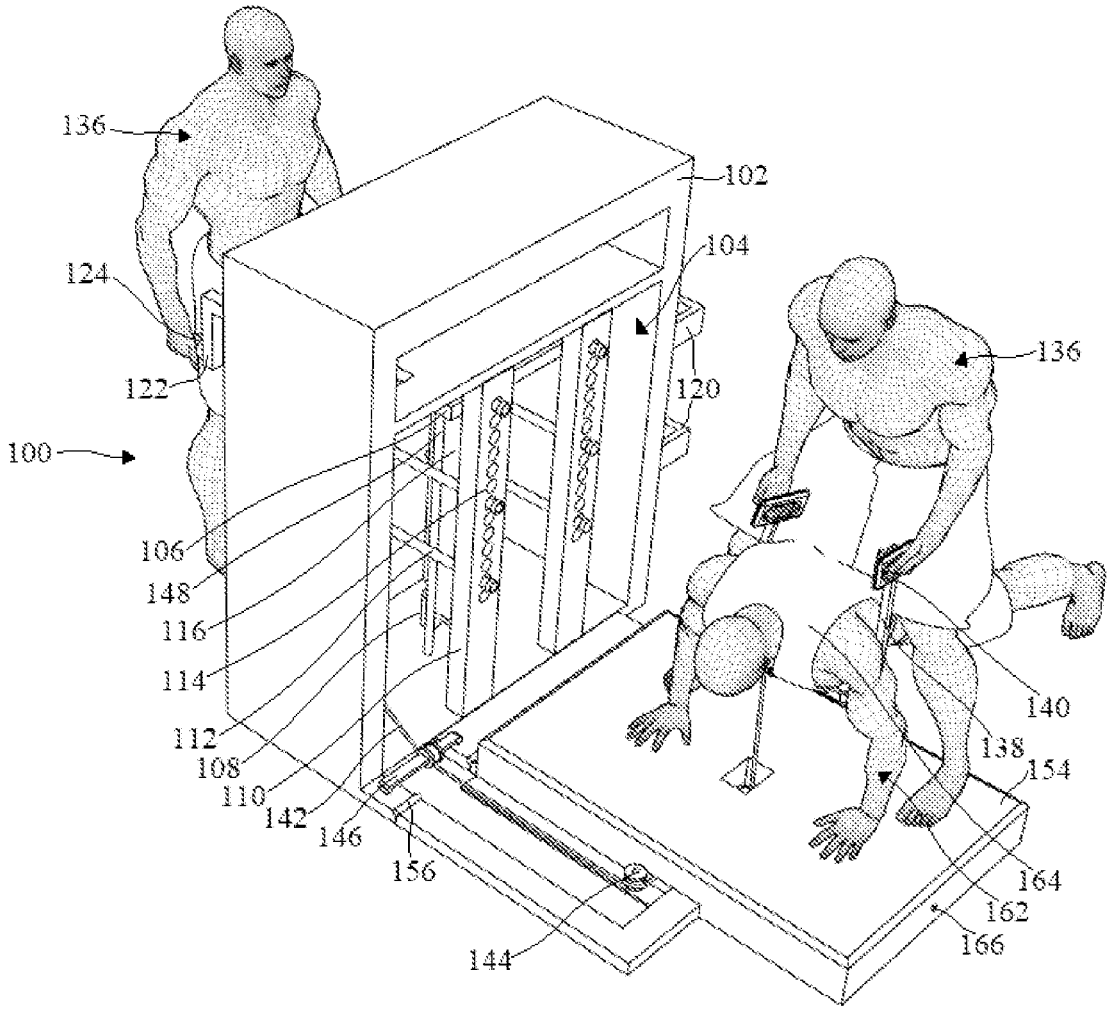
Figure 12C:
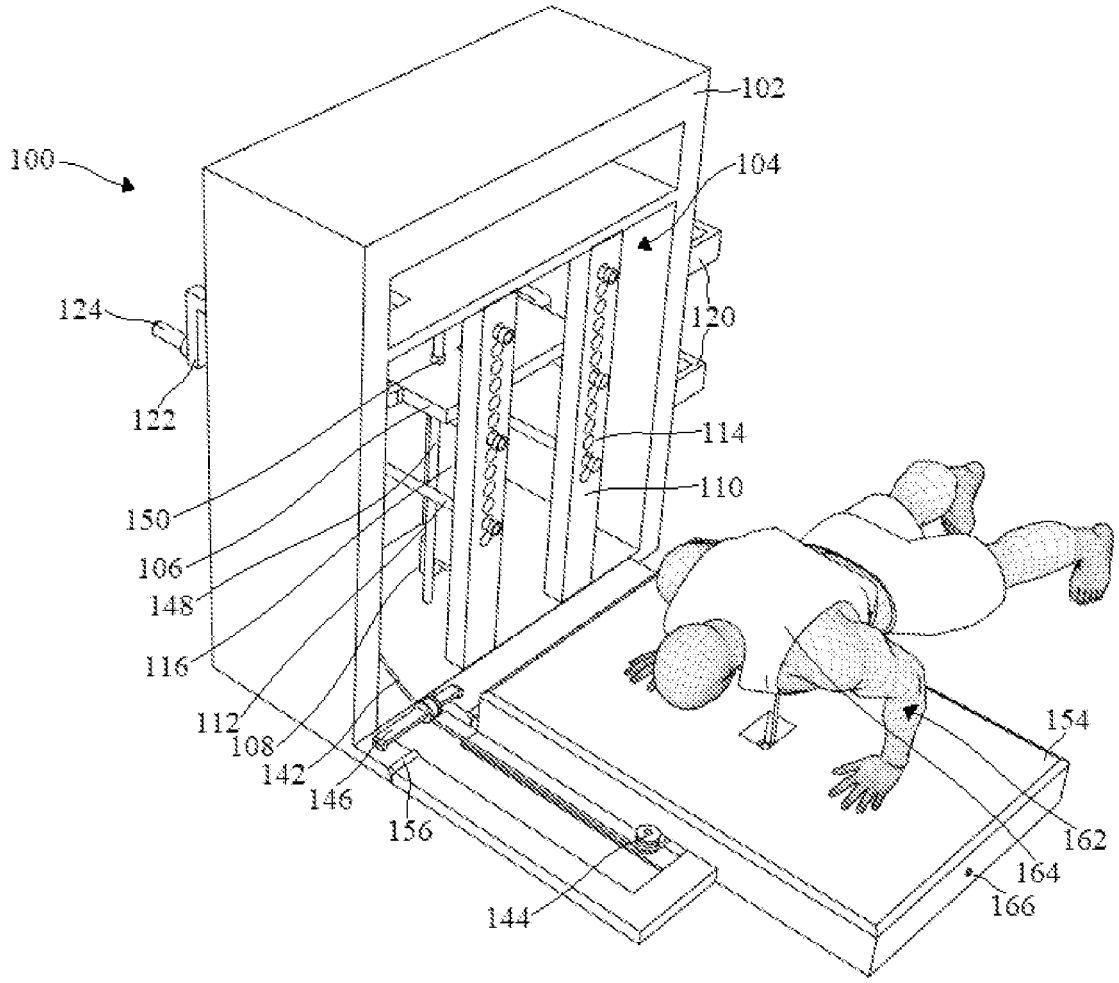

After the user is done performing partial range of motion repetitions and isometrics against the safety bars, the training partners can assist the user to perform negative partial range of motion repetitions as shown in FIGS. 12A-12C.

FIGS. 13A-13F, show the training partner assisting the user to get into the end position of the exercise by performing squats using the input lifting arm and the shoulder padding then inserting the safety bars into the safety bar hole so the user can perform partial range of motion repetitions then end the exercise performing isometrics against the safety bars.

Figure 15A:
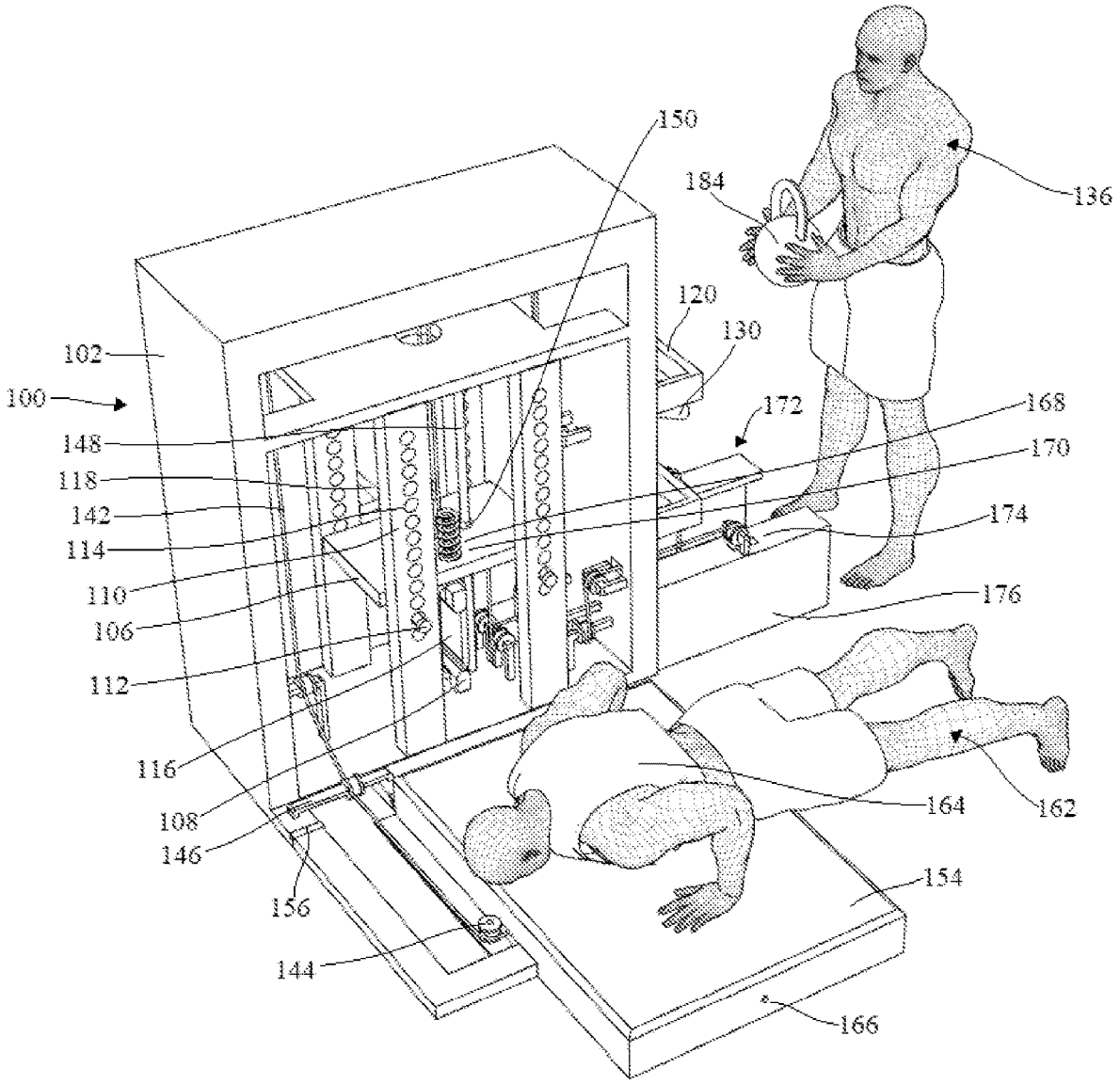
FIGS. 15A to 15N show interaction between user and resistance band exercise machine through a full range of motion exercise in accordance with another embodiment.
Figure 15B:
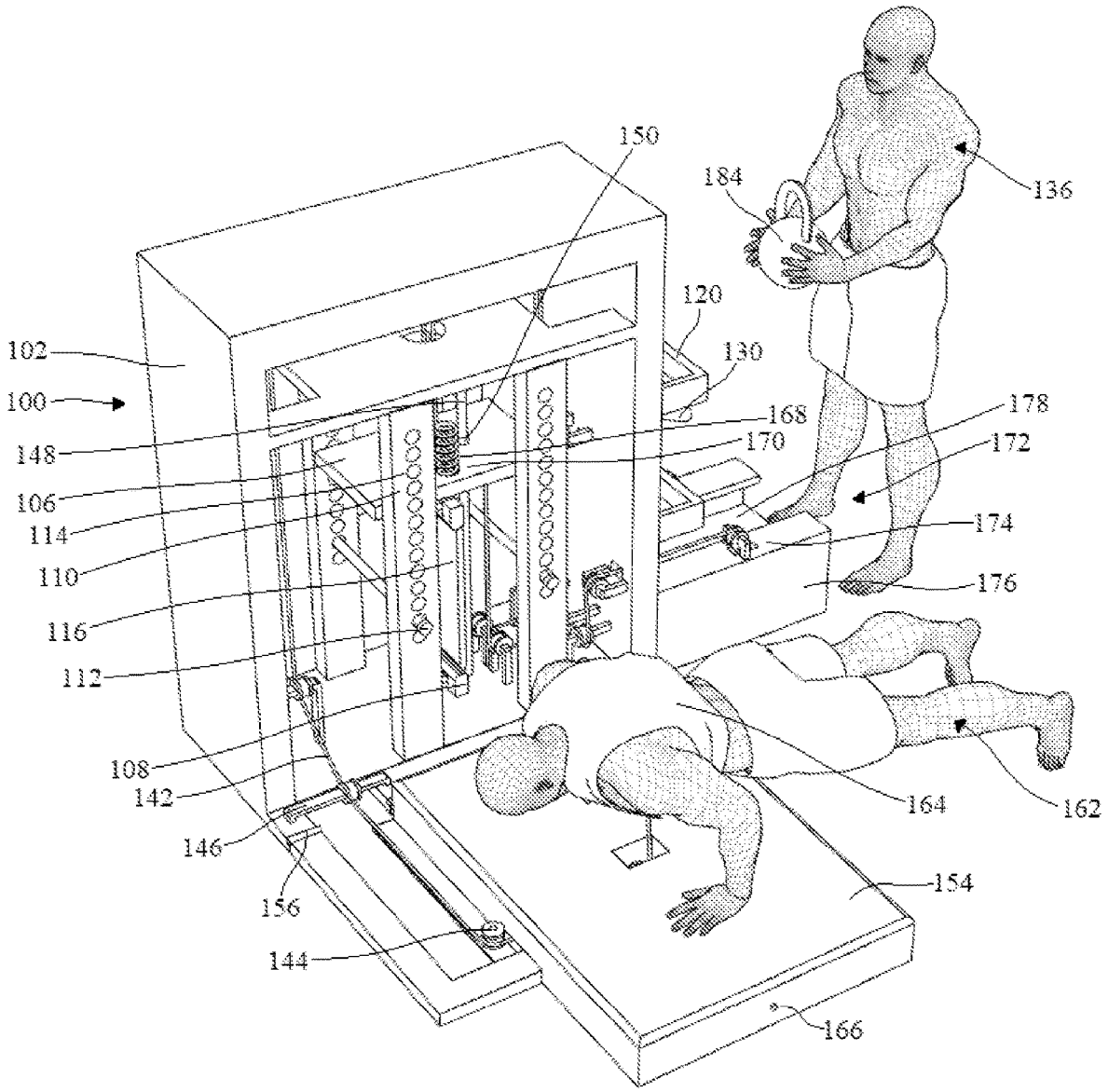
Figure 15C:
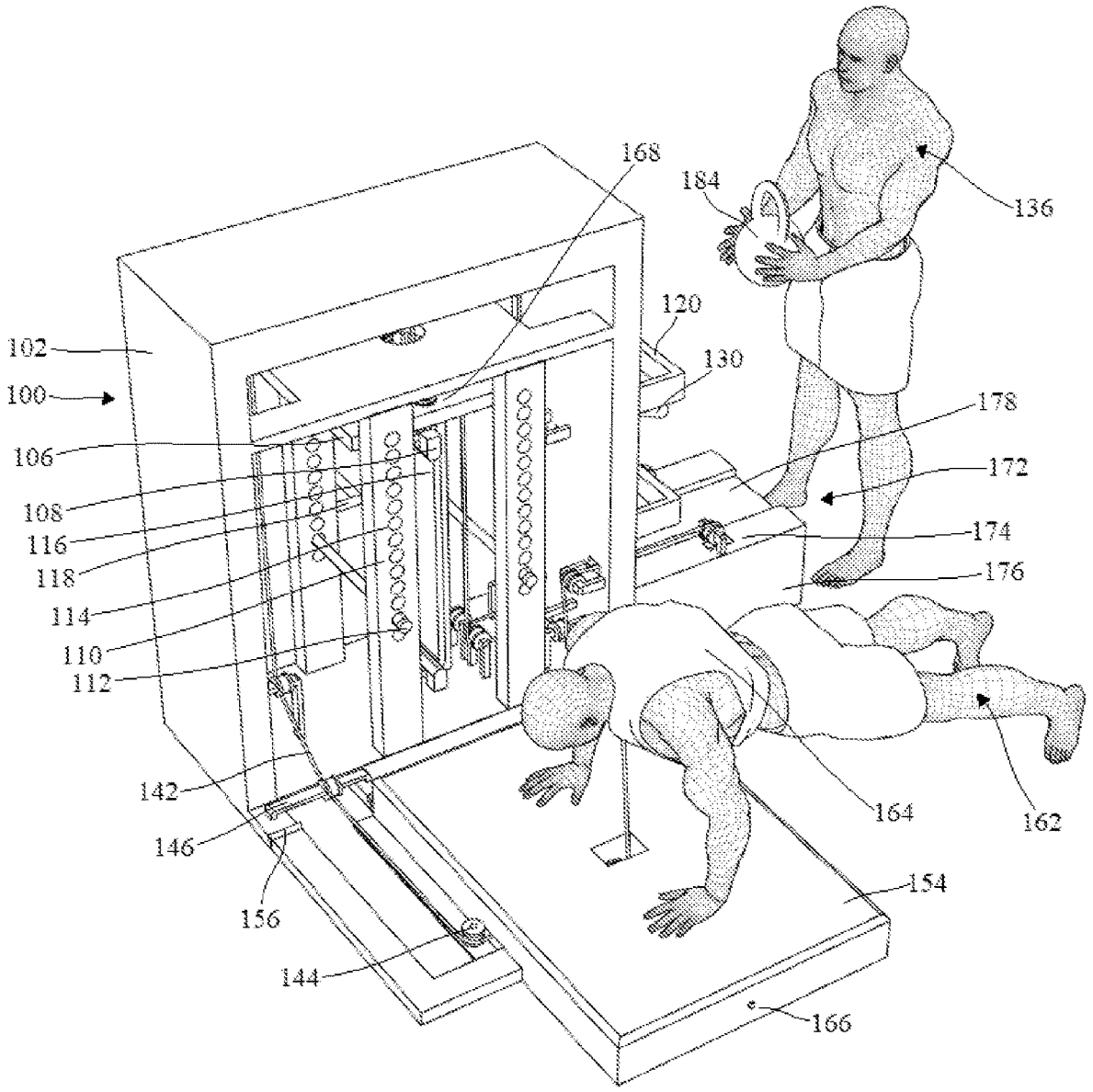
Figure 15D:
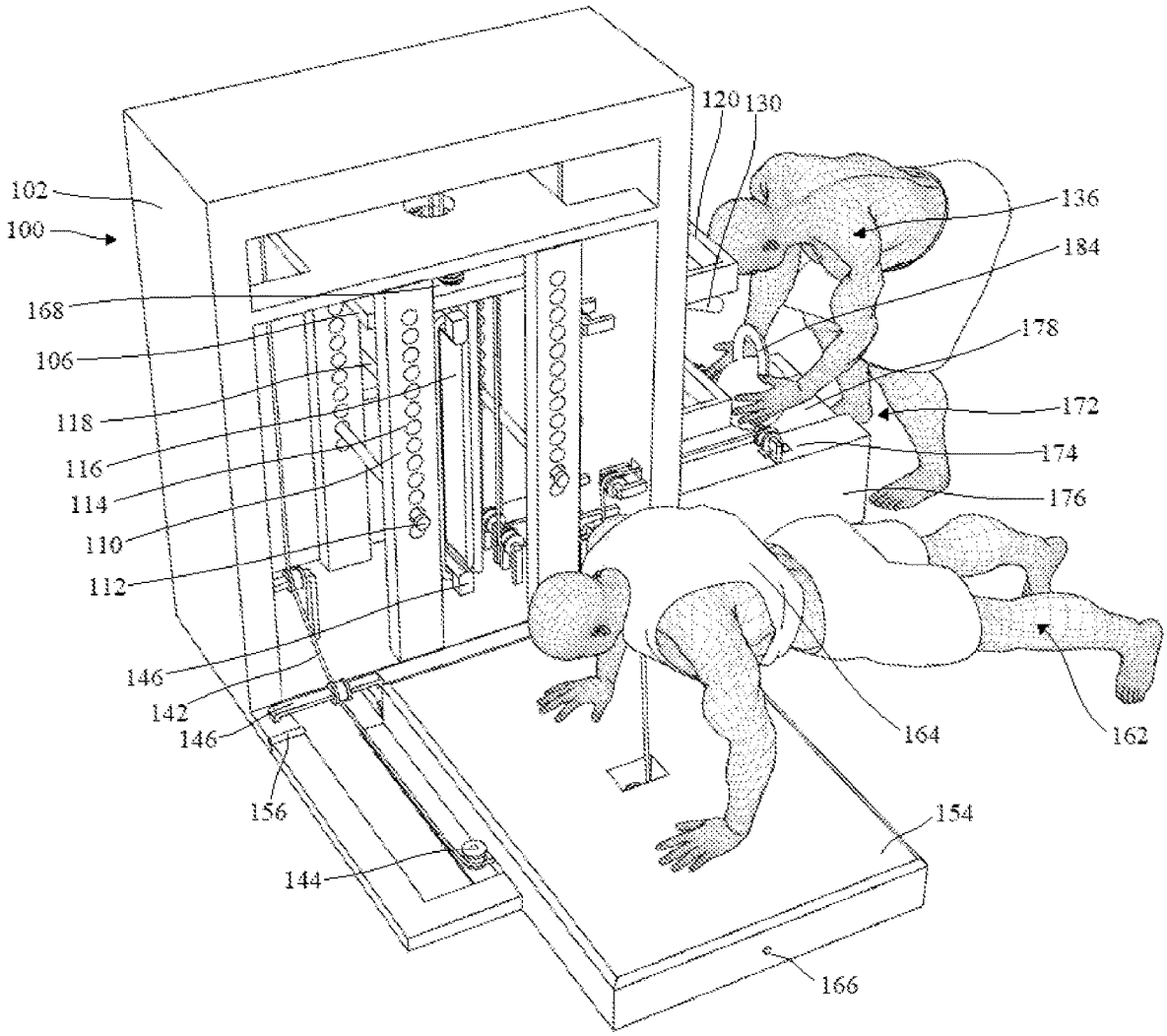
Figure 15E:
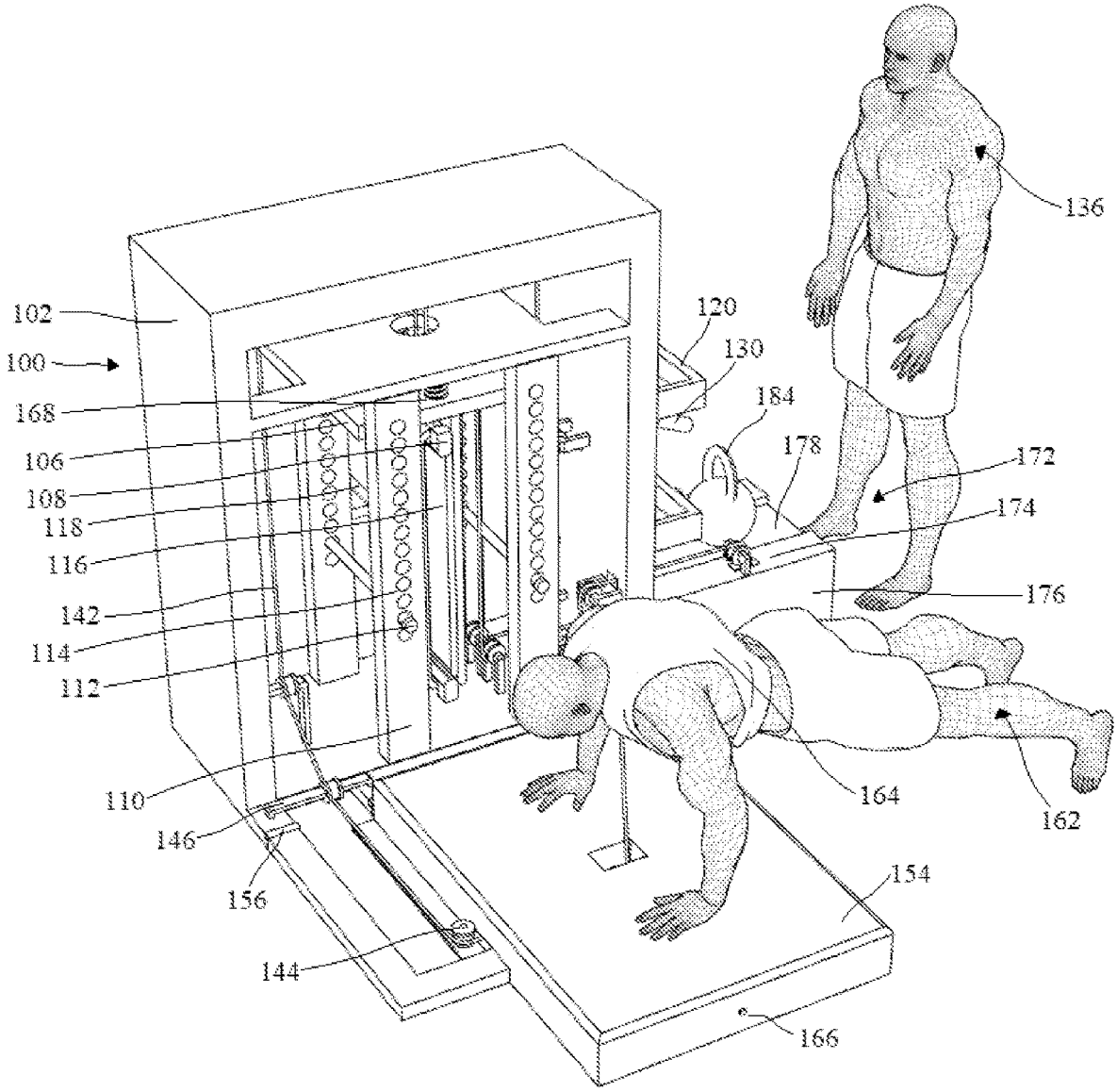
Figure 15F:
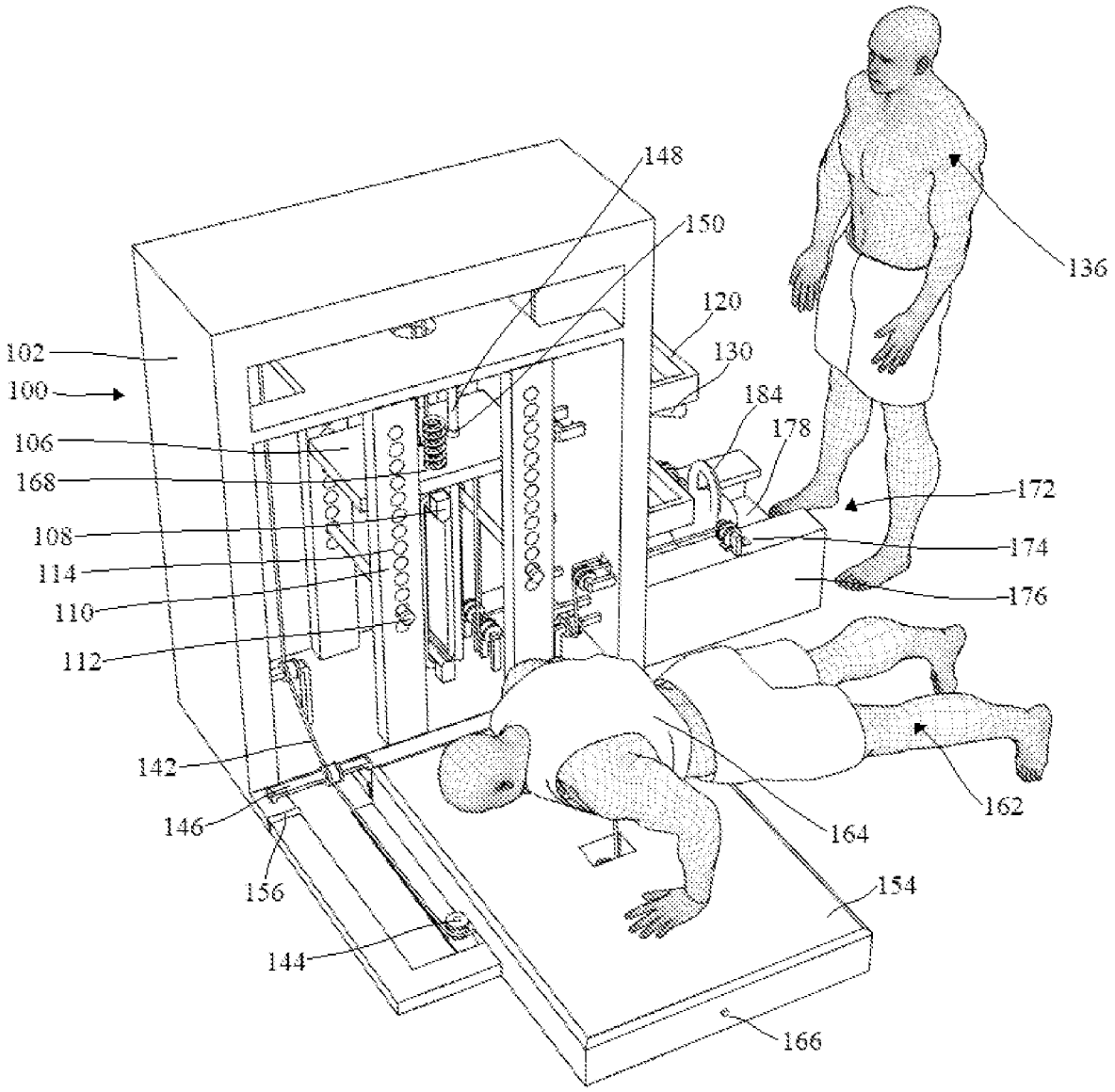
Figure 15G:
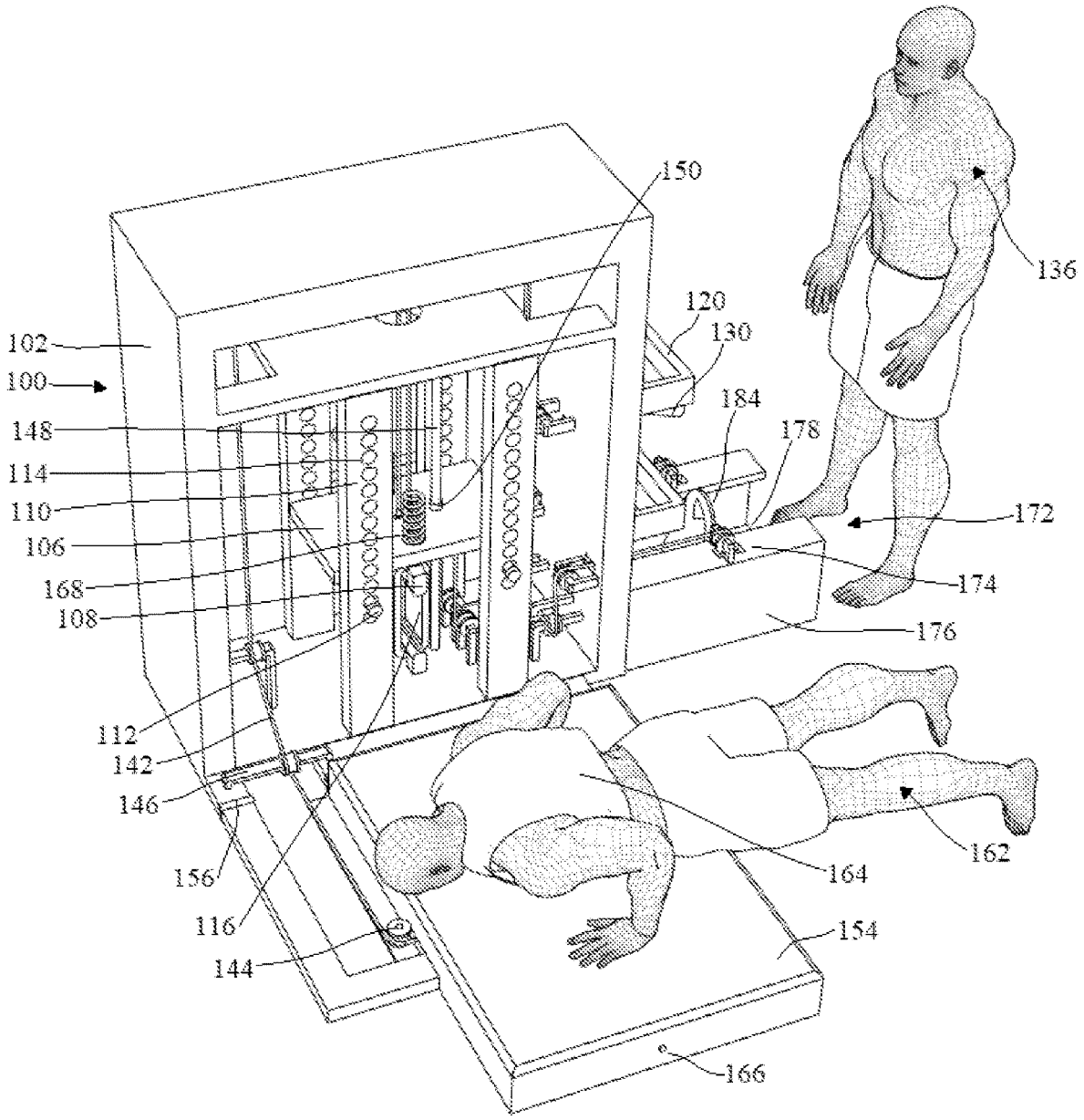
Figure 15H:
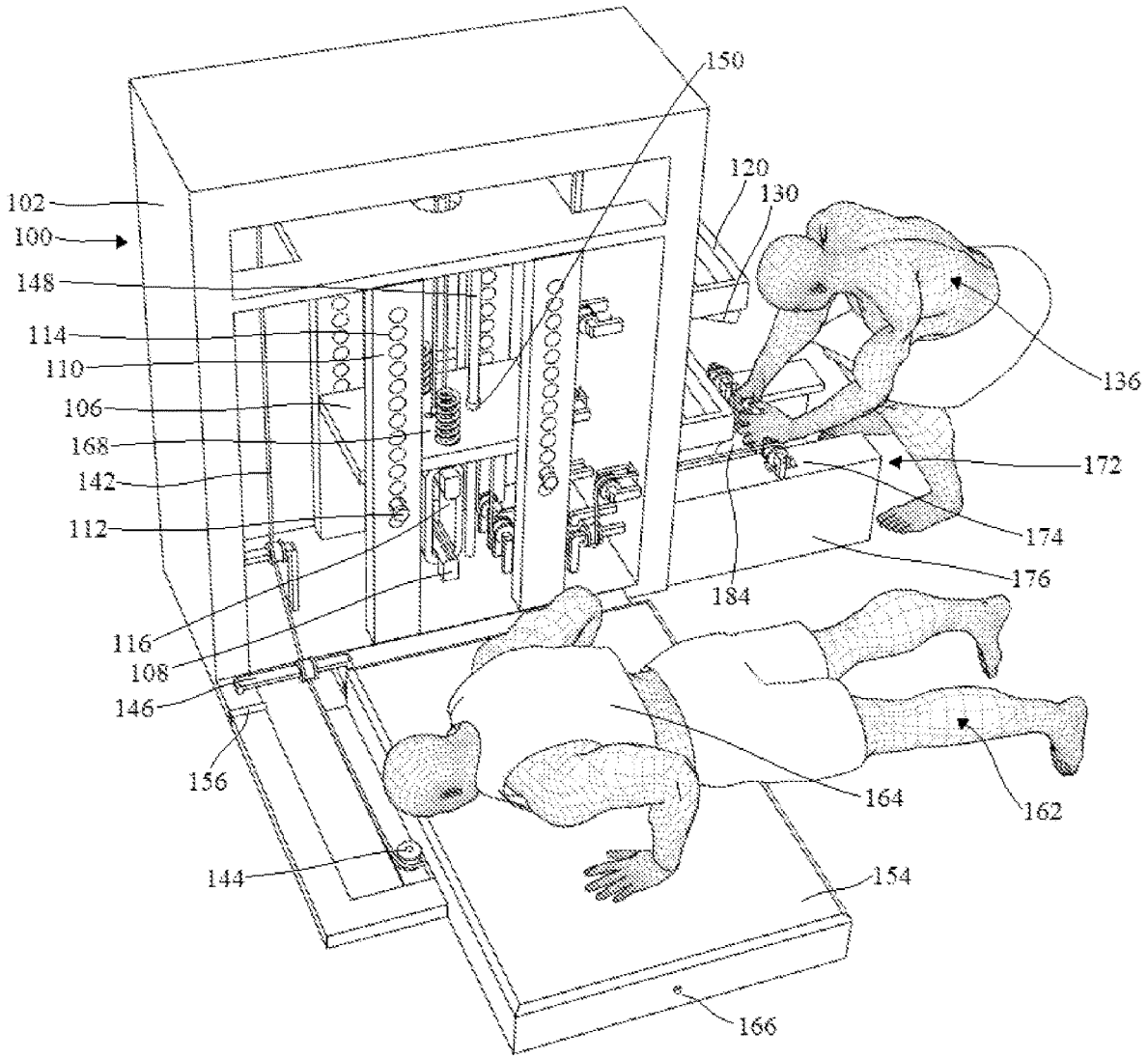
Figure 15I:
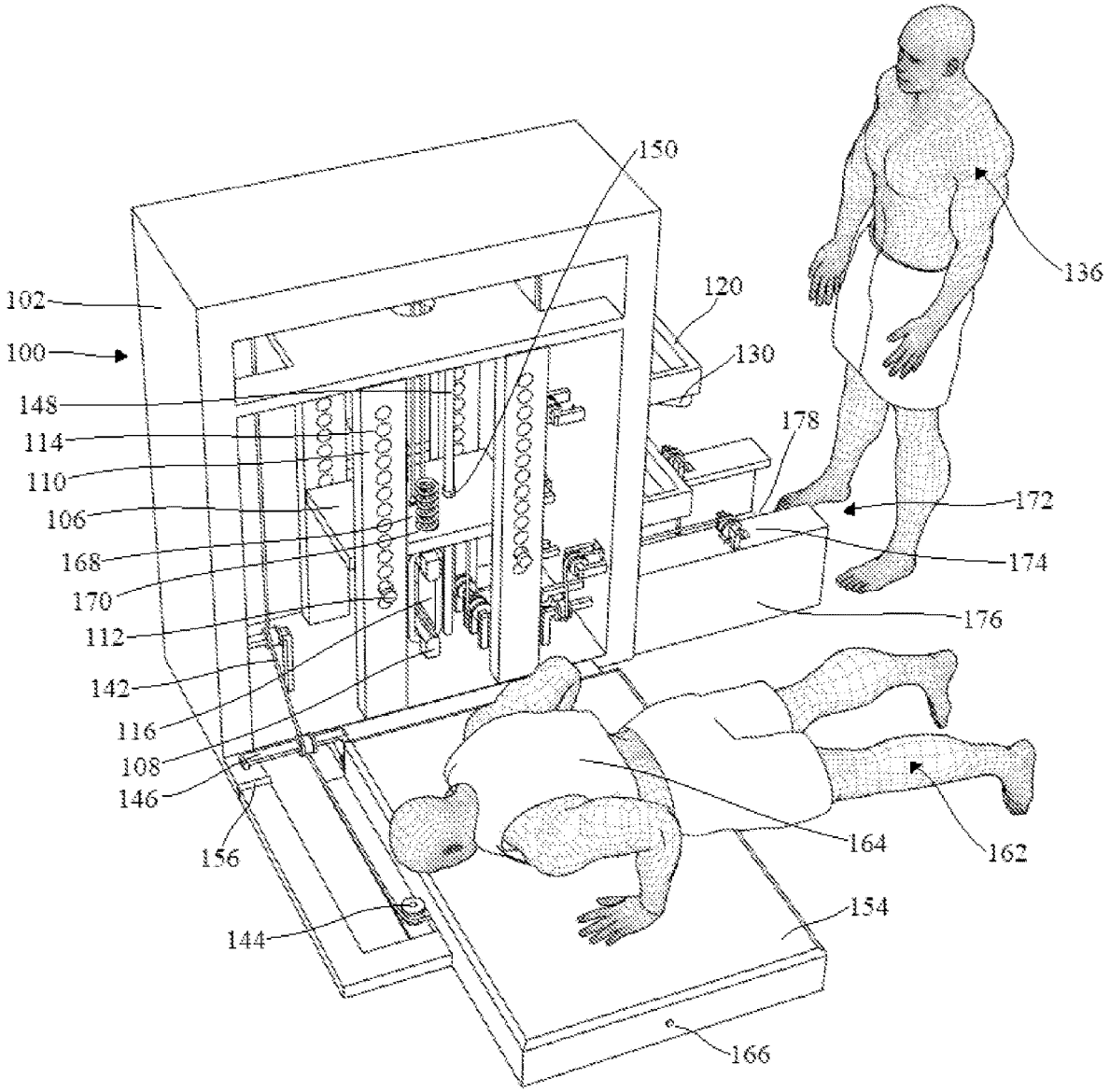
Figure 15J:
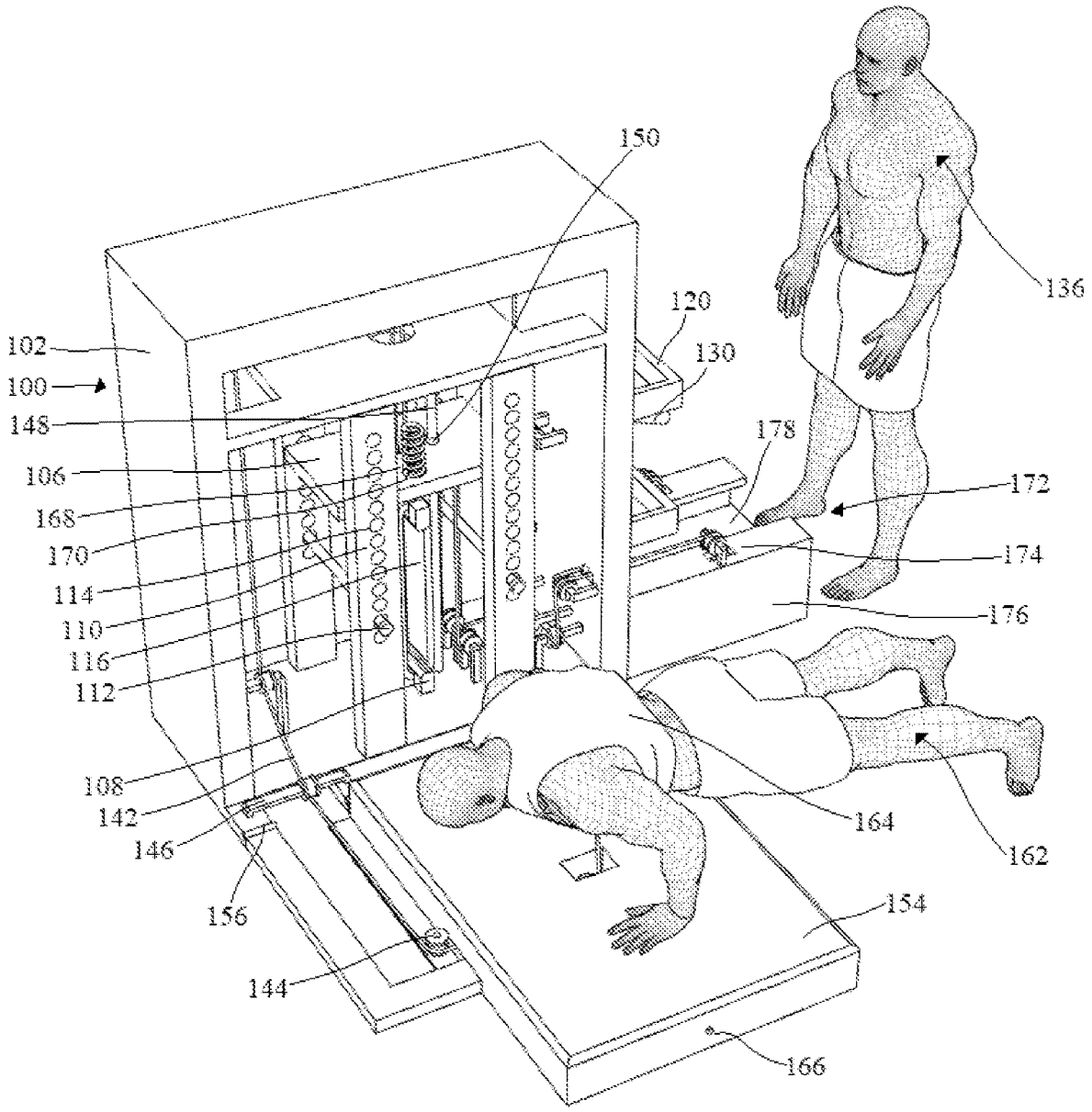
Figure 15K:
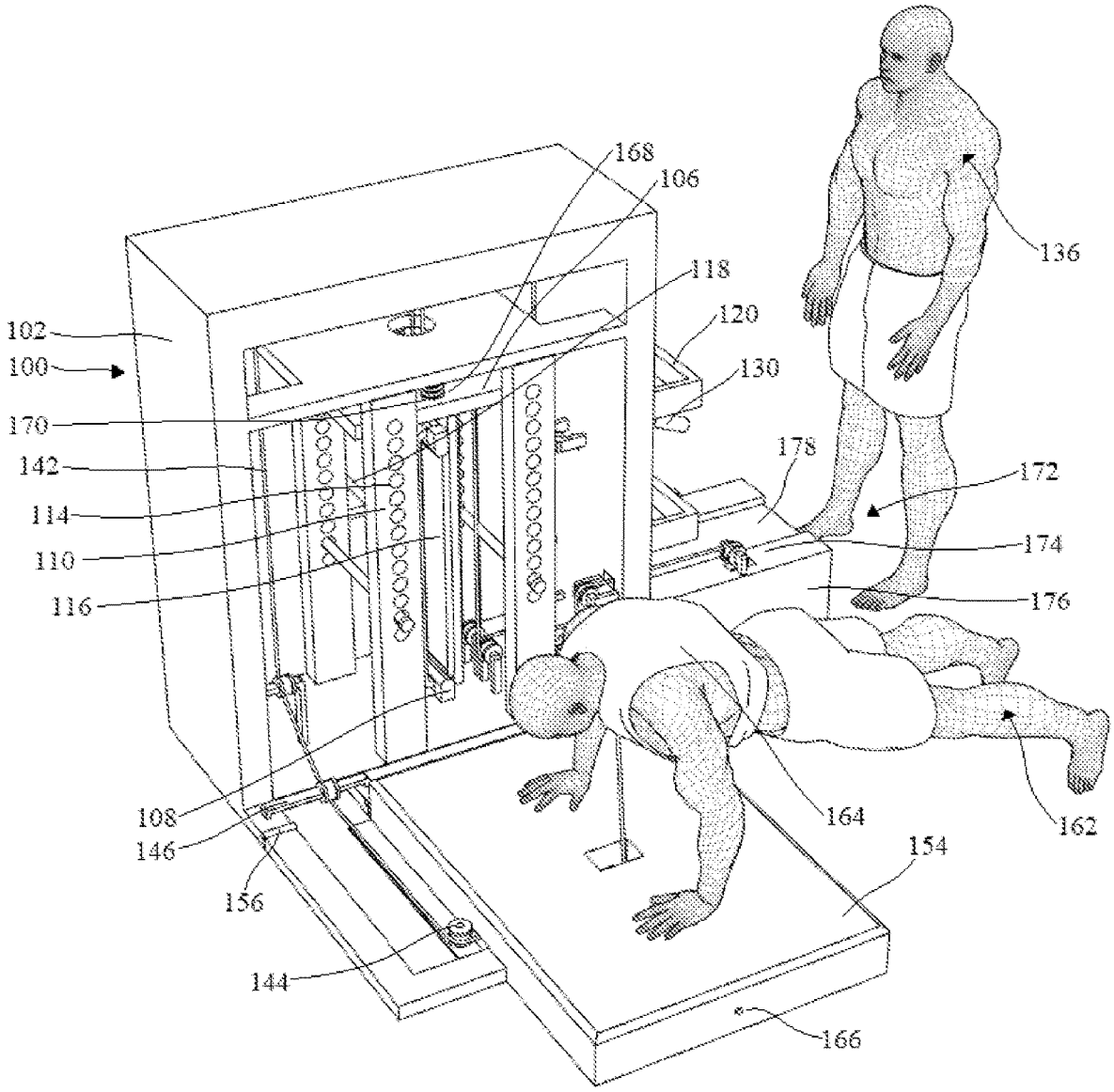
Figure 15L:
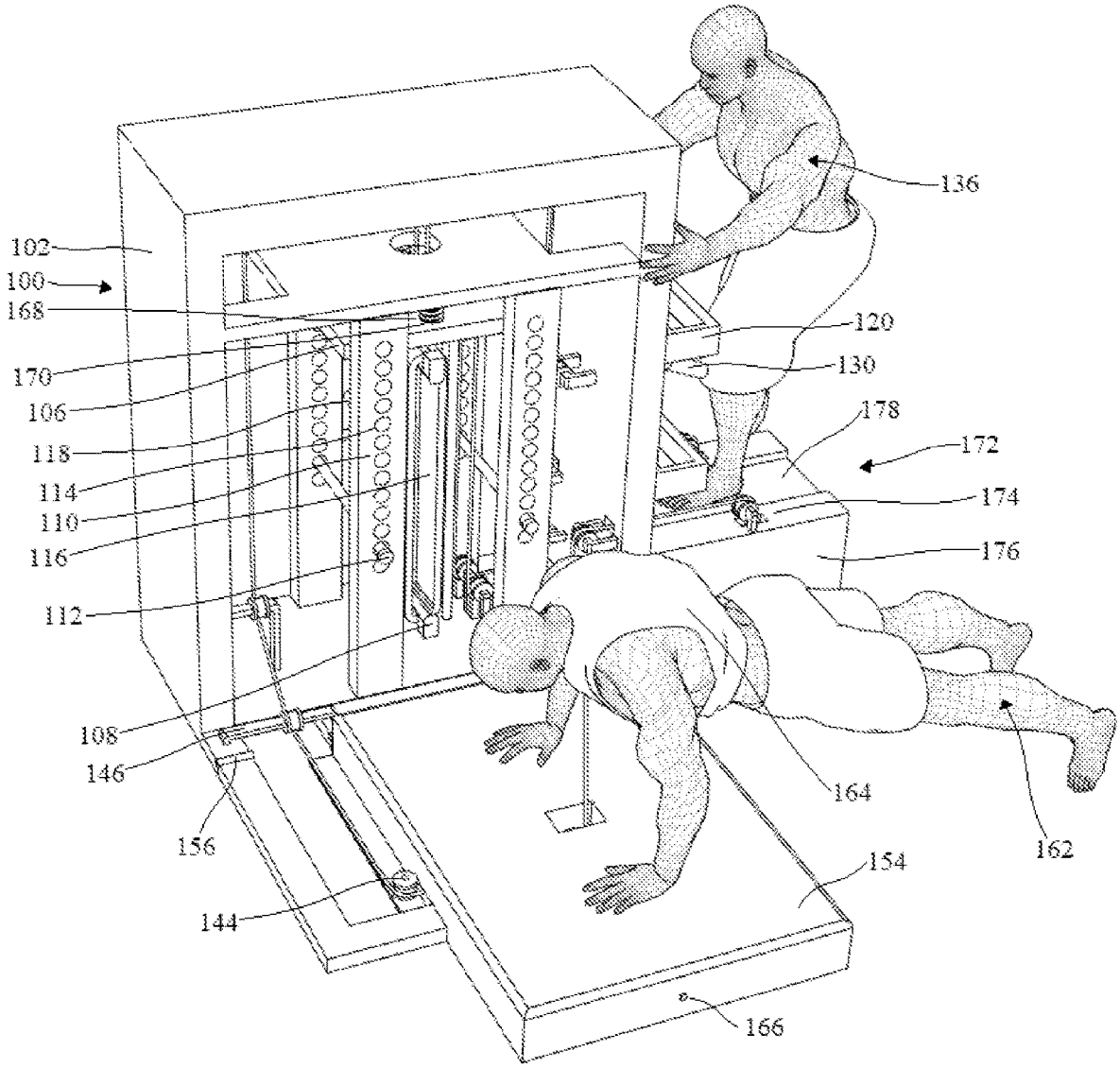
Figure 15M:
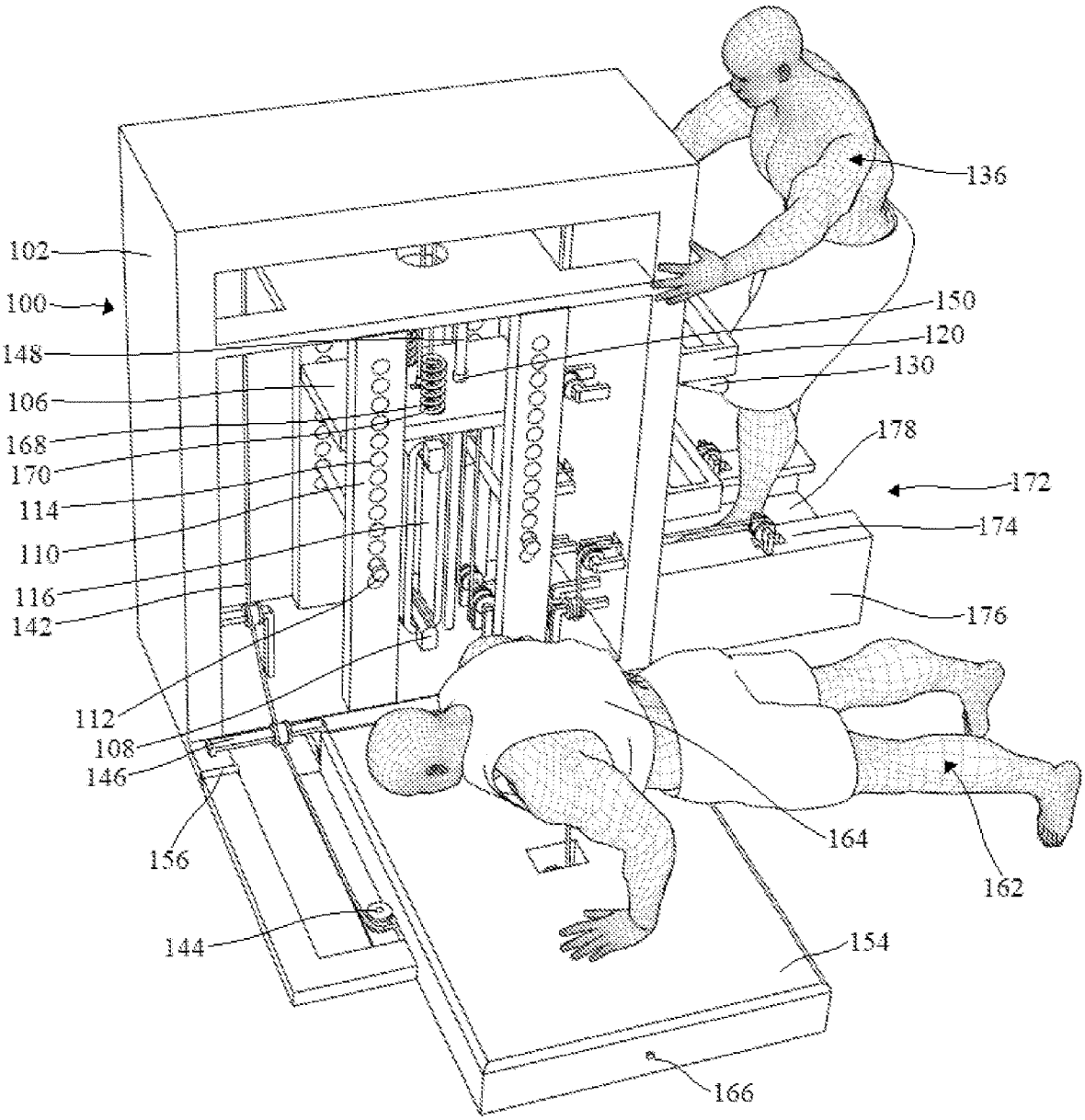
Figure 15N:
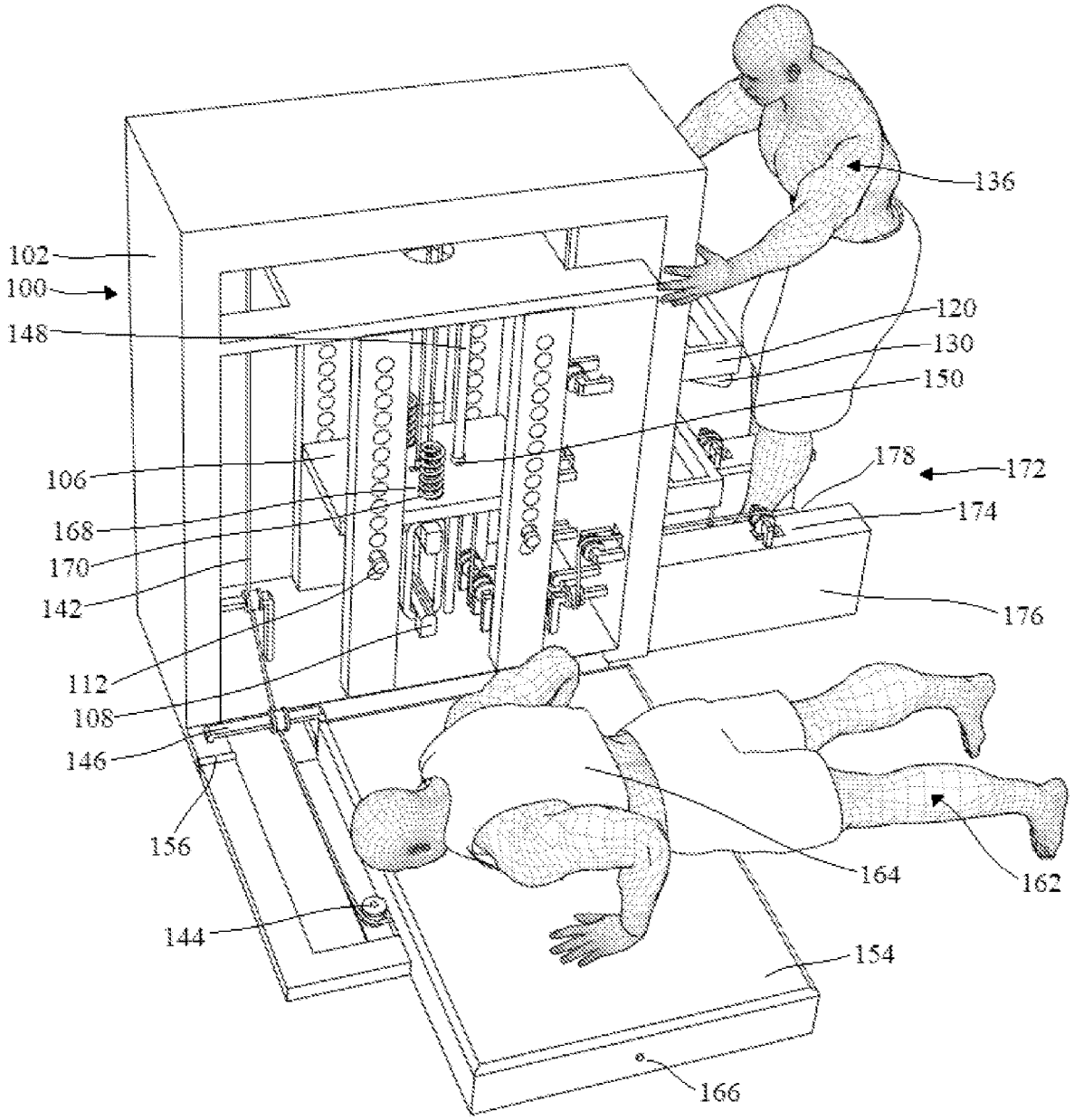

FIGS. 15A-15N, show a way the user can perform full range of motion from start to end position of an exercise contracting against the resistance band and the springs approaching the end position of the exercise then contract against additional resistance in the negative phase of the movement with the help of the training partner using weights and/or manual resistance applied to the NRAF.

DRAWINGS—REFERENCE NUMERALS

100 resistance band exercise machine
102 cable-pulley variable resistance system housing
104 cable-pulley variable resistance system
106 top plate
108 resistance band hook
110 uprights
112 safety bars
114 safety bar hole
116 resistance band
118 joined safety bar
120 container
122 input lifting arm
124 handle grip
126 shoulder padding
128 training partner assistantship
130 exercise handle attachment
132 snap link hook
134 O ring
136 training partner
138 strap
140 strap handle grip
142 cable
144 pulley
146 pulley mounts
148 guide rods
150 shaft collar
152 cable-to-top plate adapter
154 platform
156 hinge
158 cable stopper ball
160 cable thimble
162 user
164 harness or belt
166 rod
168 springs
170 recessed spring pocket
172 negative repetition assistance feature
174 negative cable-pulley system
176 negative platform housing
178 negative platform
180 negative platform indicia
182 rubber cushion
184 kettlebell Advantages From the description above, a number of advantages of my resistance band exercise machine become evident:

1) The user can perform full/partial range of motion push-up exercises in the prone position with their hands on the platform of the resistance band exercise machine against primary and secondary sources of variably increasing resistance.
2) The user can perform full/partial range of motion push-up exercises in the prone position with their hands on the platform of the resistance band exercise machine against primary source of variably increasing resistance with isometrics using safety bars.
3) The user can perform push-up exercises in the prone position with their hands on the platform of the resistance band exercise machine against primary and secondary sources of variably increasing resistance using full/partial range of motion negative repetitions only with the help of training partners.
4) The user can perform isolation (single-joint) and compound (multi-joint) movement exercises contracting against primary and secondary sources of variably increasing resistance in proper form utilizing cable pulley systems and the ergonomic/biomechanical design features of weightlifting exercise machines. This allows the user to contract against variably increasing resistance along the direction of the muscle group's muscle fibers.
5) The user can perform isolation (single-joint) and compound (multi-joint) movement exercises against primary source of variably increasing resistance through full/partial range of motion with isometrics using safety bars.
6) The user can perform isolation (single-joint) and compound (multi-joint) movement exercises against primary and secondary sources of variably increasing resistance using full/partial range of motion negative repetitions only with the help of training partners.

CONCLUSION, RAMIFICATIONS, AND SCOPE

Accordingly, the reader will see that the resistance band exercise machine allows a user to perform exercises including exercises from U.S. patent application publication 20190374814-A1 through dynamic motion (full range motion and partial range of motion), full/partial range of motion negative repetitions only using training partners, and static position (yielding isometrics and overcoming isometrics) using primary and secondary sources of variably increasing resistance as well as safety bars in one machine. Also, the user can quickly change the resistance level and multiple users can perform push-up exercises in the prone position together assisting one another with no muscular effort lost. In addition, the user can perform more repetitions in the strong range of motion (from mid to end position of an exercise) using primary and secondary sources of variably increasing resistance with the help of training partners. Furthermore, the resistance band exercise machine has the additional advantages in that:

1) It allows the user to perform exercises along the direction of the muscle group's muscle fibers with comfort and proper form using primary and secondary sources of variably increasing resistance, cable pulley system, and ergonomic/biomechanical design features of exercise machines.
2) It allows the user to train a muscle group to its maximum strength capability by increasing the variability in resistance level using primary and secondary sources of variably increasing resistance to match a muscle group's strength curve.
3) It allows the user to perform exercises using isometrics training protocol which is a combination of isometric and isotonic exercises in one machine.
4) It allows the user to perform more full/partial range of motion negative repetitions only against variably decreasing resistances from primary and secondary sources of resistances with the help of training partners.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A resistance member exercise machine, the exercise machine comprising:

a first resistance attachment member secured to a cable-pulley system, wherein the first resistance attachment member is configured to temporarily receive one or more variable resistance members;

the cable-pulley system including a cable operably connected to a user-interaction element through which a user can impart a force to cause the first resistance attachment member to move;

a second resistance attachment member fixed to a base structure of the resistance member exercise machine, wherein the second resistance attachment member is configured to temporarily receive the one or more variable resistance members;

wherein the first resistance attachment member is configured to move away from the second resistance attachment member when force is imparted onto the user-interaction element that is greater than a resistance force of the one or more variable resistance members secured to both the first resistance attachment member and the second resistance attachment member;

a training partner assistantship feature operably connected to the first resistance attachment member, wherein the training partner assistantship feature is configured to allow another user to impart a force onto the first resistance attachment member via the training partner assistantship feature to reduce a total force imparted on the user; and a negative repetition assistance feature operably connected to the first resistance attachment member, wherein the negative repetition assistance feature is configured to allow another user to impart an additional force onto the first resistance attachment member to increase the total force imparted onto the user.

2. The machine of claim 1, further including a guide rail, wherein the first resistance attachment member is configured to translate along a length of a guide rail, the guide rail including:

a first end, a second end, and the length extending therebetween;

at least one safety bar attachment point along the length of the guide rail between the first and second ends of the guide rail;

wherein at least one safety bar reduces a range of motion and sets a starting position of the first resistance attachment member when the at least one safety bar is secured to the at least one safety bar attachment point between the first and second ends of the guide rail.

3. The machine of claim 2, further including a secondary resistance member configured to apply a secondary resistance force on the first resistance attachment member when the first resistance attachment member reaches a predetermined distance from the second end of the guide rail.

4. The machine of claim 3, wherein the secondary resistance member is one or more springs.

5. The machine of claim 2, wherein the guide rail includes a multitude of apertures longitudinally spaced about the length of the guide rail and configured to receive the at least one safety bar.

6. The machine of claim 1, further including an exercise platform, wherein the cable extends below or through the exercise platform and is accessible through a top surface of the exercise platform such that the user can engage the cable as needed.

7. The machine of claim 6, wherein the user-interaction element is a user-wearable device configured to connect to the cable to allow the user to perform push-up exercises in the prone position with their hands on the exercise platform to overcome resistance force from the one or more variable resistance members.

8. The machine of claim 1, wherein the first resistance attachment member is a plate-like structure having a hook-shaped structure.

9. The machine of claim 1, wherein the one or more variable resistance members are elastic resistance bands.

10. The machine of claim 1, wherein the training partner assistantship feature includes a lifting arm with a handle grip and/or a shoulder padding.

11. The machine of claim 1, further including:

a first hook on the first resistance attachment member;

a second hook on the second resistance attachment member; and whereby the one or more variable resistance members are configured to be looped around the first and second hooks.

12. A resistance member exercise machine, the exercise machine comprising:

a first resistance attachment member secured to a cable-pulley system, wherein the first resistance attachment member is configured to temporarily receive one or more elastic resistance bands;

the cable-pulley system including a cable operably connected to a user-interaction element through which a user can impart a force to cause the first resistance attachment member to move;

a second resistance attachment member fixed to a base structure of the resistance member exercise machine, wherein the second resistance attachment member is configured to temporarily receive the one or more elastic resistance bands;

wherein the first resistance attachment member is configured to move away from the second resistance attachment member when force is imparted onto the user-interaction element that is greater than a resistance force of the one or more elastic resistance bands secured to both the first resistance attachment member and the second resistance attachment member; and a negative repetition assistance feature operably connected to the first resistance attachment member, wherein the negative repetition assistance feature is configured to allow another user to impart an additional force onto a platform that transfers the additional force to the first resistance attachment member to increase the total force imparted onto the user.

13. The machine of claim 12, further including an exercise platform, wherein the cable extends below or through the exercise platform and is accessible through a top surface of the exercise platform such that the user can engage the cable as needed.

14. The machine of claim 13, wherein the user-interaction element is a user-wearable device configured to connect to the cable to allow the user to perform push-up exercises in the prone position with their hands on the exercise platform to overcome resistance force from the one or more elastic resistance bands.

15. The machine of claim 12, wherein the first resistance attachment member is a plate-like structure having a hook-shaped structure.

16. The machine of claim 12, wherein the first resistance attachment member is further configured to translate along a length of a guide rail, the guide rail further including:

a first end, a second end, and the length extending therebetween;

a multitude of apertures longitudinally spaced about the length of the guide rail between the first and second ends of the guide rail, each aperture configured to receive at least one safety bar;

wherein the at least one safety bar reduces a range of motion and sets a starting position of the first resistance attachment member when the at least one safety bar is secured between the first and second ends of the guide rail.

17. The machine of claim 12, further including:

a first hook on the first resistance attachment member;

a second hook on the second resistance attachment member; and whereby the one or more elastic resistance bands are configured to be looped around the first and second hooks.

18. A resistance member exercise machine, the exercise machine comprising:

a first resistance attachment member secured to a cable-pulley system, wherein the first resistance attachment member is configured to temporarily receive one or more variable resistance members;

the cable-pulley system including a cable operably connected to a user-interaction element through which a user can impart a force to cause the first resistance attachment member to move;

a second resistance attachment member fixed to a base structure of the resistance member exercise machine, wherein the second resistance attachment member is configured to temporarily receive the one or more variable resistance members;

wherein the first resistance attachment member is configured to move away from the second resistance attachment member when force is imparted onto the user-interaction element that is greater than a resistance force of the one or more variable resistance members secured to both the first resistance attachment member and the second resistance attachment member; and a negative repetition assistance feature operably connected to the first resistance attachment member, wherein the negative repetition assistance feature is configured to allow another user to impart an additional force onto a platform that transfers the additional force to the first resistance attachment member to increase the total force imparted onto the user.

* * * * *